US009327867B2

(12) United States Patent
Stanley et al.

(10) Patent No.: US 9,327,867 B2
(45) Date of Patent: May 3, 2016

(54) ENHANCEMENTS TO TACTILE INTERACTION WITH FILM WALLED PACKAGING HAVING AIR FILLED STRUCTURAL SUPPORT VOLUMES

(71) Applicant: The Procter & Gamble Company, Cincinnati, OH (US)

(72) Inventors: Scott Kendyl Stanley, Mason, OH (US); Kenneth Stephen McGuire, Montgomery, OH (US); Joseph Craig Lester, Liberty Township, OH (US); Andrew Paul Rapach, Fairfield, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 14/448,599

(22) Filed: Jul. 31, 2014

(65) Prior Publication Data

US 2015/0034662 A1 Feb. 5, 2015

Related U.S. Application Data

(60) Provisional application No. 61/861,129, filed on Aug. 1, 2013.

(51) Int. Cl.
*B65D 6/00* (2006.01)
*B65D 75/00* (2006.01)

(52) U.S. Cl.
CPC ..... *B65D 11/10* (2013.01); *B65D 75/008* (2013.01)

(58) Field of Classification Search
CPC .. B65D 1/0292; B65D 21/086; B65D 1/0223; B65D 1/40; B65D 35/12; B65D 35/02; B65D 11/10; B65D 75/008
USPC ..... 220/666, 907, 6; 215/900, 381; 222/107, 92, 94; 53/456; 428/35.7
See application file for complete search history.

(56) References Cited

U.S. PATENT DOCUMENTS

| | | | |
|---|---|---|---|
| 3,730,240 | A | 5/1973 | Presnick |
| 3,742,994 | A | 7/1973 | Pensak |
| 3,930,286 | A | 1/1976 | McGowen |

(Continued)

FOREIGN PATENT DOCUMENTS

| | | | |
|---|---|---|---|
| CN | 201272533 | Y | 7/2009 |
| DE | 20 2005 016704 | | 7/2006 |

(Continued)

OTHER PUBLICATIONS

PCT International Search Report and Written Opinion for PCT/US2013/039800, dated Aug. 12, 2013.

(Continued)

*Primary Examiner* — Robert J Hicks
(74) *Attorney, Agent, or Firm* — Charles R. Ware

(57) ABSTRACT

Non-durable self-supporting flexible containers having gradients where at least one of a plurality of physical characteristics that are perceptible via tactile interaction with an exterior surface of the container are varied across the exterior of the container. The flexible containers may permit users to perceive viscosity or relative thermal condition of contained product in discrete zones or regions of the container through one or more outer surface of the container without direct interaction with the product, or vary hardness or softness of the container.

20 Claims, 37 Drawing Sheets

(56) References Cited

U.S. PATENT DOCUMENTS

| | | | | |
|---|---|---|---|---|
| 4,044,867 | A | 8/1977 | Fisher | |
| 4,189,456 | A | 2/1980 | Rausing | |
| 4,384,603 | A * | 5/1983 | Tyrer et al. | 220/4.23 |
| 4,503,558 | A | 3/1985 | Lief et al. | |
| 4,615,926 | A | 10/1986 | Hsu et al. | |
| 4,700,531 | A | 10/1987 | Hsu et al. | |
| 4,704,314 | A | 11/1987 | Hsu et al. | |
| 4,978,025 | A | 12/1990 | Fougeres | |
| 4,988,016 | A * | 1/1991 | Hawkins et al. | 222/92 |
| 5,137,154 | A * | 8/1992 | Cohen | 206/522 |
| 5,263,587 | A | 11/1993 | Elkin et al. | |
| 5,469,966 | A | 11/1995 | Boyer | |
| 5,489,464 | A | 2/1996 | Bjorck | |
| 5,692,833 | A | 12/1997 | DeLuca | |
| 5,791,485 | A * | 8/1998 | Carbonneau | 206/720 |
| 5,880,241 | A * | 3/1999 | Brookhart et al. | 526/348 |
| 5,950,833 | A * | 9/1999 | James | 206/522 |
| 5,960,975 | A | 10/1999 | Lennartsson | |
| 6,015,235 | A | 1/2000 | Kraimer et al. | |
| 6,206,569 | B1 | 3/2001 | Kraimer et al. | |
| 6,244,441 | B1 | 6/2001 | Ahlgren | |
| 6,244,466 | B1 * | 6/2001 | Naslund | 222/94 |
| 6,520,332 | B1 | 2/2003 | Barmore et al. | |
| 6,682,825 | B1 | 1/2004 | Kennedy et al. | |
| 6,913,803 | B2 | 7/2005 | Peper | |
| 6,978,893 | B2 | 12/2005 | Peper | |
| 6,982,113 | B2 | 1/2006 | Kannankeril et al. | |
| 7,021,505 | B2 | 4/2006 | Franczyk | |
| 7,056,593 | B2 | 6/2006 | Kennedy et al. | |
| 7,168,566 | B2 | 1/2007 | Anderson et al. | |
| 7,168,567 | B2 | 1/2007 | Peper et al. | |
| 7,207,717 | B2 * | 4/2007 | Steele | 383/38 |
| 7,344,038 | B2 | 3/2008 | Elansary | |
| 7,494,279 | B2 | 2/2009 | Marquet et al. | |
| 7,585,528 | B2 | 9/2009 | Ferri et al. | |
| 7,722,254 | B2 | 5/2010 | Murray | |
| 7,883,268 | B2 | 2/2011 | Steele | |
| 8,028,502 | B2 | 10/2011 | Murray | |
| 8,206,033 | B2 | 6/2012 | Sato et al. | |
| 8,500,330 | B2 | 8/2013 | Nomura et al. | |
| 2003/0094394 | A1 | 5/2003 | Anderson et al. | |
| 2003/0094395 | A1 | 5/2003 | Peper et al. | |
| 2003/0096068 | A1 * | 5/2003 | Peper | 428/34.1 |
| 2003/0161999 | A1 | 8/2003 | Kannankeril et al. | |
| 2003/0192909 | A1 | 10/2003 | Maskell | |
| 2004/0035865 | A1 | 2/2004 | Rosen | |
| 2005/0263426 | A1 | 12/2005 | Ho | |
| 2006/0210773 | A1 | 9/2006 | Kannankeril | |
| 2007/0084745 | A1 | 4/2007 | Yoshifusa | |
| 2008/0149666 | A1 | 6/2008 | LaFlamme et al. | |
| 2008/0193055 | A1 | 8/2008 | Chen et al. | |
| 2008/0245804 | A1 | 10/2008 | Weinberger | |
| 2008/0277310 | A1 | 11/2008 | Chacon | |
| 2010/0061664 | A1 | 3/2010 | Gustafsson et al. | |
| 2010/0308062 | A1 | 12/2010 | Helou, Jr. | |
| 2011/0039098 | A1 | 2/2011 | Forloni et al. | |
| 2011/0062051 | A1 | 3/2011 | Miller | |
| 2011/0079608 | A1 | 4/2011 | Mamiye | |
| 2011/0290798 | A1 | 12/2011 | Corbett et al. | |
| 2012/0085785 | A1 * | 4/2012 | Sand | 222/173 |
| 2012/0097634 | A1 | 4/2012 | Riedl | |
| 2013/0292287 | A1 | 11/2013 | Stanley et al. | |
| 2013/0292353 | A1 | 11/2013 | Stanley et al. | |
| 2013/0292395 | A1 | 11/2013 | Stanley | |
| 2013/0292413 | A1 | 11/2013 | Stanley et al. | |
| 2013/0292415 | A1 | 11/2013 | Stanley et al. | |
| 2013/0294711 | A1 | 11/2013 | Stanley et al. | |
| 2014/0033654 | A1 | 2/2014 | Stanley | |
| 2014/0033655 | A1 | 2/2014 | Stanley | |

FOREIGN PATENT DOCUMENTS

| | | | | |
|---|---|---|---|---|
| DE | 102005002301 | A1 | 7/2006 | |
| EP | 0 654 418 | A1 | 5/1995 | |
| EP | 1964785 | A2 | 9/2008 | |
| FR | 2638715 | | 10/1990 | |
| FR | 2801287 | | 4/2002 | |
| JP | 2001-270533 | A1 | 10/2001 | |
| JP | 2009-184690 | A | 8/2009 | |
| WO | 96/01775 | A1 | 1/1996 | |
| WO | WO 02085729 | A1 * | 10/2002 | B31B 19/74 |
| WO | WO 03051740 | A2 * | 6/2003 | B65D 75/52 |
| WO | 2005/063589 | A1 | 7/2005 | |
| WO | 2005/108065 | A1 | 11/2005 | |
| WO | 2008/064508 | A1 | 6/2008 | |
| WO | 2012/062806 | A1 | 3/2012 | |

OTHER PUBLICATIONS

PCT International Search Report and Written Opinion for PCT/US2013/039801, dated Aug. 12, 2013.
PCT International Search Report and Written Opinion for PCT/US2013/039809, dated Aug. 8, 2013.
PCT International Search Report and Written Opinion for PCT/US2013/039811, dated Aug. 14, 2013.
PCT International Search Report and Written Opinion for PCT/US2013/039807, dated Aug. 12, 2013.
PCT International Search Report and Written Opinion for PCT/US2013/053204, dated Nov. 13, 2013.
PCT International Search Report and Written Opinion for PCT/US2013/053205, dated Nov. 22, 2013.
PCT International Search Report and Written Opinion for PCT/US2013/039804, dated Aug. 12, 2013.
PCT International Search Report and Written Opinion for PCT/US2013/039802, dated Aug. 12, 2013.
PCT International Search Report and Written Opinion for PCT/US2014/049058 dated Nov. 11, 2014.
All Office Actions, U.S. Appl. No. 13/888,679.
All Office Actions, U.S. Appl. No. 13/888,963.
All Office Actions, U.S. Appl. No. 13/888,756.

* cited by examiner

ENHANCEMENTS TO TACTILE INTERACTION WITH FILM WALLED PACKAGING HAVING AIR FILLED STRUCTURAL SUPPORT VOLUMES

FIELD OF THE INVENTION

The present disclosure relates in general to containers, and in particular, to aspects of disposable containers that enhance tactile interaction with the containers and facilitate variations in tactile interaction across different regions or surfaces of the containers.

BACKGROUND OF THE INVENTION

Fluent products include liquid products and/or pourable solid products. In various embodiments, a container can be used to receive, contain, and dispense one or more fluent products. And, in various embodiments, a container can be used to receive, contain, and/or dispense individual articles or separately packaged portions of a product. A container can include one or more product volumes. A product volume can be configured to be filled with one or more fluent products. A container receives a fluent product when its product volume is filled. Once filled to a desired volume, a container can be configured to contain the fluent product in its product volume, until the fluent product is dispensed. A container contains a fluent product by providing a barrier around the fluent product. The barrier prevents the fluent product from escaping the product volume. The barrier can also protect the fluent product from the environment outside of the container. A filled product volume is typically closed off by a cap or a seal. A container can be configured to dispense one or more fluent products contained in its product volume(s). Once dispensed, an end user can consume, apply, or otherwise use the fluent product(s), as appropriate. In various embodiments, a container may be configured to be refilled and reused or a container may be configured to be disposed of after a single fill or even after a single use. A container should be configured with sufficient structural integrity, such that it can receive, contain, and dispense its fluent product(s), as intended, without failure.

A container for fluent product(s) can be handled, displayed for sale, and put into use. A container can be handled in many different ways as it is made, filled, decorated, packaged, shipped, and unpacked. A container can experience a wide range of external forces and environmental conditions as it is handled by machines and people, moved by equipment and vehicles, and contacted by other containers and various packaging materials. A container for fluent product(s) should be configured with sufficient structural integrity, such that it can be handled in any of these ways, or in any other way known in the art, as intended, without failure.

A container can also be displayed for sale in many different ways as it is offered for purchase. A container can be offered for sale as an individual article of commerce or packaged with one or more other containers or products, which together form an article of commerce. A container can be offered for sale as a primary package with or without a secondary package. A container can be decorated to display characters, graphics, branding, and/or other visual elements when the container is displayed for sale. A container can be configured to be displayed for sale while laying down or standing up on a store shelf, while presented in a merchandising display, while hanging on a display hanger, or while loaded into a display rack or a vending machine. A container for fluent product(s) should be configured with a structure that allows it to be displayed in any of these ways, or in any other way known in the art, as intended, without failure.

A container can also be put into use in many different ways, by its end user. A container can be configured to be held and/or gripped by an end user, so a container should be appropriately sized and shaped for human hands; and for this purpose, a container can include useful structural features such as a handle and/or a gripping surface. A container can be stored while laying down or standing up on a support surface, while hanging on or from a projection such as a hook or a clip, or while supported by a product holder, or (for refillable or rechargeable containers) positioned in a refilling or recharging station. A container can be configured to dispense fluent product(s) while in any of these storage positions or while being held by the user. A container can be configured to dispense fluent product(s) through the use of gravity, and/or pressure, and/or a dispensing mechanism, such as a pump, or a straw, or through the use of other kinds of dispensers known in the art. Some containers can be configured to be filled and/or refilled by a seller (e.g. a merchant or retailer) or by an end user. A container for fluent product(s) should be configured with a structure that allows it to be put to use in any of these ways, or in any other way known in the art, as intended, without failure. A container can also be configured to be disposed of by the end user, as waste and/or recyclable material, in various ways.

One conventional type of container for fluent products is a rigid container made from solid material(s). Examples of conventional rigid containers include molded plastic bottles, glass jars, metal cans, cardboard boxes, etc. These conventional rigid containers are well-known and generally useful; however their designs do present several notable difficulties. First, some conventional rigid containers for fluent products can be expensive to make. Some rigid containers are made by a process shaping one or more solid materials. Other rigid containers are made with a phase change process, where container materials are heated (to soften/melt), then shaped, then cooled (to harden/solidify). Both kinds of making are energy intensive processes, which can require complex equipment.

Second, some conventional rigid containers for fluent products can require significant amounts of material. Rigid containers that are designed to stand up on a support surface require solid walls that are thick enough to support the containers when they are filled. This can require significant amounts of material, which adds to the cost of the containers and can contribute to difficulties with their disposal.

Third, some conventional rigid containers for fluent products can be difficult to decorate. The sizes, shapes, (e.g. curved surfaces) and/or materials of some rigid containers, make it difficult to print directly on their outside surfaces. Labeling requires additional materials and processing, and limits the size and shape of the decoration. Overwrapping provides larger decoration areas, but also requires additional materials and processing, often at significant expense.

Fourth, some conventional rigid containers for fluent products can be prone to certain kinds of damage. If a rigid container is pushed against a rough surface, then the container can become scuffed, which may obscure printing on the container. If a rigid container is pressed against a hard object, then the container can become dented, which may look unsightly. And if a rigid container is dropped, then the container can rupture, which may cause its fluent product to be lost.

Fifth, some fluent products in conventional rigid containers can be difficult to dispense. When an end user squeezes a rigid container to dispense its fluent product, the end user must overcome the resistance of the rigid sides, to deform the container. Some users may lack the hand strength to easily overcome that resistance; these users may dispense less than their desired amount of fluent product. Other users may need to apply so much of their hand strength, that they cannot easily control how much they deform the container; these users may dispense more than their desired amount of fluent product.

SUMMARY OF THE INVENTION

The present disclosure describes various embodiments of containers made from flexible material. Because these containers are made from flexible material, these containers can be less expensive to make, can use less material, and can be easier to decorate, when compared with conventional rigid containers. First, these containers can be less expensive to make, because the conversion of flexible materials (from sheet form to finished goods) generally requires less energy and complexity, than formation of rigid materials (from bulk form to finished goods). Second, these containers can use less material, because they are configured with novel support structures that do not require the use of the thick solid walls used in conventional rigid containers. Third, these flexible containers can be easier to print and/or decorate, because they are made from flexible materials, and flexible materials can be printed and/or decorated as conformable webs, before they are formed into containers. Even though the containers of the present disclosure are made from flexible material, they can be configured with sufficient structural integrity, such that they can receive, contain, and dispense fluent product(s), as intended, without failure. Also, these containers can be configured with sufficient structural integrity, such that they can withstand external forces and environmental conditions from handling, without failure. Further, these containers can be configured with structures that allow them to be displayed and put into use, as intended, without failure.

The disposable containers of the present disclosure permit the manufacturer to achieve gradients in a plurality of physical characteristics of the containers across various surfaces or regions of the containers. For instance, one can vary the hardness of different regions or locations on the containers. Instead or in addition, due to the relatively low thermal conductivity of air compared to films, through strategic placement of structural support volumes and also non-structural volumes comprising surface elements on non-structural panels at least partially defining product volumes, one can achieve a desired control of thermal conductivity from the product volume to the container exterior or from the container exterior to the product volume.

When a disposable flexible container is filled with a flowable product, such as a liquid product, that flowable product, when separated from a user's fingers by only a film panel or wall having a thermal conductivity coefficient $K_{eff}$ of, for example, about 0.5 Watt/meter K, the body heat in the user's finger tends to be drawn through the film to the flowable product, tending to give the user a tactile sensation of coolness, when the product is cooler than the hand. This level of tactile interaction with a contained flowable product is not as great when the flowable product is contained in a bottle. There are also applications for the disposable flexible containers of the present disclosure, such in the case of beverage containers, where it is desired to insulate the contents of the container from the user's body so as to maintain the temperature of the contents of the container as long as possible (i.e., to keep cool beverages cool or to prevent heat loss from hot beverages to the hand). Moreover, by strategically providing one or more non-structural volumes along that film panel of a disposable flexible container, which nonstructural volumes are filled with a gas such as air and/or nitrogen, a foam, a powder, solid, flowable, or any material with low thermal conductivity, the structural support volumes and the nonstructural volumes (when present) serve as insulators, with a thermal conductivity coefficient $K_{eff}$ as low as about 0.03 Watt/meter K or ranging from about 0.03 Watt/meter K to about 0.5 Watt/meter K, interrupting the high thermal interaction between the user's body part, such as the user's fingers, hand, foot, mouth, lips, eyelids, face, head, or skin, and the contained flowable product across regions of the container where no structural support volumes or nonstructural support volumes are present. This allows the manufacturer to achieve a desired gradient of thermal conductivity or thermal interaction with contained fluent product across the surfaces of a disposable flexible container.

In addition to the above-described thermal interaction between the user's body part and the contained fluent product, at least one or more portions of the one or more nonstructural panels are preferably sufficiently thin and smooth such that the viscosity of a liquid contained in the product volume is tactilely perceptible from an exterior of the container by touching those portions of the one or more nonstructural panels. In cases of solid, semi-solid, or at least partially solid fluent products, though one or more nonstructural panels, or at least one or more portions thereof, may permit tactile perception of the texture of the fluent products.

In an exemplary embodiment, a disposable flexible container for a fluent product comprises a product volume for the fluent product at least partially defined by one or more structural support volumes and a nonstructural panel having one or more flat spaces. It is found that the pressures to which the one or more structural support volumes are expanded, inflated, or otherwise filled, affect the manner in which a user's hand grips the disposable flexible container. If the pressure to which a given structural support volume is expanded, inflated, or otherwise filled, is too great, the structural support volume can be uncomfortable to the user's hand or create a container that is too difficult to squeeze and dispense a fluent product. On the other hand, if the pressure of the structural support volume is too low, the disposable flexible container may sag or otherwise lose structure afforded to it by the structural support volume. The structural support volumes of the disposable flexible container of the present disclosure are preferably expanded, inflated, or otherwise filled, to a gauge pressure in the range of about 13,750 Pa to about 69,000 Pa, more preferably about 20,000 Pa to about 69,000 Pa, even more preferably about 27,500 Pa to about 55,000 Pa, and even more preferably about 34,400 Pa.

According to a further aspect, a cover material is joined to at least one of an outer surface of the nonstructural panel or an outer surface of the container. This cover material may be joined to the underlying nonstructural panel and/or structural support volumes by a variety of joining techniques, such as lamination, heat seal, adhesive, weld, tack, and sew. The cover material may include one or more of a flexible material, film laminate, a non-woven, a vacuum-formed material, a hydro-formed material, a woven material, and a solid-state formed material. The cover material preferably has a different texture than the portions of the outer surfaces of the nonstructural panel and/or the one or more structural support volumes not covered by the cover material. Because such a cover material, or even a plurality of different-textured cover materials, may be selectively provided on various surfaces of the flexible container, such cover materials provide yet another way for the manufacturer to vary tactile interaction at different locations of a given disposable flexible container.

The manner in which these and other aspects of the present disclosure are achieved is explained in the following detailed description of the preferred embodiments, with reference to the accompanying drawings.

DETAILED DESCRIPTION OF THE INVENTION

Figure 1A:
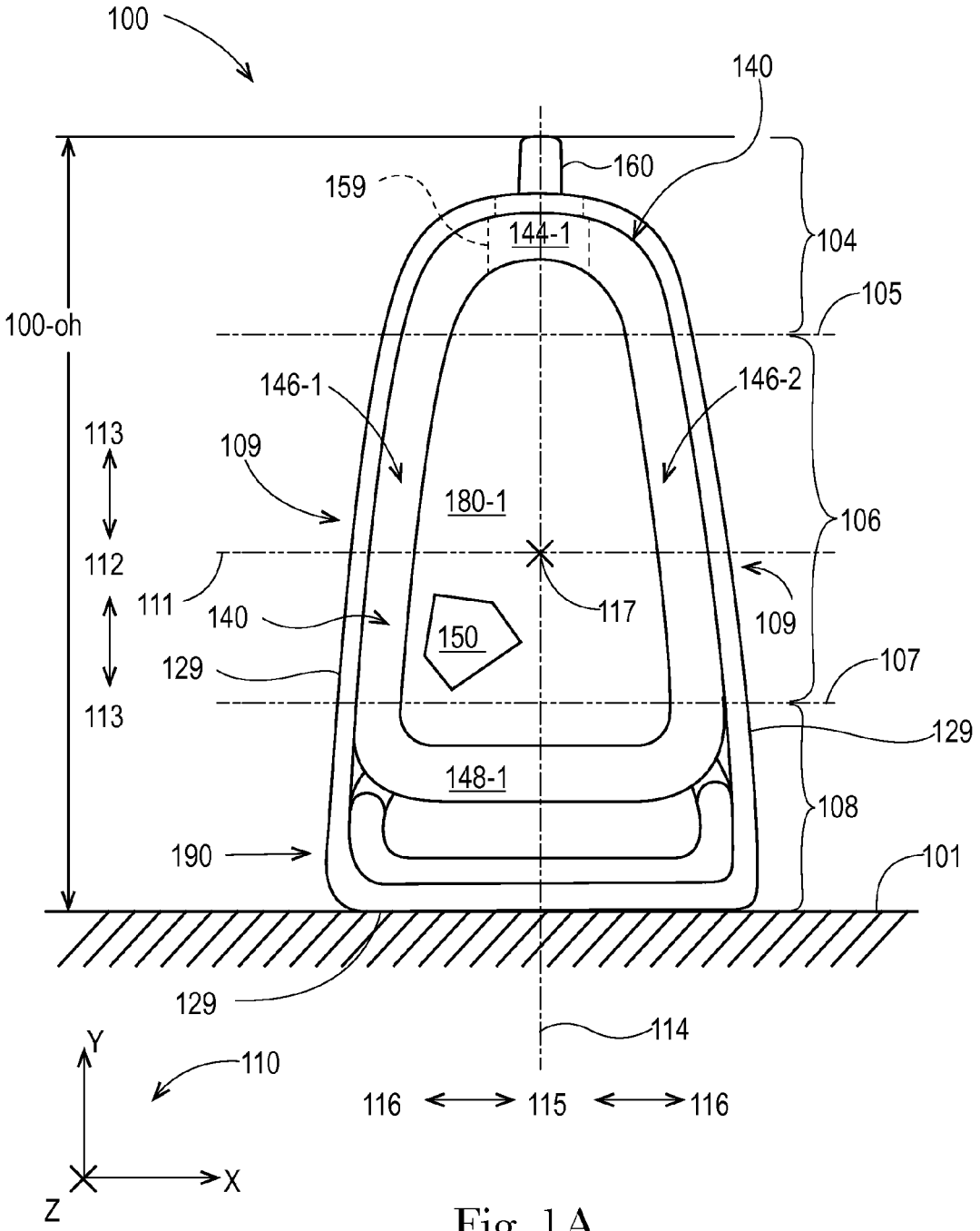
FIG. 1A illustrates a front view of an embodiment of a stand up flexible container.

The present disclosure describes various embodiments of containers made from flexible material. Because these containers are made from flexible material, these containers can be less expensive to make, can use less material, and can be easier to decorate, when compared with conventional rigid containers. First, these containers can be less expensive to make, because the conversion of flexible materials (from sheet form to finished goods) generally requires less energy and complexity, than formation of rigid materials (from bulk form to finished goods). Second, these containers can use less material, because they are configured with novel support structures that do not require the use of the thick solid walls used in conventional rigid containers. Third, these flexible containers can be easier to decorate, because their flexible materials can be easily printed before they are formed into containers. Fourth, these flexible containers can be less prone to scuffing, denting, and rupture, because flexible materials allow their outer surfaces to deform when contacting surfaces and objects, and then to bounce back. Fifth, fluent products in these flexible containers can be more readily and carefully dispensed, because the sides of flexible containers can be more easily and controllably squeezed by human hands.

Even though the containers of the present disclosure are made from flexible material, they can be configured with sufficient structural integrity, such that they can receive, contain, and dispense fluent product(s), as intended, without failure. Also, these containers can be configured with sufficient structural integrity, such that they can withstand external forces and environmental conditions from handling, without failure. Further, these containers can be configured with structures that allow them to be displayed for sale and put into use, as intended, without failure.

As used herein, the term "about" modifies a particular value, by referring to a range equal to the particular value, plus or minus twenty percent (+/−20%). For any of the embodiments of flexible containers, disclosed herein, any disclosure of a particular value, can, in various alternate embodiments, also be understood as a disclosure of a range equal to about that particular value (i.e. +/−20%).

As used herein, the term "ambient conditions" refers to a temperature within the range of 15-35 degrees Celsius and a relative humidity within the range of 35-75%.

As used herein, the term "approximately" modifies a particular value, by referring to a range equal to the particular value, plus or minus fifteen percent (+/−15%). For any of the embodiments of flexible containers, disclosed herein, any disclosure of a particular value, can, in various alternate embodiments, also be understood as a disclosure of a range equal to approximately that particular value (i.e. +/−15%).

As used herein, when referring to a sheet of material, the term "basis weight" refers to a measure of mass per area, in units of grams per square meter (gsm). For any of the embodiments of flexible containers, disclosed herein, in various embodiments, any of the flexible materials can be configured to have a basis weight of 10-1000 gsm, or any integer value for gsm from 10-1000, or within any range formed by any of these values, such as 20-800 gsm, 30-600 gsm, 40-400 gsm, or 50-200, etc.

As used herein, when referring to a user, the term "body" refers to an outer surface of a mammal, for example a human, and may include, without limitation, hands, fingers, arms, feet, toes, legs, joints, head, face, back, genitalia, chest, mouth, ears, and neck.

As used herein, when referring to a flexible container, the term "bottom" refers to the portion of the container that is located in the lowermost 30% of the overall height of the container, that is, from 0-30% of the overall height of the container. As used herein, the term bottom can be further limited by modifying the term bottom with a particular percentage value, which is less than 30%. For any of the embodiments of flexible containers, disclosed herein, a reference to the bottom of the container can, in various alternate embodiments, refer to the bottom 25% (i.e. from 0-25% of the overall height), the bottom 20% (i.e. from 0-20% of the overall height), the bottom 15% (i.e. from 0-15% of the overall height), the bottom 10% (i.e. from 0-10% of the overall height), or the bottom 5% (i.e. from 0-5% of the overall height), or any integer value for percentage between 0% and 30%.

As used herein, the term "branding" refers to a visual element intended to distinguish a product from other products. Examples of branding include one of more of any of the following: trademarks, trade dress, logos, icons, and the like. For any of the embodiments of flexible containers, disclosed herein, in various embodiments, any surface of the flexible container can include one or more brandings of any size, shape, or configuration, disclosed herein or known in the art, in any combination.

As used herein, the term "character" refers to a visual element intended to convey information. Examples of characters include one or more of any of the following: letters, numbers, symbols, and the like. For any of the embodiments of flexible containers, disclosed herein, in various embodiments, any surface of the flexible container can include one or more characters of any size, shape, or configuration, disclosed herein or known in the art, in any combination.

As used herein, the term "characteristic" refers to an identifiable attribute, physical or chemical state, or physical property of the fluent product. A characteristic of the fluent product may include, without limitation, softness, strength, rigidity, smoothness, viscosity, rheology, percent solids, density, compositional variations, temperature, and lubricity. Additional example characteristics may include, without limitation, for the solids comprising a fluent product, size of individual solids and size variation of the pourable solids, hardness or crushability of one or more of the pourable solids, the force to displace a volume of the product containing multiples of the individual solids, the texture of individual solids and/or of the volume of the product containing multiples of the individual solids, or the tackiness or stickiness between individual solids. Some of these or other characteristics relate to how a solid will flow, i.e. how pourable the solid is, such as from the container or when later deposited onto a surface or into another container.

As used herein, the term "closed" refers to a state of a product volume, wherein fluent products within the product volume are prevented from escaping the product volume (e.g. by one or more materials that form a barrier, and by a cap), but the product volume is not necessarily hermetically sealed. For example, a closed container can include a vent, which allows a head space in the container to be in fluid communication with air in the environment outside of the container. As used herein, the term "cover material" refers to a material that is joined to at least a portion of the outer surface of the container. For example, the cover material can be joined to at least a portion of a structural support member and/or a nonstructural panel. The cover material can cover a portion or the entirety of the outer surface of the container. For example, in one embodiment, the cover material can be secured to a portion of the outer surface of the container to cover one or more seams projecting outwardly from the container. The cover material can be joined to at least a portion of the outer surface of the container using any suitable methods, including, for example, lamination, heat seal, adhesive, weld, tack, and sew methods. The cover material can be any suitable flexible material including, for example, a film laminate, a non-woven, a vacuum-formed material, a hydro-formed material, a woven material, and a solid-state formed material. The cover material can have any suitable texture. In an embodiment, the cover material can have a different texture than the portions of the outer surfaces of the nonstructural panel and/or the one or more structural support volumes not covered by the cover material. Because such a cover material, or even a plurality of different-textured cover materials, may be selectively provided on various surfaces of the flexible container, such cover materials can provide a way for the manufacturer to vary tactile interaction at different locations of a given disposable flexible container. For example, in a gripping region of the container, the cover material can cover a seam projecting outwardly from the container, and present a smooth gripping surface. A container in accordance with the disclosure can include one or more cover materials joined to at least a portion of the outer surface of the container. In various embodiments, the container can be free of a cover material.

As used herein, the term "directly connected" refers to a configuration wherein elements are attached to each other without any intermediate elements therebetween, except for any means of attachment (e.g. adhesive).

As used herein, when referring to a flexible container, the term "dispenser" refers to a structure configured to dispense fluent product(s) from a product volume to the environment outside of the container. For any of the flexible containers disclosed herein, any dispenser can be configured in any way disclosed herein or known in the art. For example, a dispenser can be a push-pull type dispenser, a dispenser with a flip-top cap, a dispenser with a screw-on cap, a rotatable type dispenser, dispenser with a cap, a pump type dispenser, a pump spray type dispenser, a trigger spray type dispenser, a straw dispenser, a flip up straw dispenser, a straw dispenser with bite valve, a dosing dispenser, etc. As another example, a dispenser can be formed by a frangible opening. As further examples, a dispenser can utilize one or more valves and/or dispensing mechanisms disclosed in the art, such as those disclosed in: published US patent application 2003/0096068, entitled "One-way valve for inflatable package"; U.S. Pat. No. 4,988,016 entitled "Self-sealing container"; and U.S. Pat. No. 7,207,717, entitled "Package having a fluid actuated closure"; each of which is hereby incorporated by reference. Still further, any of the dispensers disclosed herein, may be incorporated into a flexible container either directly, or in combination with one or more other materials or structures (such as a fitment), or in any way known in the art. In some alternate embodiments, dispensers disclosed herein can be configured for both dispensing and filling, to allow filling of product volume(s) through one or more dispensers. In other alternate embodiments, a product volume can include one or filling structure(s) in addition to one or more dispenser(s).

As used herein, when referring to a flexible container, the term "disposable" refers to a container which, after dispensing a product to an end user, is not configured to be refilled with an additional amount of the product, but is configured to be disposed of (i.e. as waste, compost, and/or recyclable material). Part, parts, or all of any of the embodiments of flexible containers, disclosed herein, can be configured to be disposable.

As used herein, when referring to a flexible container, the term "durable" refers to a container that is reusable more than non-durable containers.

As used herein, when referring to a flexible container, the term "effective base contact area" refers to a particular area defined by a portion of the bottom of the container, when the container (with all of its product volume(s) filled 100% with water) is standing upright and its bottom is resting on a horizontal support surface. The effective base contact area lies in a plane defined by the horizontal support surface. The effective base contact area is a continuous area bounded on all sides by an outer periphery.

The outer periphery is formed from an actual contact area and from a series of projected areas from defined cross-sections taken at the bottom of the container. The actual contact area is the one or more portions of the bottom of the container that contact the horizontal support surface, when the effective base contact area is defined. The effective base contact area includes all of the actual contact area. However, in some embodiments, the effective base contact area may extend beyond the actual contact area.

The series of projected area are formed from five horizontal cross-sections, taken at the bottom of the flexible container. These cross-sections are taken at 1%, 2%, 3%, 4%, and 5% of the overall height. The outer extent of each of these cross-sections is projected vertically downward onto the horizontal support surface to form five (overlapping) projected areas, which, together with the actual contact area, form a single combined area. This is not a summing up of the values for these areas, but is the formation of a single combined area that includes all of these (projected and actual) areas, overlapping each other, wherein any overlapping portion makes only one contribution to the single combined area.

The outer periphery of the effective base contact area is formed as described below. In the following description, the terms convex, protruding, concave, and recessed are understood from the perspective of points outside of the combined area. The outer periphery is formed by a combination of the outer extent of the combined area and any chords, which are straight line segments constructed as described below.

For each continuous portion of the combined area that has an outer perimeter with a shape that is concave or recessed, a chord is constructed across that portion. This chord is the shortest straight line segment that can be drawn tangent to the combined area on both sides of the concave/recessed portion.

For a combined area that is discontinuous (formed by two or more separate portions), one or more chords are constructed around the outer perimeter of the combined area, across the one or more discontinuities (open spaces disposed between the portions). These chords are straight lines segments drawn tangent to the outermost separate portions of the combined area. These chords are drawn to create the largest possible effective base contact area.

Thus, the outer periphery is formed by a combination of the outer extent of the combined area and any chords, constructed as described above, which all together enclose the effective base area. Any chords that are bounded by the combined area and/or one or more other chords, are not part of the outer periphery and should be ignored.

Any of the embodiments of flexible containers, disclosed herein, can be configured to have an effective base contact area from 1 to 50,000 square centimeters ($cm^2$), or any integer value for $cm^2$ between 1 and 50,000 $cm^2$, or within any range formed by any of the preceding values, such as: from 2 to 25,000 $cm^2$, 3 to 10,000 $cm^2$, 4 to 5,000 $cm^2$, 5 to 2,500 $cm^2$, from 10 to 1,000 $cm^2$, from 20 to 500 $cm^2$, from 30 to 300 $cm^2$, from 40 to 200 $cm^2$, or from 50 to 100 $cm^2$, etc.

As used herein, when referring to a flexible container, the term "expanded" refers to the state of one or more flexible materials that are configured to be formed into a structural support volume, after the structural support volume is made rigid by one or more expansion materials. An expanded structural support volume has an overall width that is significantly greater than the combined thickness of its one or more flexible materials, before the structural support volume is filled with the one or more expansion materials. Examples of expansion materials include liquids (e.g. water), gases (e.g. compressed air), fluent products, foams (that can expand after being added into a structural support volume), co-reactive materials (that produce gas), or phase change materials (that can be added in solid or liquid form, but which turn into a gas; for example, liquid nitrogen or dry ice), or other suitable materials known in the art, or combinations of any of these (e.g. fluent product and liquid nitrogen). In various embodiments, expansion materials can be added at atmospheric pressure, or added under pressure greater than atmospheric pressure, or added to provide a material change that will increase pressure to something above atmospheric pressure. For any of the embodiments of flexible containers, disclosed herein, its one or more flexible materials can be expanded at various points in time, with respect to its manufacture, sale, and use, including, for example: before or after its product volume(s) are filled with fluent product(s), before or after the flexible container is shipped to a seller, and before or after the flexible container is purchased by an end user.

As used herein, when referring to a product volume of a flexible container, the term "filled" refers to the state when the product volume contains an amount of fluent product(s) that is equal to a full capacity for the product volume, with an allowance for head space, under ambient conditions. As used herein, the term filled can be modified by using the term filled with a particular percentage value, wherein 100% filled represents the maximum capacity of the product volume.

As used herein, the term "flat" refers to a surface that is without significant projections or depressions.

As used herein, the term "flexible container" refers to a container configured to have a product volume, wherein one or more flexible materials form 50-100% of the overall surface area of the one or more materials that define the three-dimensional space of the product volume. For any of the embodiments of flexible containers, disclosed herein, in various embodiments, the flexible container can be configured to have a product volume, wherein one or more flexible materials form a particular percentage of the overall area of the one or more materials that define the three-dimensional space, and the particular percentage is any integer value for percentage between 50% and 100%, or within any range formed by any of these values, such as: 60-100%, or 70-100%, or 80-100%, or 90-100%, etc. One kind of flexible container is a film-based container, which is a flexible container made from one or more flexible materials, which include a film.

For any of the embodiments of flexible containers, disclosed herein, in various embodiments, the middle of the flexible container (apart from any fluent product) can be configured to have an overall middle mass, wherein one or more flexible materials form a particular percentage of the overall middle mass, and the particular percentage is any integer value for percentage between 50% and 100%, or within any range formed by any of the preceding values, such as: 60-100%, or 70-100%, or 80-100%, or 90-100%, etc.

For any of the embodiments of flexible containers, disclosed herein, in various embodiments, the entire flexible container (apart from any fluent product) can be configured to have an overall mass, wherein one or more flexible materials form a particular percentage of the overall mass, and the particular percentage is any integer value for percentage between 50% and 100%, or within any range formed by any of the preceding values, such as: 60-100%, or 70-100%, or 80-100%, or 90-100%, etc.

As used herein, when referring to a flexible container, the term "flexible material" refers to a thin, easily deformable, sheet-like material, having a flexibility factor within the range of 1,000-2,500,000 N/m. For any of the embodiments of flexible containers, disclosed herein, in various embodiments, any of the flexible materials can be configured to have a flexibility factor of 1,000-2,500,000 N/m, or any integer value for flexibility factor from 1,000-2,500,000 N/m, or within any range formed by any of these values, such as 1,000-1,500,000 N/m, 1,500-1,000,000 N/m, 2,500-800,000 N/m, 5,000-700,000 N/m, 10,000-600,000 N/m, 15,000-500,000 N/m, 20,000-400,000 N/m, 25,000-300,000 N/m, 30,000-200,000 N/m, 35,000-100,000 N/m, 40,000-90,000 N/m, or 45,000-85,000 N/m, etc. Throughout the present disclosure the terms "flexible material", "flexible sheet", "sheet", and "sheet-like material" are used interchangeably and are intended to have the same meaning. Examples of materials that can be flexible materials include one or more of any of the following: films (such as plastic films), elastomers, foamed sheets, foils, fabrics (including wovens and nonwovens), biosourced materials, and papers, in any configuration, as separate material(s), or as layer(s) of a laminate, or as part(s) of a composite material, in a microlayered or nanolayered structure, and in any combination, as described herein or as known in the art. In various embodiments, part, parts, or all of a flexible material can be coated or uncoated, treated or untreated, processed or unprocessed, in any manner known in the art. In various embodiments, parts, parts, or all of a flexible material can made of sustainable, bio-sourced, recycled, recyclable, and/or biodegradable material. Part, parts, or all of any of the flexible materials described herein can be partially or completely translucent, partially or completely transparent, or partially or completely opaque. The flexible materials used to make the containers disclosed herein can be formed in any manner known in the art, and can be joined together using any kind of joining or sealing method known in the art, including, for example, heat sealing (e.g. conductive sealing, impulse sealing, ultrasonic sealing, etc.), welding, crimping, bonding, adhering, and the like, and combinations of any of these.

As used herein, when referring to a flexible container, the term "flexibility factor" refers to a material parameter for a thin, easily deformable, sheet-like material, wherein the parameter is measured in Newtons per meter, and the flexibility factor is equal to the product of the value for the Young's modulus of the material (measured in Pascals) and the value for the overall thickness of the material (measured in meters).

As used herein, when referring to a flexible container, the term "fluent product" refers to one or more liquids and/or pourable solids, and combinations thereof. Examples of fluent products include one or more of any of the following: bites, bits, creams, chips, chunks, crumbs, crystals, emulsions, flakes, gels, grains, granules, jellies, kibbles, liquid solutions, liquid suspensions, lotions, nuggets, ointments, particles, particulates, pastes, pieces, pills, powders, salves, shreds, sprinkles, fibers, hairs, granular materials (which may be of any shape, such as needle-shaped, spherical, cubicle, or other polyhedron), granular material, solid particulates, or other solids suspended in a liquid, coarse products, phase-separated materials, materials of different densities, beads, capsules, microcapsules, pellets, sand, and the like, either individually or in any combination. Throughout the present disclosure the terms "fluent product" and "flowable product" are used interchangeably and are intended to have the same meaning. Any of the product volumes disclosed herein can be configured to include one or more of any fluent product disclosed herein, or known in the art, in any combination.

As used herein, when referring to a flexible container, the term "formed" refers to the state of one or more materials that are configured to be formed into a product volume, after the product volume is provided with its defined three-dimensional space.

As used herein, the term "gradient" refers to a change in response to a stimulus, a change in performance, a change in physical properties, a changed in perceived properties such as tactile feel, softness, or compliance, a change in behavior, or a change in characteristic, depending on the location on a disposable flexible container. As it relates to the term gradient, the location on a disposable flexible container may be a discrete point or coordinate, an identifiable zone of the disposable flexible container within which all points or coordinates have common physical properties, a distance away from a particular point or coordinate, or a plurality of points or coordinates of the disposable flexible container that share common physical properties even if they are not all contiguous with one another.

As used herein, the term "graphic" refers to a visual element intended to provide a decoration or to communicate information. Examples of graphics include one or more of any of the following: colors, patterns, designs, images, and the like. For any of the embodiments of flexible containers, disclosed herein, in various embodiments, any surface of the flexible container can include one or more graphics of any size, shape, or configuration, disclosed herein or known in the art, in any combination.

As used herein, when referring to a flexible container, the term "height area ratio" refers to a ratio for the container, with units of per centimeter ($cm^{-1}$), which is equal to the value for the overall height of the container (with all of its product volume(s) filled 100% with water, and with overall height measured in centimeters) divided by the value for the effective base contact area of the container (with all of its product volume(s) filled 100% with water, and with effective base contact area measured in square centimeters). For any of the embodiments of flexible containers, disclosed herein, in various embodiments, any of the flexible containers, can be configured to have a height area ratio from 0.3 to 3.0 per centimeter, or any value in increments of 0.05 $cm^{-1}$ between 0.3 and 3.0 per centimeter, or within any range formed by any of the preceding values, such as: from 0.35 to 2.0 $cm^{-1}$, from 0.4 to 1.5 $cm^{-1}$, from 0.4 to 1.2 $cm^{-1}$, or from 0.45 to 0.9 $cm^{-1}$, etc.

As used herein, the term "indicia" refers to one or more of characters, graphics, branding, or other visual elements, in any combination. For any of the embodiments of flexible containers, disclosed herein, in various embodiments, any surface of the flexible container can include one or more indicia of any size, shape, or configuration, disclosed herein or known in the art, in any combination.

As used herein, the term "indirectly connected" refers to a configuration wherein elements are attached to each other with one or more intermediate elements therebetween.

As used herein, the term "joined" refers to a configuration wherein elements are either directly connected or indirectly connected.

As used herein, the term "lateral" refers to a direction, orientation, or measurement that is parallel to a lateral centerline of a container, when the container is standing upright on a horizontal support surface, as described herein. A lateral orientation may also be referred to a "horizontal" orientation, and a lateral measurement may also be referred to as a "width."

As used herein, the term "like-numbered" refers to similar alphanumeric labels for corresponding elements, as described below. Like-numbered elements have labels with the same last two digits; for example, one element with a label ending in the digits 20 and another element with a label ending in the digits 20 are like-numbered. Like-numbered elements can have labels with a differing first digit, wherein that first digit matches the number for its figure; as an example, an element of FIG. 3 labeled 320 and an element of FIG. 4 labeled 420 are like-numbered. Like-numbered elements can have labels with a suffix (i.e. the portion of the label following the dash symbol) that is the same or possibly different (e.g. corresponding with a particular embodiment); for example, a first embodiment of an element in FIG. 3A labeled 320-*a* and a second embodiment of an element in FIG. 3B labeled 320-*b*, are like numbered.

As used herein, the term "longitudinal" refers to a direction, orientation, or measurement that is parallel to a longitudinal centerline of a container, when the container is standing upright on a horizontal support surface, as described herein. A longitudinal orientation may also be referred to a "vertical"

orientation. When expressed in relation to a horizontal support surface for a container, a longitudinal measurement may also be referred to as a "height", measured above the horizontal support surface.

As used herein, when referring to a flexible container, the term "middle" refers to the portion of the container that is located in between the top of the container and the bottom of the container. As used herein, the term middle can be modified by describing the term middle with reference to a particular percentage value for the top and/or a particular percentage value for the bottom. For any of the embodiments of flexible containers, disclosed herein, a reference to the middle of the container can, in various alternate embodiments, refer to the portion of the container that is located between any particular percentage value for the top, disclosed herein, and/or any particular percentage value for the bottom, disclosed herein, in any combination.

As used herein, when referring to a product volume, the term "multiple dose" refers to a product volume that is sized to contain a particular amount of product that is about equal to two or more units of typical consumption, application, or use by an end user. Any of the embodiments of flexible containers, disclosed herein, can be configured to have one or more multiple dose product volumes. A container with only one product volume, which is a multiple dose product volume, is referred to herein as a "multiple dose container."

As used herein, the term "nearly" modifies a particular value, by referring to a range equal to the particular value, plus or minus five percent (+/−5%). For any of the embodiments of flexible containers, disclosed herein, any disclosure of a particular value, can, in various alternate embodiments, also be understood as a disclosure of a range equal to approximately that particular value (i.e. +/−5%).

As used herein, when referring to a flexible container, the term "non-durable" refers to a container that is temporarily reusable, or disposable, or single use.

As used herein, when referring to a flexible container, the term "non-structural panel" refers to a layer of one or more adjacent sheets of flexible material, the layer having an outermost major surface that faces outward, toward the environment outside of the flexible container, and an inner-most major surface that faces inward, toward product volume(s) disposed within the flexible container; a nonstructural panel is configured such that, the layer, does not independently provide substantial support in making the container self-supporting and/or standing upright.

As used herein, when referring to a flexible container, the term "overall height" refers to a distance that is measured while the container is standing upright on a horizontal support surface, the distance measured vertically from the upper side of the support surface to a point on the top of the container, which is farthest away from the upper side of the support surface. Any of the embodiments of flexible containers, disclosed herein, can be configured to have an overall height from 2.0 cm to 100.0 cm, or any value in increments of 0.1 cm between 2.0 and 100.0 cm, or within any range formed by any of the preceding values, such as: from 4.0 to 90.0 cm, from 5.0 to 80.0 cm, from 6.0 to 70.0 cm, from 7.0 to 60.0 cm, from 8.0 to 50.0 cm, from 9.0 to 40.0 cm, or from 10.0 to 30.0, etc.

As used herein, when referring to a sheet of flexible material, the term "overall thickness" refers to a linear dimension measured perpendicular to the outer major surfaces of the sheet, when the sheet is lying flat. For any of the embodiments of flexible containers, disclosed herein, in various embodiments, any of the flexible materials can be configured to have an overall thickness 5-500 micrometers (μ), or any integer value for micrometers from 5-500, or within any range formed by any of these values, such as 10-500 μm, 20-400 μm, 30-300 μm, 40-200 μm, or 50-100 μm, etc. As used herein, the term "product volume" refers to an enclosable three-dimensional space that is configured to receive and directly contain one or more fluent product(s), wherein that space is defined by one or more materials that form a barrier that prevents the fluent product(s) from escaping the product volume. By directly containing the one or more fluent products, the fluent products come into contact with the materials that form the enclosable three-dimensional space; there is no intermediate material or container, which prevents such contact. Throughout the present disclosure the terms "product volume" and "product receiving volume" are used interchangeably and are intended to have the same meaning. Any of the embodiments of flexible containers, disclosed herein, can be configured to have any number of product volumes including one product volume, two product volumes, three product volumes, four product volumes, five product volumes, six product volumes, or even more product volumes. Any of the product volumes disclosed herein can have a product volume of any size, including from 0.001 liters to 100.0 liters, or any value in increments of 0.001 liters between 0.001 liters and 3.0 liters, or any value in increments of 0.01 liters between 3.0 liters and 10.0 liters, or any value in increments of 1.0 liters between 10.0 liters and 100.0 liters, or within any range formed by any of the preceding values, such as: from 0.001 to 2.2 liters, 0.01 to 2.0 liters, 0.05 to 1.8 liters, 0.1 to 1.6 liters, 0.15 to 1.4 liters, 0.2 to 1.2 liters, 0.25 to 1.0 liters, etc. A product volume can have any shape in any orientation. A product volume can be included in a container that has a structural support frame, and a product volume can be included in a container that does not have a structural support frame.

As used herein, when referring to a flexible container, the term "resting on a horizontal support surface" refers to the container resting directly on the horizontal support surface, without other support.

As used herein, the term "sealed," when referring to a product volume, refers to a state of the product volume wherein fluent products within the product volume are prevented from escaping the product volume (e.g. by one or more materials that form a barrier, and by a seal), and the product volume is hermetically sealed.

As used herein, when referring to a flexible container, the term "self-supporting" refers to a container that includes a product volume and a structural support frame, wherein, when the container is resting on a horizontal support surface, in at least one orientation, the structural support frame is configured to prevent the container from collapsing and to give the container an overall height that is significantly greater than the combined thickness of the materials that form the container, even when the product volume is unfilled. Any of the embodiments of flexible containers, disclosed herein, can be configured to be self-supporting.

As used herein, when referring to a flexible container, the term "single use" refers to a closed container which, after being opened by an end user, is not configured to be reclosed. Any of the embodiments of flexible containers, disclosed herein, can be configured to be single use.

As used herein, when referring to a product volume, the term "single dose" refers to a product volume that is sized to contain a particular amount of product that is about equal to one unit of typical consumption, application, or use by an end user. Any of the embodiments of flexible containers, disclosed herein, can be configured to have one or more single dose product volumes. A container with only one product volume, which is a single dose product volume, is referred to herein as a "single dose container."

As used herein, when referring to a flexible container, the terms "stand up," "stands up," "standing up", "stand upright", "stands upright", and "standing upright" refer to a particular orientation of a self-supporting flexible container, when the container is resting on a horizontal support surface. This standing upright orientation can be determined from the structural features of the container and/or indicia on the container. In a first determining test, if the flexible container has a clearly defined base structure that is configured to be used on the bottom of the container, then the container is determined to be standing upright when this base structure is resting on the horizontal support surface. If the first test cannot determine the standing upright orientation, then, in a second determining test, the container is determined to be standing upright when the container is oriented to rest on the horizontal support surface such that the indicia on the flexible container are best positioned in an upright orientation. If the second test cannot determine the standing upright orientation, then, in a third determining test, the container is determined to be standing upright when the container is oriented to rest on the horizontal support surface such that the container has the largest overall height. If the third test cannot determine the standing upright orientation, then, in a fourth determining test, the container is determined to be standing upright when the container is oriented to rest on the horizontal support surface such that the container has the largest height area ratio. If the fourth test cannot determine the standing upright orientation, then, any orientation used in the fourth determining test can be considered to be a standing upright orientation. As used herein, when referring to a flexible container, the term "stand up container" refers to a self-supporting container, wherein, when the container (with all of its product volume(s) filled 100% with water) is standing up, the container has a height area ratio from 0.4 to 1.5 $cm^{-1}$. Any of the embodiments of flexible containers, disclosed herein, can be configured to be stand up containers.

As used herein, when referring to a flexible container, the term "structural support frame" refers to a rigid structure formed of one or more structural support members, joined together, around one or more sizable empty spaces and/or one or more nonstructural panels, and generally used as a major support in making the container self-supporting and/or standing upright.

As used herein, when referring to a flexible container, the term "structural support member" refers to a rigid, physical structure, which includes one or more expanded structural support volumes, and which is configured to be used in a structural support frame, to carry one or more loads (from the flexible container) across a span. A structure that does not include at least one expanded structural support volume, is not considered to be a structural support member, as used herein.

A structural support member has two defined ends, a middle between the two ends, and an overall length from its one end to its other end. A structural support member can have one or more cross-sectional areas, each of which has an overall width that is less than its overall length.

A structural support member can be configured in various forms. A structural support member can include one, two, three, four, five, six or more structural support volumes, arranged in various ways. For example, a structural support member can be formed by a single structural support volume. As another example, a structural support member can be formed by a plurality of structural support volumes, disposed end to end, in series, wherein, in various embodiments, part, parts, or all of some or all of the structural support volumes can be partly or fully in contact with each other, partly or fully directly connected to each other, and/or partly or fully joined to each other. As a further example, a structural support member can be formed by a plurality of support volumes disposed side by side, in parallel, wherein, in various embodiments, part, parts, or all of some or all of the structural support volumes can be partly or fully in contact with each other, partly or fully directly connected to each other, and/or partly or fully joined to each other.

In some embodiments, a structural support member can include a number of different kinds of elements. For example, a structural support member can include one or more structural support volumes along with one or more mechanical reinforcing elements (e.g. braces, collars, connectors, joints, ribs, etc.), which can be made from one or more rigid (e.g. solid) materials.

Structural support members can have various shapes and sizes. Part, parts, or all of a structural support member can be straight, curved, angled, segmented, or other shapes, or combinations of any of these shapes. Part, parts, or all of a structural support member can have any suitable cross-sectional shape, such as circular, oval, square, triangular, star-shaped, or modified versions of these shapes, or other shapes, or combinations of any of these shapes. A structural support member can have an overall shape that is tubular, or convex, or concave, along part, parts, or all of a length. A structural support member can have any suitable cross-sectional area, any suitable overall width, and any suitable overall length. A structural support member can be substantially uniform along part, parts, or all of its length, or can vary, in any way described herein, along part, parts, or all of its length. For example, a cross-sectional area of a structural support member can increase or decrease along part, parts, or all of its length. Part, parts, or all of any of the embodiments of structural support members of the present disclosure, can be configured according to any embodiment disclosed herein, including any workable combination of structures, features, materials, and/or connections from any number of any of the embodiments disclosed herein.

As used herein, when referring to a flexible container, the term "structural support volume" refers to a fillable space made from one or more flexible materials, wherein the space is configured to be at least partially filled with one or more expansion materials, which create tension in the one or more flexible materials, and form an expanded structural support volume. One or more expanded structural support volumes can be configured to be included in a structural support member. A structural support volume is distinct from structures configured in other ways, such as: structures without a fillable space (e.g. an open space), structures made from inflexible (e.g. solid) materials, structures with spaces that are not configured to be filled with an expansion material (e.g. an unattached area between adjacent layers in a multi-layer panel), and structures with flexible materials that are not configured to be expanded by an expansion material (e.g. a space in a structure that is configured to be a non-structural panel). Throughout the present disclosure the terms "structural support volume" and "expandable chamber" are used interchangeably and are intended to have the same meaning.

In some embodiments, a structural support frame can include a plurality of structural support volumes, wherein some of or all of the structural support volumes are in fluid communication with each other. In other embodiments, a structural support frame can include a plurality of structural support volumes, wherein some of or none of the structural support volumes are in fluid communication with each other.

Any of the structural support frames of the present disclosure can be configured to have any kind of fluid communication disclosed herein.

As used herein, the term "substantially" modifies a particular value, by referring to a range equal to the particular value, plus or minus ten percent (+/−10%). For any of the embodiments of flexible containers, disclosed herein, any disclosure of a particular value, can, in various alternate embodiments, also be understood as a disclosure of a range equal to approximately that particular value (i.e. +/−10%).

As used herein, the term "surface element" refers to at least one nonstructural volume which defines a thumb rest on the nonstructural panel. The one or more surface elements may suitably comprise a pattern of nonstructural volumes which projects outwardly of the one or more flat spaces on the nonstructural panel. In a further embodiment, the one or more surface elements may suitably comprise a plurality of nonstructural volumes which serve to divide the squeeze panel into multiple nonstructural subpanels.

As used herein, when referring to a flexible container, the term "temporarily reusable" refers to a container which, after dispensing a product to an end user, is configured to be refilled with an additional amount of a product, up to ten times, before the container experiences a failure that renders it unsuitable for receiving, containing, or dispensing the product. As used herein, the term temporarily reusable can be further limited by modifying the number of times that the container can be refilled before the container experiences such a failure. For any of the embodiments of flexible containers, disclosed herein, a reference to temporarily reusable can, in various alternate embodiments, refer to temporarily reusable by refilling up to eight times before failure, by refilling up to six times before failure, by refilling up to four times before failure, or by refilling up to two times before failure, or any integer value for refills between one and ten times before failure. Any of the embodiments of flexible containers, disclosed herein, can be configured to be temporarily reusable, for the number of refills disclosed herein.

As used herein, the term "thermal conductivity coefficient", abbreviated $K_{eff}$, refers to the coefficient for heat transfer, in one dimension, in a direction normal to an exterior surface of a container through the outermost surface of the container to the innermost surface in contact with a fluent product contained therein. $K_{eff}$ is a lumped or effective parameter characterizing the heat transfer coefficient through any number of layers, materials present, including fluid or gas filled gaps or regions, from an exterior point to an interior point. $K_{eff}$ may be used in thermal conductivity-based calculations characterizing a single layer of material or a composite of multiple layers of material.

As used herein, the term "thickness" refers to a measurement that is parallel to a third centerline of a container, when the container is standing upright on a horizontal support surface, as described herein. A thickness may also be referred to as a "depth."

As used herein, when referring to a flexible container, the term "top" refers to the portion of the container that is located in the uppermost 20% of the overall height of the container, that is, from 80-100% of the overall height of the container. As used herein, the term top can be further limited by modifying the term top with a particular percentage value, which is less than 20%. For any of the embodiments of flexible containers, disclosed herein, a reference to the top of the container can, in various alternate embodiments, refer to the top 15% (i.e. from 85-100% of the overall height), the top 10% (i.e. from 90-100% of the overall height), or the top 5% (i.e. from 95-100% of the overall height), or any integer value for percentage between 0% and 20%.

As used herein, when referring to one or more portions of a flexible container, the term "transparent" refers to a visual quality of the layer or layers forming the portion or portions of the flexible container that permits light to pass through the layer or layers with little or no interruption or distortion, such that anything on an opposite side of the layer or layers can clearly be seen through the layer or layers. Another, more quantifiable, way to describe the transparency of a given portion of a flexible container (i.e., the degree to which objects can be seen through a portion of the flexible container) is in terms of the opacity of that portion, i.e. the degree to which light is blocked from passing through the portion of the container. For purposes of the present disclosure, a given portion of a flexible container is considered transparent when it has an opacity in a range of 0-50%. When a given portion of a flexible container has an opacity of 0%, that portion is considered completely transparent. Transparency is inversely proportional to opacity. As such, if a given portion of a flexible container has an opacity of 100%, that portion of the flexible container has no transparency. This is because no light can be transmitted through that portion of the flexible container. The opacity of a given portion of a flexible container can be controlled by varying the amount of filler or fillers used in a layer or layers that define the portion of the container.

In general, when the opacity of a given portion of a flexible container is within a low range, such as from 0 to 30%, 0 to 25%, 0 to 15%, 0 to 10%, 0 to 5%, 0 to 1%, 0 to 0.5%, or 0 to 0.1%, that opacity renders it easier for users to see any contents of a given compartment or region of the flexible container through that portion of the flexible container.

As used herein, when referring to a flexible container, the term "unexpanded" refers to the state of one or more materials that are configured to be formed into a structural support volume, before the structural support volume is made rigid by an expansion material.

As used herein, when referring to a product volume of a flexible container, the term "unfilled" refers to the state of the product volume when it does not contain a fluent product. As used herein, when referring to a flexible container, the term "unformed" refers to the state of one or more materials that are configured to be formed into a product volume, before the product volume is provided with its defined three-dimensional space. For example, an article of manufacture could be a container blank with an unformed product volume, wherein sheets of flexible material, with portions joined together, are laying flat against each other.

Flexible containers, as described herein, may be used across a variety of industries for a variety of products. For example, flexible containers, as described herein, may be used across the consumer products industry, including the following products: soft surface cleaners, hard surface cleaners, glass cleaners, ceramic tile cleaners, toilet bowl cleaners, wood cleaners, multi-surface cleaners, surface disinfectants, dishwashing compositions, laundry detergents, fabric conditioners, fabric dyes, surface protectants, surface disinfectants, cosmetics, facial powders, body powders, hair treatment products (e.g. mousse, hair spray, styling gels), shampoo, hair conditioner (leave-in or rinse-out), cream rinse, hair dye, hair coloring product, hair shine product, hair serum, hair anti-frizz product, hair split-end repair products, permanent waving solution, antidandruff formulation, bath gels, shower gels, body washes, facial cleaners, skin care products (e.g. sunscreen, sun block lotions, lip balm, skin conditioner, cold creams, moisturizers), body sprays, soaps, body scrubs, exfoliants, astringent, scrubbing lotions, depilatories, antiperspirant compositions, deodorants, shaving products, pre-shaving products, after shaving products, toothpaste, mouthwash, etc. As further examples, flexible containers, as described herein, may be used across other industries, including foods, beverages, pharmaceuticals, commercial products, industrial products, medical, etc. FIGS. 1A-1D illustrates various views of an embodiment of a stand up flexible container 100. FIG. 1A illustrates a front view of the container 100. The container 100 is standing upright on a horizontal support surface 101.

In FIG. 1A, a coordinate system 110, provides lines of reference for referring to directions in the figure. The coordinate system 110 is a three-dimensional Cartesian coordinate system with an X-axis, a Y-axis, and a Z-axis, wherein each axis is perpendicular to the other axes, and any two of the axes define a plane. The X-axis and the Z-axis are parallel with the horizontal support surface 101 and the Y-axis is perpendicular to the horizontal support surface 101.

FIG. 1A also includes other lines of reference, for referring to directions and locations with respect to the container 100. A lateral centerline 111 runs parallel to the X-axis. An XY plane at the lateral centerline 111 separates the container 100 into a front half and a back half. An XZ plane at the lateral centerline 111 separates the container 100 into an upper half and a lower half. A longitudinal centerline 114 runs parallel to the Y-axis. A YZ plane at the longitudinal centerline 114 separates the container 100 into a left half and a right half. A third centerline 117 runs parallel to the Z-axis. The lateral centerline 111, the longitudinal centerline 114, and the third centerline 117 all intersect at a center of the container 100.

A disposition with respect to the lateral centerline 111 defines what is longitudinally inboard 112 and longitudinally outboard 113. When a first location is nearer to the lateral centerline 111 than a second location, the first location is considered to be disposed longitudinally inboard 112 to the second location. And, the second location is considered to be disposed longitudinally outboard 113 from the first location. The term lateral refers to a direction, orientation, or measurement that is parallel to the lateral centerline 111. A lateral orientation may also be referred to a horizontal orientation, and a lateral measurement may also be referred to as a width.

A disposition with respect to the longitudinal centerline 114 defines what is laterally inboard 115 and laterally outboard 116. When a first location is nearer to the longitudinal centerline 114 than a second location, the first location is considered to be disposed laterally inboard 115 to the second location. And, the second location is considered to be disposed laterally outboard 116 from the first location. The term longitudinal refers to a direction, orientation, or measurement that is parallel to the longitudinal centerline 114. A longitudinal orientation may also be referred to a vertical orientation.

A longitudinal direction, orientation, or measurement may also be expressed in relation to a horizontal support surface for the container 100. When a first location is nearer to the support surface than a second location, the first location can be considered to be disposed lower than, below, beneath, or under the second location. And, the second location can be considered to be disposed higher than, above, or upward from the first location. A longitudinal measurement may also be referred to as a height, measured above the horizontal support surface 100.

A measurement that is made parallel to the third centerline 117 is referred to a thickness or depth. A disposition in the direction of the third centerline 117 and toward a front 102-1 of the container is referred to as forward 118 or in front of. A disposition in the direction of the third centerline 117 and toward a back 102-2 of the container is referred to as backward 119 or behind. These terms for direction, orientation, measurement, and disposition, as described above, are used for all of the embodiments of the present disclosure, whether or not a support surface, reference line, or coordinate system is shown in a figure.

The container 100 includes a top 104, a middle 106, and a bottom 108, the front 102-1, the back 102-2, and left and right sides 109. The top 104 is separated from the middle 106 by a reference plane 105, which is parallel to the XZ plane. The middle 106 is separated from the bottom 108 by a reference plane 107, which is also parallel to the XZ plane. The container 100 has an overall height of 100-oh. In the embodiment of FIG. 1A, the front 102-1 and the back 102-2 of the container are joined together at a seal 129, which extends around the outer periphery of the container 100, across the top 104, down the side 109, and then, at the bottom of each side 109, splits outward to follow the front and back portions of the base 190, around their outer extents.

The container 100 includes a structural support frame 140, a product volume 150, a dispenser 160, panels 180-1 and 180-2, and a base structure 190. A portion of panel 180-1 is illustrated as broken away, in order to show the product volume 150. The product volume 150 is configured to contain one or more fluent products. The panel 180-1 may be transparent or translucent, or be provided with one or more transparent or translucent windows 152, so as to permit fluent products contained in the product volume 150 to be visible from an exterior of the container 100. The windows 152 need not be of uniform dimensions or shapes. Each of the transparent or translucent windows may be a contiguous area or region, having a dimensional area of at least 1 $cm^2$, having an opacity within a range of 0-55%, 0-40%, 0-30%, 0-20%, 0-15%, 0-10%, 0-5%, 0-2%, 0-1%, 0-0.75%, 0-0.5%, 0-0.2%, or 0-0.1%. The dimensional area of the translucent window may be within a range of 1-1000 $cm^2$, 2-200 $cm^2$, 3-100 $cm^2$, 4-50 $cm^2$, or 5-25 $cm^2$. If it is desired to only show the user a hint of the fluent products in the product volume 150, the panel 180-1 may be provided with a greater opacity, such as within a range of 40-50%, 30-55%, or 20-55%. Alternately, the panel 180-1 may be provided with a very high opacity, such as in the range of 56-100%, 70-100%, 75-100%, 80-100%, 90-100%, or 95-100%. In one embodiment, a substantial portion of the panel 180-1 may have an opacity in a range of 90-100%, but be provided with one or more translucent windows having an opacity in a range of 0-89%, 25-89%, 30-89%, 40-89%, 50-89%, or 55-89%.

In certain embodiments, the flexible container 100 includes, in one or more translucent area(s), a transparent layer, and a white or non-white color layer disposed on the transparent layer. In one embodiment, at least the panel 180-1 of the container 100 has an opacity of 5-55%, and a speculum gloss of 0.1-90 in the translucent area.

The light reflectance of the transparent/translucent portion of the container 100 can be of any reflectance, such as various degrees of matte, luster, dullness, gloss, sheen, shine. The light reflectance property may be consistent or varying across a given portion of the flexible container 100, such as the panel 180-1. The portion of the flexible container, such as the panel 180-1, can also exhibit points or areas of different reflectance which can cause a glitter or sparkle effect. In another embodiment, a given portion of the container 100 has an opacity of 15-40% and a speculum gloss of 2-15 in the translucent area 17.

Test Methods

This section describes methods for determining an opacity and a speculum gloss.

I. Opacity (OP)

A dispersion colorimeter can be used for determining the opacity of a sample material. One example of such a dispersion colorimeter is available from BYK-Gardner GmbH, Geretsried, Germany, under Trade Name "BYK Gardner Color-Guide 45/0" (Cat. No. 6800).

The measurements should be conducted by using a light source "A" at a viewing angle of 2 deg. (degrees).

This dispersion colorimeter includes a light source for Illuminant A (i.e., an approximation of incandescent lamp having a correlated color temperature of about 3000 K), a flat table, a white standard plate, a standard black plate, a photo detector which includes a multi-celled photo-detector diode array, and a computer. The white and black standard plates are available from the same company under Cat. Nos. 6811 and 6810, respectively.

In the measurement, the white standard plate is placed on the flat table. A sample material is put on the white standard plate in a flat state. The sample material is illuminated by the light source with an incident angle of 45°. The reflection light which is reflected from the sample material is received by the photo detector with a receiving angle of 0°. The reflection rate (Yw) of the reflection light is detected by the photo detector. Similarly, after the black standard plate is placed on the flat table, the sample material is put on the black standard plate in a flat state. The sample material is illuminated by the light source with an incident angle of 45°. The reflection light which is reflected from the sample material is received by the photo detector with a receiving angle of 0°. The reflection rate (Yb) of the reflection light is detected by the photo detector.

The opacity (OP) is obtained by the following formula:

$$\text{OP}\ (\%)=(Yb/Yw)\times 100 \quad (1)$$

This process is repeated for one sample container 100 at least five times and the average value of the opacities (OP) measured is calculated and recorded by the colorimeter. The average value of the opacities measured is called the opacity of a given portion of the container 100.

The dispenser 160 allows the container 100 to dispense these fluent product(s) from the product volume 150 through a flow channel 159 then through the dispenser 160, to the environment outside of the container 100. The structural support frame 140 supports the mass of fluent product(s) in the product volume 150, and makes the container 100 stand upright. The panels 180-1 and 180-2 are relatively flat surfaces, overlaying the product volume 150, and are suitable for displaying any kind of indicia. The base structure 190 supports the structural support frame 140 and provides stability to the container 100 as it stands upright.

The structural support frame 140 is formed by a plurality of structural support members. The structural support frame 140 includes top structural support members 144-1 and 144-2, middle structural support members 146-1, 146-2, 146-3, and 146-4, as well as bottom structural support members 148-1 and 148-2.

The top structural support members 144-1 and 144-2 are disposed on the upper part of the top 104 of the container 100, with the top structural support member 144-1 disposed in the front 102-1 and the top structural support member 144-2 disposed in the back 102-2, behind the top structural support member 144-1. The top structural support members 144-1 and 144-2 are adjacent to each other and can be in contact with each other along the laterally outboard portions of their lengths. In various embodiments, the top structural support members 144-1 and 144-2 can be in contact with each other at one or more relatively smaller locations and/or at one or more relatively larger locations, along part, or parts, or about all, or approximately all, or substantially all, or nearly all of their overall lengths, so long as there is a flow channel 159 between the top structural support members 144-1 and 144-2, which allows the container 100 to dispense fluent product(s) from the product volume 150 through the flow channel 159 then through the dispenser 160. The top structural support members 144-1 and 144-2 are not directly connected to each other. However, in various alternate embodiments, the top structural support members 144-1 and 144-2 can be directly connected and/or joined together along part, or parts, or about all, or approximately all, or substantially all, or nearly all, or all of their overall lengths.

The top structural support members 144-1 and 144-2 are disposed substantially above the product volume 150. Overall, each of the top structural support members 144-1 and 144-2 is oriented about horizontally, but with its ends curved slightly downward. And, overall each of the top structural support members 144-1 and 144-2 has a cross-sectional area that is substantially uniform along its length; however the cross-sectional area at their ends are slightly larger than the cross-sectional area in their middles.

The middle structural support members 146-1, 146-2, 146-3, and 146-4 are disposed on the left and right sides 109, from the top 104, through the middle 106, to the bottom 108. The middle structural support member 146-1 is disposed in the front 102-1, on the left side 109; the middle structural support member 146-4 is disposed in the back 102-2, on the left side 109, behind the middle structural support member 146-1. The middle structural support members 146-1 and 146-4 are adjacent to each other and can be in contact with each other along substantially all of their lengths. In various embodiments, the middle structural support members 146-1 and 146-4 can be in contact with each other at one or more relatively smaller locations and/or at one or more relatively larger locations, along part, or parts, or about all, or approximately all, or substantially all, or nearly all, or all of their overall lengths. The middle structural support members 146-1 and 146-4 are not directly connected to each other. However, in various alternate embodiments, the middle structural support members 146-1 and 146-4 can be directly connected and/or joined together along part, or parts, or about all, or approximately all, or substantially all, or nearly all, or all of their overall lengths.

The middle structural support member 146-2 is disposed in the front 102-1, on the right side 109; the middle structural support member 146-3 is disposed in the back 102-2, on the right side 109, behind the middle structural support member 146-2. The middle structural support members 146-2 and 146-3 are adjacent to each other and can be in contact with each other along substantially all of their lengths. In various embodiments, the middle structural support members 146-2 and 146-3 can be in contact with each other at one or more relatively smaller locations and/or at one or more relatively larger locations, along part, or parts, or about all, or approximately all, or substantially all, or nearly all, or all of their overall lengths. The middle structural support members 146-2 and 146-3 are not directly connected to each other. However, in various alternate embodiments, the middle structural support members 146-2 and 146-3 can be directly connected and/or joined together along part, or parts, or about all, or approximately all, or substantially all, or nearly all, or all of their overall lengths.

The middle structural support members 146-1, 146-2, 146-3, and 146-4 are disposed substantially laterally outboard from the product volume 150. Overall, each of the middle structural support members 146-1, 146-2, 146-3, and 146-4 is oriented about vertically, but angled slightly, with its upper end laterally inboard to its lower end. And, overall each of the middle structural support members 146-1, 146-2, 146-3, and 146-4 has a cross-sectional area that changes along its length, increasing in size from its upper end to its lower end.

The bottom structural support members 148-1 and 148-2 are disposed on the bottom 108 of the container 100, with the bottom structural support member 148-1 disposed in the front 102-1 and the bottom structural support member 148-2 disposed in the back 102-2, behind the top structural support member 148-1. The bottom structural support members 148-1 and 148-2 are adjacent to each other and can be in contact with each other along substantially all of their lengths. In various embodiments, the bottom structural support members 148-1 and 148-2 can be in contact with each other at one or more relatively smaller locations and/or at one or more relatively larger locations, along part, or parts, or about all, or approximately all, or substantially all, or nearly all, or all of their overall lengths. The bottom structural support members 148-1 and 148-2 are not directly connected to each other. However, in various alternate embodiments, the bottom structural support members 148-1 and 148-2 can be directly connected and/or joined together along part, or parts, or about all, or approximately all, or substantially all, or nearly all, or all of their overall lengths.

The bottom structural support members 148-1 and 148-2 are disposed substantially below the product volume 150, but substantially above the base structure 190. Overall, each of the bottom structural support members 148-1 and 148-2 is oriented about horizontally, but with its ends curved slightly upward. And, overall each of the bottom structural support members 148-1 and 148-2 has a cross-sectional area that is substantially uniform along its length.

In the front portion of the structural support frame 140, the left end of the top structural support member 144-1 is joined to the upper end of the middle structural support member 146-1; the lower end of the middle structural support member 146-1 is joined to the left end of the bottom structural support member 148-1; the right end of the bottom structural support member 148-1 is joined to the lower end of the middle structural support member 146-2; and the upper end of the middle structural support member 146-2 is joined to the right end of the top structural support member 144-1. Similarly, in the back portion of the structural support frame 140, the left end of the top structural support member 144-2 is joined to the upper end of the middle structural support member 146-4; the lower end of the middle structural support member 146-4 is joined to the left end of the bottom structural support member 148-2; the right end of the bottom structural support member 148-2 is joined to the lower end of the middle structural support member 146-3; and the upper end of the middle structural support member 146-3 is joined to the right end of the top structural support member 144-2. In the structural support frame 140, the ends of the structural support members, which are joined together, are directly connected, all around the periphery of their walls. However, in various alternative embodiments, any of the structural support members 144-1, 144-2, 146-1, 146-2, 146-3, 146-4, 148-1, and 148-2 can be joined together in any way described herein or known in the art.

In alternative embodiments of the structural support frame 140, adjacent structural support members can be combined into a single structural support member, wherein the combined structural support member can effectively substitute for the adjacent structural support members, as their functions and connections are described herein. In other alternative embodiments of the structural support frame 140, one or more additional structural support members can be added to the structural support members in the structural support frame 140, wherein the expanded structural support frame can effectively substitute for the structural support frame 140, as its functions and connections are described herein. Also, in some alternative embodiments, a flexible container may not include a base structure.

Figure 1B:
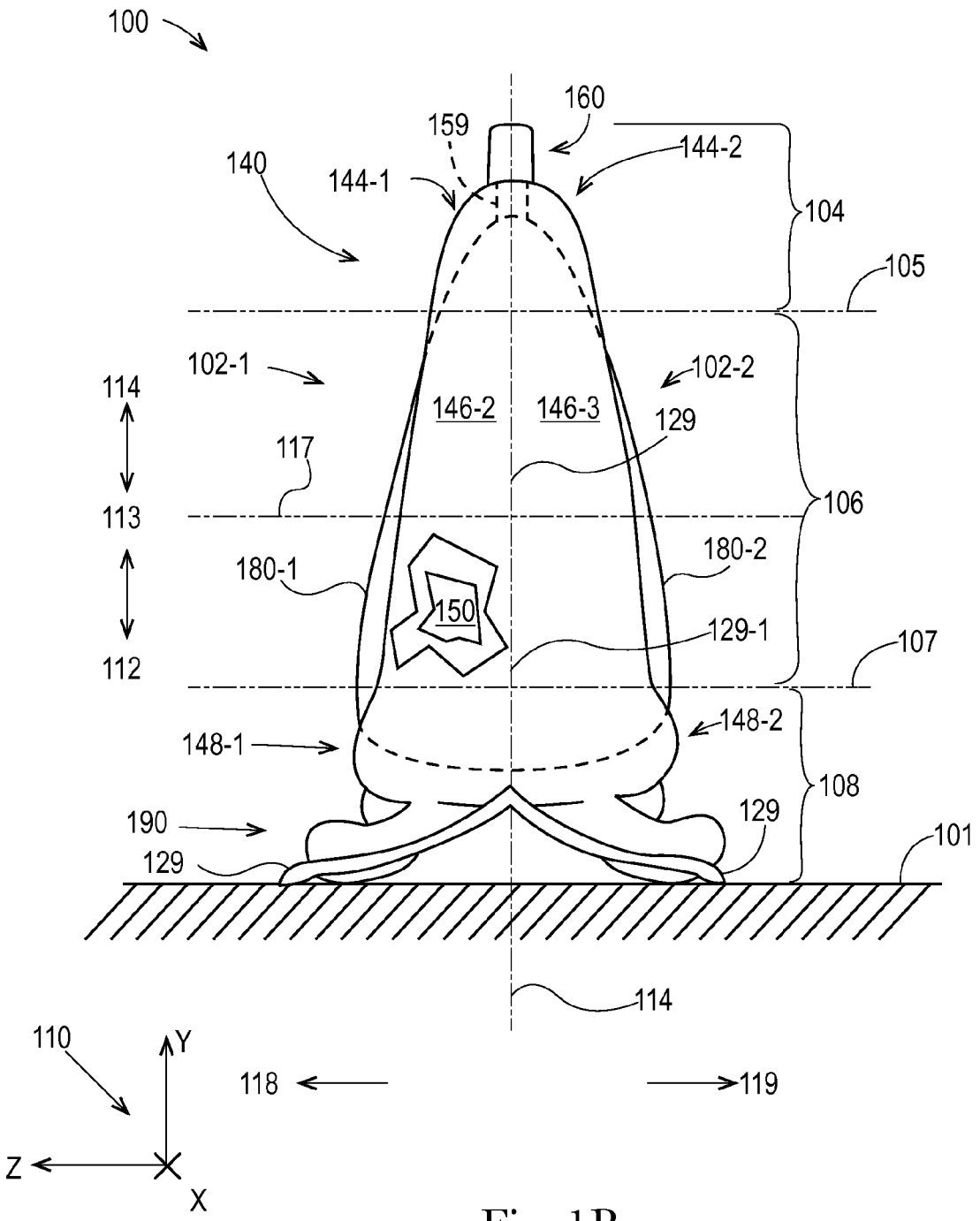
FIG. 1B illustrates a side view of the stand up flexible container of FIG. 1A.

FIG. 1B illustrates a side view of the stand up flexible container 100 of FIG. 1A.

Figure 1C:
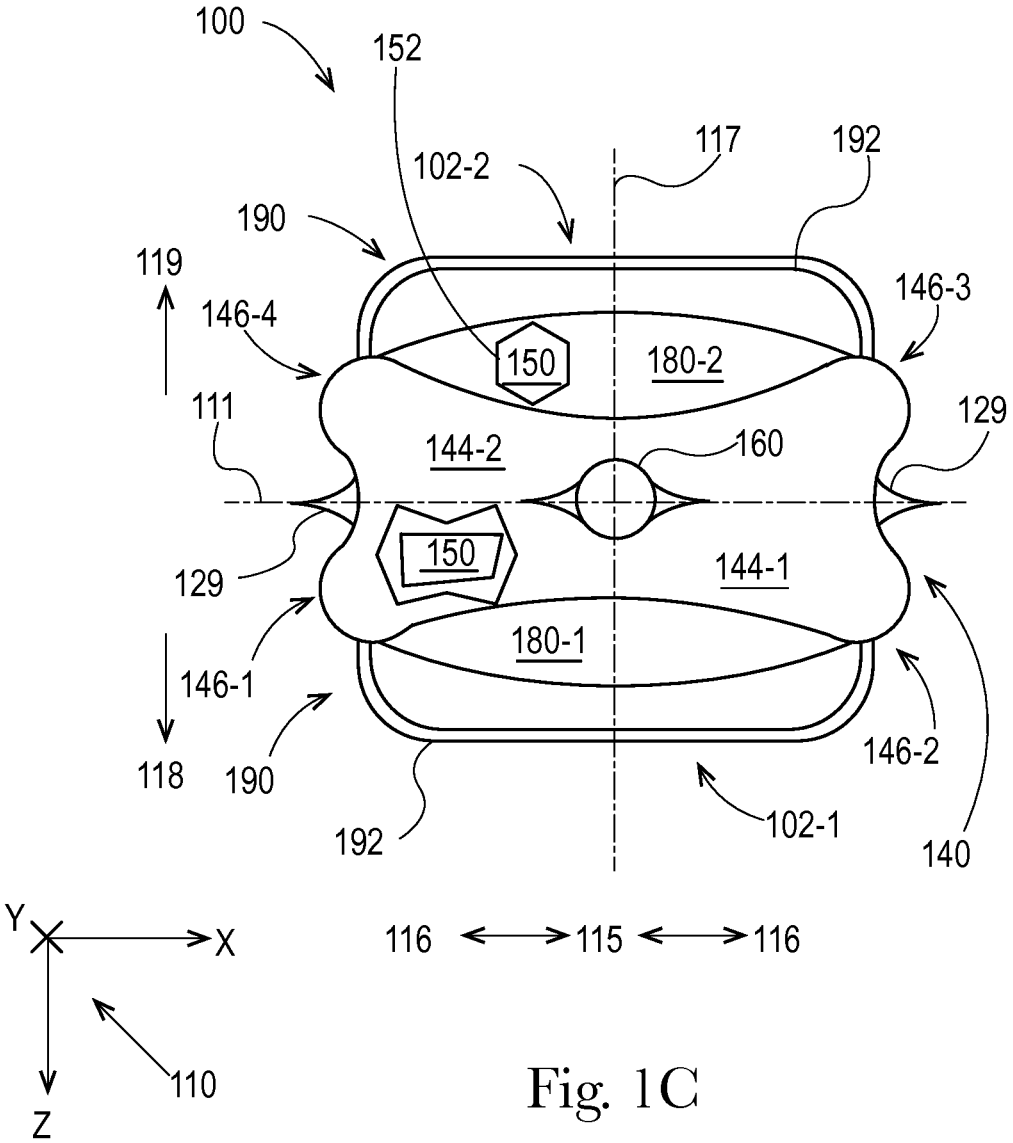
FIG. 1C illustrates a top view of the stand up flexible container of FIG. 1A.

FIG. 1C illustrates a top view of the stand up flexible container 100 of FIG. 1A.

Figure 1D:
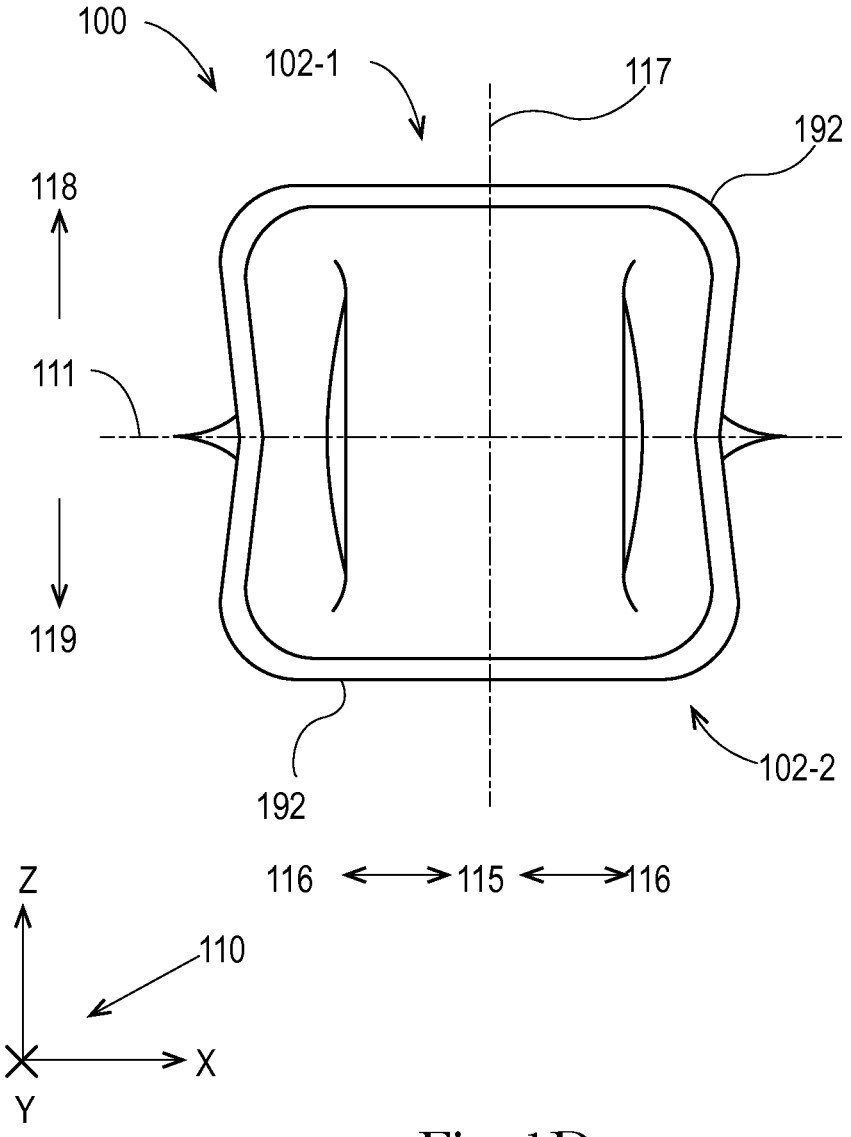
FIG. 1D illustrates a bottom view of the stand up flexible container of FIG. 1A.

FIG. 1D illustrates a bottom view of the stand up flexible container 100 of FIG. 1A.

FIGS. 2A-8D illustrate embodiments of stand-up flexible containers having various overall shapes. Any of the embodiments of FIGS. 2A-8D can be configured according to any of the embodiments disclosed herein, including the embodiments of FIGS. 1A-1D. Any of the elements (e.g. structural support frames, structural support members, panels, dispensers, etc.) of the embodiments of FIGS. 2A-8D, can be configured according to any of the embodiments disclosed herein. While each of the embodiments of FIGS. 2A-8D illustrates a container with one dispenser, in various embodiments, each container can include multiple dispensers, according to any embodiment described herein. Part, parts, or all of each of the panels in the embodiments of FIGS. 2A-8D is suitable to display any kind of indicia. Each of the side panels in the embodiments of FIGS. 2A-8D is configured to be a nonstructural panel, overlaying product volume(s) disposed within the flexible container, however, in various embodiments, one or more of any kind of decorative or structural element (such as a rib, protruding from an outer surface) can be joined to part, parts, or all of any of these side panels. For clarity, not all structural details of these flexible containers are shown in FIGS. 2A-8D, however any of the embodiments of FIGS. 2A-8D can be configured to include any structure or feature for flexible containers, disclosed herein. For example, any of the embodiments of FIGS. 2A-8D can be configured to include any kind of base structure disclosed herein.

Figure 2B:
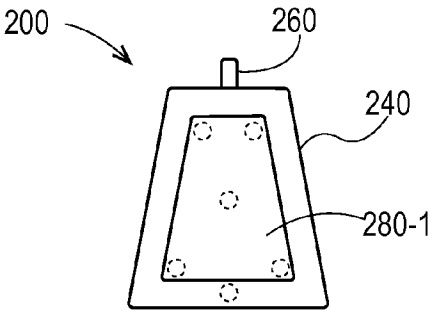
FIG. 2B illustrates a front view of the container of FIG. 2A.
Figure 2D:
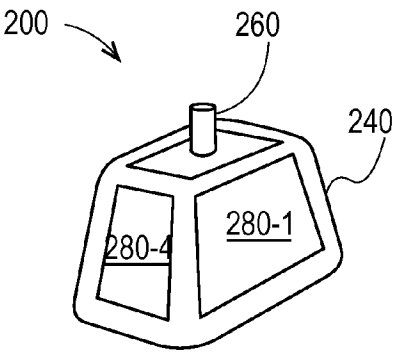
FIG. 2D illustrates an isometric view of the container of FIG. 2A.
Figure 2A:
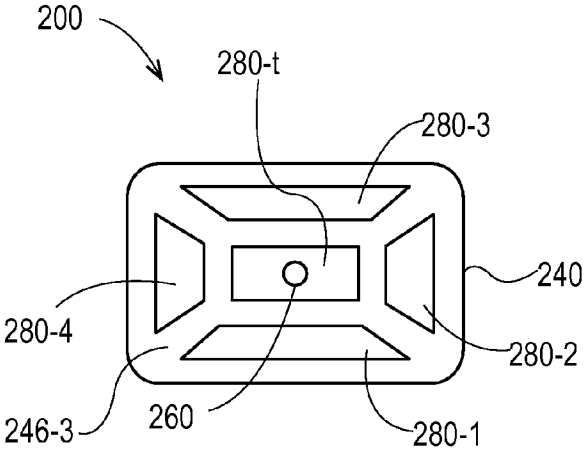
FIG. 2A illustrates a top view of a stand up flexible container having a structural support frame that has an overall shape like a frustum.
Figure 2C:
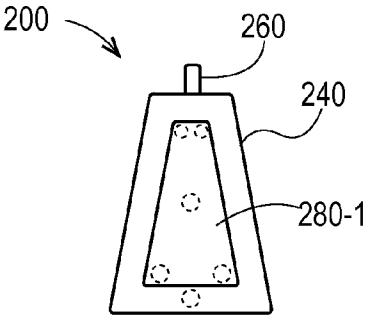
FIG. 2C illustrates a side view of the container of FIG. 2A.

FIG. 2A illustrates a front view of a stand up flexible container 200 having a structural support frame 240 that has an overall shape like a frustum. In the embodiment of FIG. 2A, the frustum shape is based on a four-sided pyramid, however, in various embodiments, the frustum shape can be based on a pyramid with a different number of sides, or the frustum shape can be based on a cone. The support frame 240 is formed by structural support members disposed along the edges of the frustum shape and joined together at their ends. The structural support members define a rectangular shaped top panel 280-*t*, trapezoidal shaped side panels 280-1, 280-2, 280-3, and 280-4, and a rectangular shaped bottom panel (not shown). Each of the side panels 280-1, 280-2, 280-3, and 280-4 is about flat, however in various embodiments, part, parts, or all of any of the side panels can be approximately flat, substantially flat, nearly flat, or completely flat. The container 200 includes a dispenser 260, which is configured to dispense one or more fluent products from one or more product volumes disposed within the container 200. In the embodiment of FIG. 2A, the dispenser 260 is disposed in the center of the top panel 280-*t*, however, in various alternate embodiments, the dispenser 260 can be disposed anywhere else on the top, sides, or bottom, of the container 200. FIG. 2B illustrates a front view of the container 200 of FIG. 2A, including exemplary additional/alternate locations for a dispenser, any of which can also apply to the back of the container. FIG. 2C illustrates a side view of the container 200 of FIG. 2A, including exemplary additional/alternate locations for a dispenser (shown as phantom lines), any of which can apply to either side of the container. FIG. 2D illustrates an isometric view of the container 200 of FIG. 2A.

Figure 3A:
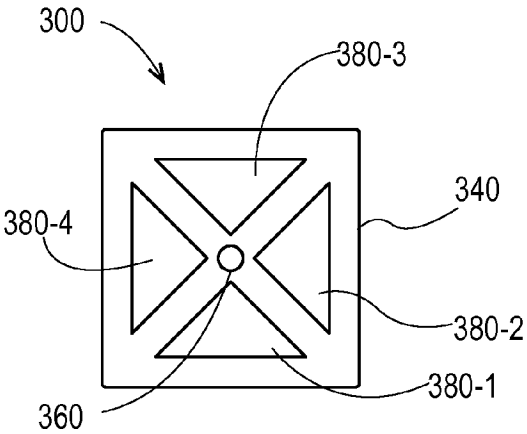
FIG. 3A illustrates a top view of a stand up flexible container having a structural support frame that has an overall shape like a pyramid.
Figure 3B:
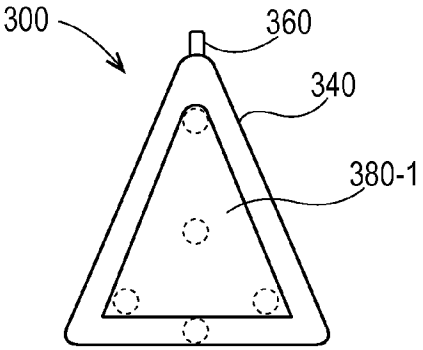
FIG. 3B illustrates a front view of the container of FIG. 3A.
Figure 3C:
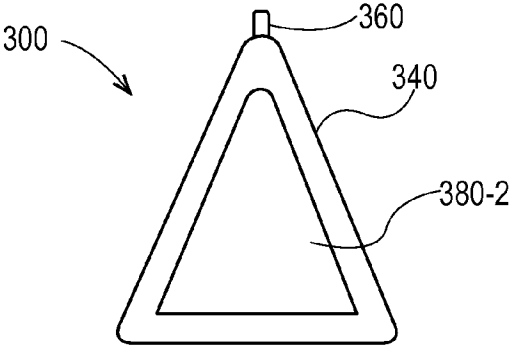
FIG. 3C illustrates a side view of the container of FIG. 3A.
Figure 3D:
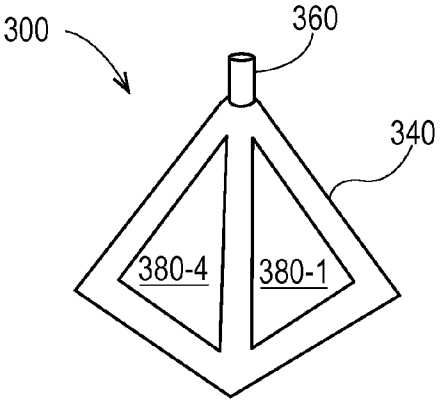
FIG. 3D illustrates an isometric view of the container of FIG. 3A.

FIG. 3A illustrates a front view of a stand up flexible container 300 having a structural support frame 340 that has an overall shape like a pyramid. In the embodiment of FIG. 3A, the pyramid shape is based on a four-sided pyramid, however, in various embodiments, the pyramid shape can be based on a pyramid with a different number of sides. The support frame 340 is formed by structural support members disposed along the edges of the pyramid shape and joined together at their ends. The structural support members define triangular shaped side panels 380-1, 380-2, 380-3, and 380-4, and a square shaped bottom panel (not shown). Each of the side panels 380-1, 380-2, 380-3, and 380-4 is about flat, however in various embodiments, part, parts, or all of any of the side panels can be approximately flat, substantially flat, nearly flat, or completely flat. The container 300 includes a dispenser 360, which is configured to dispense one or more fluent products from one or more product volumes disposed within the container 300. In the embodiment of FIG. 3A, the dispenser 360 is disposed at the apex of the pyramid shape, however, in various alternate embodiments, the dispenser 360 can be disposed anywhere else on the top, sides, or bottom, of the container 300. FIG. 3B illustrates a front view of the container 300 of FIG. 3A, including exemplary additional/alternate locations for a dispenser (shown as phantom lines), any of which can also apply to any side of the container. FIG. 3C illustrates a side view of the container 300 of FIG. 3A. FIG. 3D illustrates an isometric view of the container 300 of FIG. 3A.

Figure 4B:
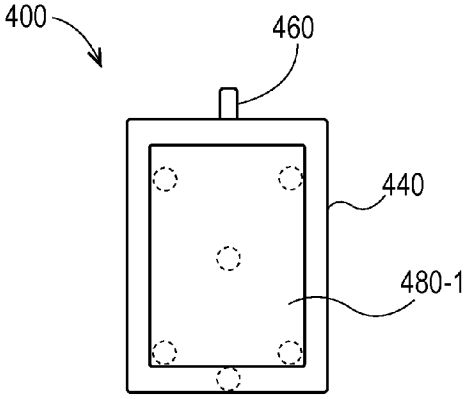
FIG. 4B illustrates a front view of the container of FIG. 4A.
Figure 4A:
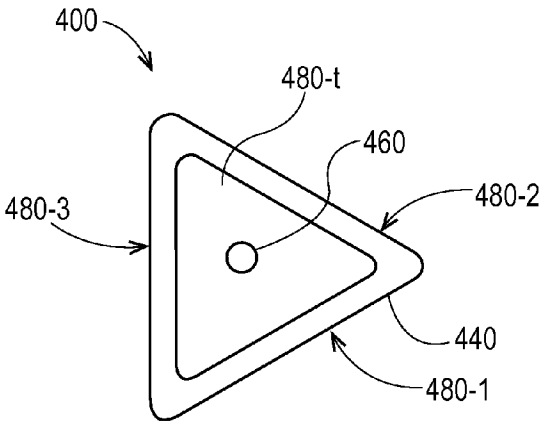
FIG. 4A illustrates a top view of a stand up flexible container having a structural support frame that has an overall shape like a trigonal prism.
Figure 4D:
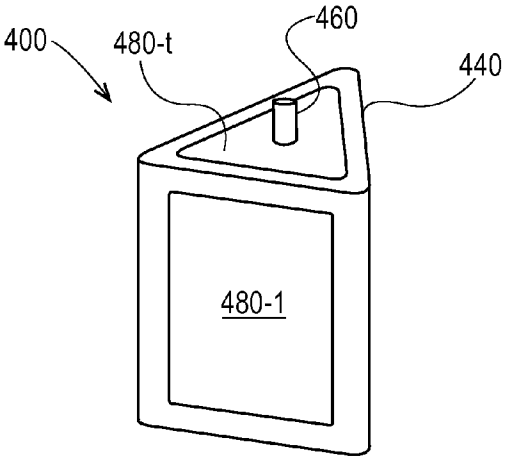
FIG. 4D illustrates an isometric view of the container of FIG. 4A.
Figure 4C:
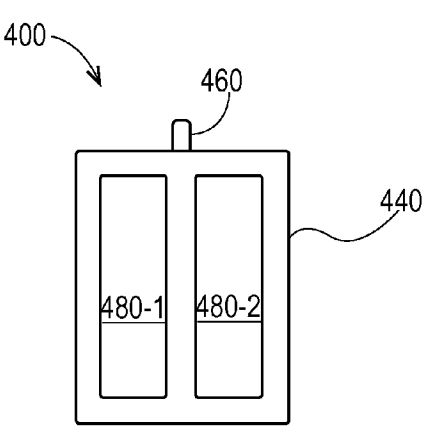
FIG. 4C illustrates a side view of the container of FIG. 4A.

FIG. 4A illustrates a front view of a stand up flexible container 400 having a structural support frame 440 that has an overall shape like a trigonal prism. In the embodiment of FIG. 4A, the prism shape is based on a triangle. The support frame 440 is formed by structural support members disposed along the edges of the prism shape and joined together at their ends. The structural support members define a triangular shaped top panel 480-*t*, rectangular shaped side panels 480-1, 480-2, and 480-3, and a triangular shaped bottom panel (not shown). Each of the side panels 480-1, 480-2, and 480-3 is about flat, however in various embodiments, part, parts, or all of any of the side panels can be approximately flat, substantially flat, nearly flat, or completely flat. The container 400 includes a dispenser 460, which is configured to dispense one or more fluent products from one or more product volumes disposed within the container 400. In the embodiment of FIG. 4A, the dispenser 460 is disposed in the center of the top panel 480-*t*, however, in various alternate embodiments, the dispenser 460 can be disposed anywhere else on the top, sides, or bottom, of the container 400. FIG. 4B illustrates a front view of the container 400 of FIG. 4A, including exemplary additional/alternate locations for a dispenser (shown as phantom lines), any of which can also apply to any side of the container 400. FIG. 4C illustrates a side view of the container 400 of FIG. 4A. FIG. 4D illustrates an isometric view of the container 400 of FIG. 4A.

Figure 5A:
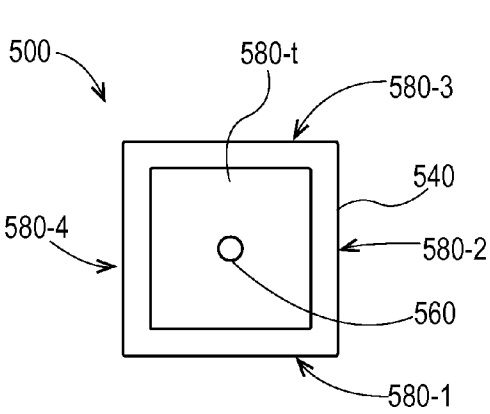
FIG. 5A illustrates a top view of a stand up flexible container having a structural support frame that has an overall shape like a tetragonal prism.
Figure 5B:
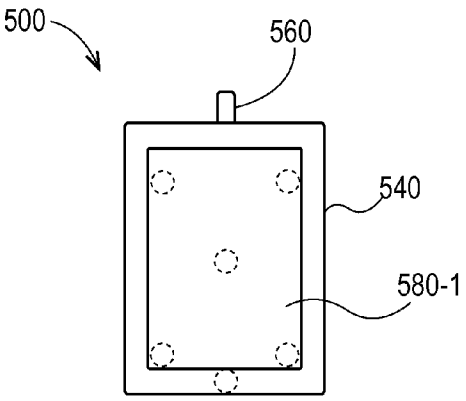
FIG. 5B illustrates a front view of the container of FIG. 5A.
Figure 5C:
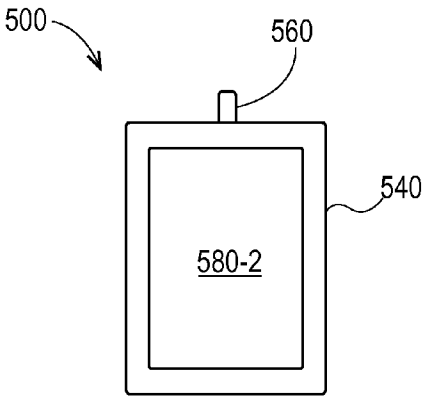
FIG. 5C illustrates a side view of the container of FIG. 5A.
Figure 5D:
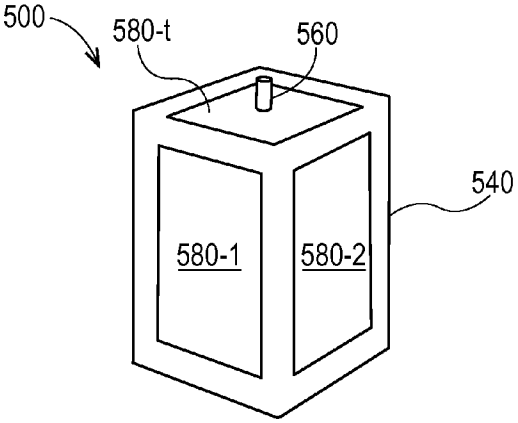
FIG. 5D illustrates an isometric view of the container of FIG. 5A.

FIG. 5A illustrates a front view of a stand up flexible container 500 having a structural support frame 540 that has an overall shape like a tetragonal prism. In the embodiment of FIG. 5A, the prism shape is based on a square. The support frame 540 is formed by structural support members disposed along the edges of the prism shape and joined together at their ends. The structural support members define a square shaped top panel 580-*t*, rectangular shaped side panels 580-1, 580-2, 580-3, and 580-4, and a square shaped bottom panel (not shown). Each of the side panels 580-1, 580-2, 580-3, and 580-4 is about flat, however in various embodiments, part, parts, or all of any of the side panels can be approximately flat, substantially flat, nearly flat, or completely flat. The container 500 includes a dispenser 560, which is configured to dispense one or more fluent products from one or more product volumes disposed within the container 500. In the embodiment of FIG. 5A, the dispenser 560 is disposed in the center of the top panel 580-*t*, however, in various alternate embodiments, the dispenser 560 can be disposed anywhere else on the top, sides, or bottom, of the container 500. FIG. 5B illustrates a front view of the container 500 of FIG. 5A, including exemplary additional/alternate locations for a dispenser (shown as phantom lines), any of which can also apply to any side of the container 500. FIG. 5C illustrates a side view of the container 500 of FIG. 5A. FIG. 5D illustrates an isometric view of the container 500 of FIG. 5A.

Figure 6B:
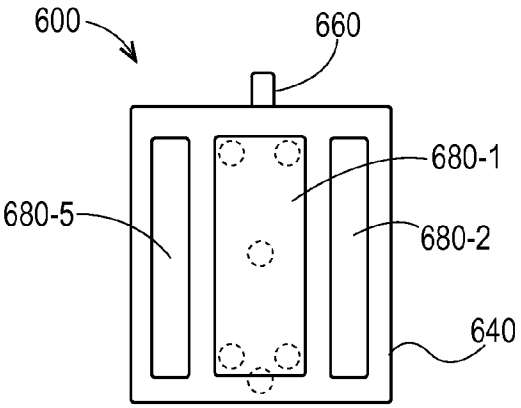
FIG. 6B illustrates a front view of the container of FIG. 6A.
Figure 6A:
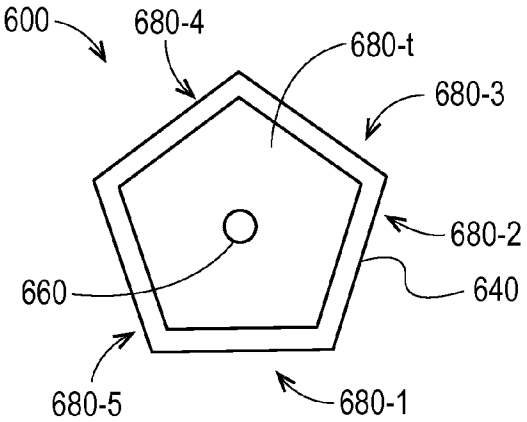
FIG. 6A illustrates a top view of a stand up flexible container having a structural support frame that has an overall shape like a pentagonal prism.
Figure 6D:
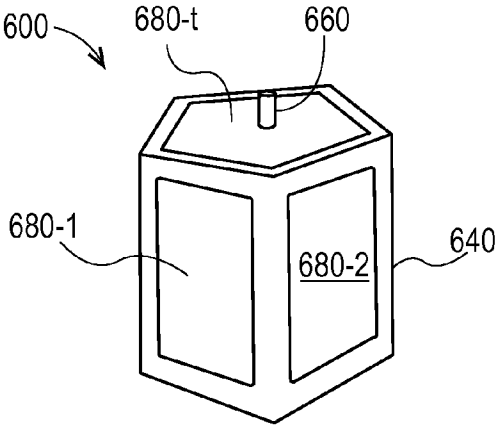
FIG. 6D illustrates an isometric view of the container of FIG. 6A.
Figure 6C:
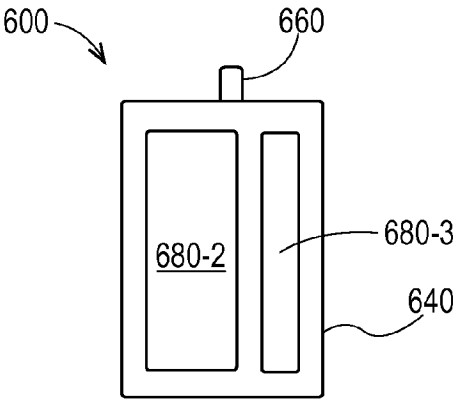
FIG. 6C illustrates a side view of the container of FIG. 6A.

FIG. 6A illustrates a front view of a stand up flexible container 600 having a structural support frame 640 that has an overall shape like a pentagonal prism. In the embodiment of FIG. 6A, the prism shape is based on a pentagon. The support frame 640 is formed by structural support members disposed along the edges of the prism shape and joined together at their ends. The structural support members define a pentagon shaped top panel 680-*t*, rectangular shaped side panels 680-1, 680-2, 680-3, 680-4, and 680-5, and a pentagon shaped bottom panel (not shown). Each of the side panels 680-1, 680-2, 680-3, 680-4, and 680-5 is about flat, however in various embodiments, part, parts, or all of any of the side panels can be approximately flat, substantially flat, nearly flat, or completely flat. The container 600 includes a dispenser 660, which is configured to dispense one or more fluent products from one or more product volumes disposed within the container 600. In the embodiment of FIG. 6A, the dispenser 660 is disposed in the center of the top panel 680-*t*, however, in various alternate embodiments, the dispenser 660 can be disposed anywhere else on the top, sides, or bottom, of the container 600. FIG. 6B illustrates a front view of the container 600 of FIG. 6A, including exemplary additional/alternate locations for a dispenser (shown as phantom lines), any of which can also apply to any side of the container 600. FIG. 6C illustrates a side view of the container 600 of FIG. 6A. FIG. 6D illustrates an isometric view of the container 600 of FIG. 6A.

Figure 7B:
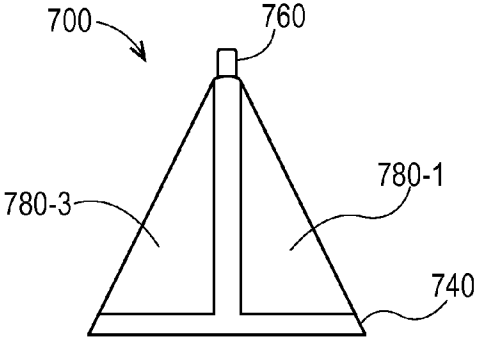
FIG. 7B illustrates a front view of the container of FIG. 7A.
Figure 7A:
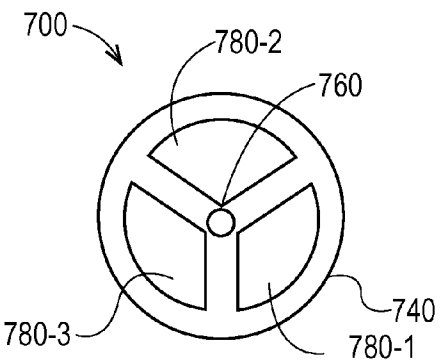
FIG. 7A illustrates a top view of a stand up flexible container having a structural support frame that has an overall shape like a cone.
Figure 7D:
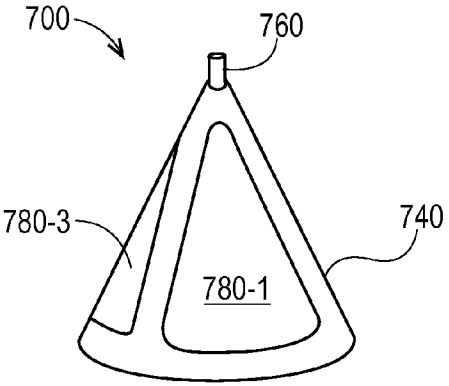
FIG. 7D illustrates an isometric view of the container of FIG. 7A.
Figure 7C:
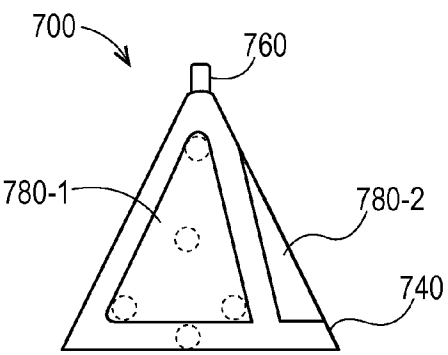
FIG. 7C illustrates a side view of the container of FIG. 7A.

FIG. 7A illustrates a front view of a stand up flexible container 700 having a structural support frame 740 that has an overall shape like a cone. The support frame 740 is formed by curved structural support members disposed around the base of the cone and by straight structural support members extending linearly from the base to the apex, wherein the structural support members are joined together at their ends. The structural support members define curved somewhat triangular shaped side panels 780-1, 780-2, and 780-3, and a circular shaped bottom panel (not shown). Each of the side panels 780-1, 780-2, and 780-3, is curved, however in various embodiments, part, parts, or all of any of the side panels can be approximately flat, substantially flat, nearly flat, or completely flat. The container 700 includes a dispenser 760, which is configured to dispense one or more fluent products from one or more product volumes disposed within the container 700. In the embodiment of FIG. 7A, the dispenser 760 is disposed at the apex of the conical shape, however, in various alternate embodiments, the dispenser 760 can be disposed anywhere else on the top, sides, or bottom, of the container 700. FIG. 7B illustrates a front view of the container 700 of FIG. 7A. FIG. 7C illustrates a side view of the container 700 of FIG. 7A, including exemplary additional/alternate locations for a dispenser (shown as phantom lines), any of which can also apply to any side panel of the container 700. FIG. 7D illustrates an isometric view of the container 700 of FIG. 7A.

Figure 8B:
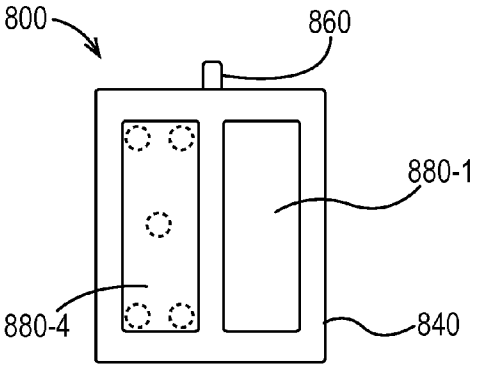
FIG. 8B illustrates a front view of the container of FIG. 8A.
Figure 8A:
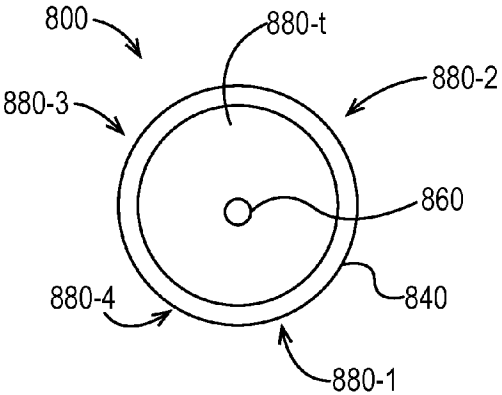
FIG. 8A illustrates a top view of a stand up flexible container having a structural support frame that has an overall shape like a cylinder.
Figure 8D:
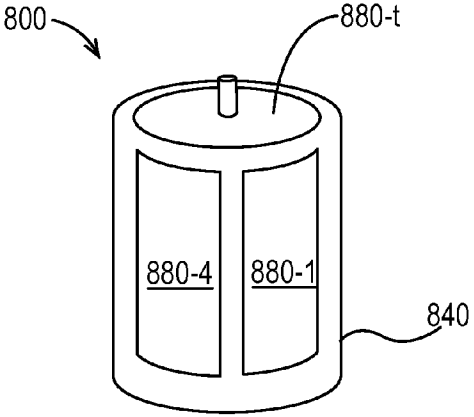
FIG. 8D illustrates an isometric view of the container of FIG. 8A.
Figure 8C:
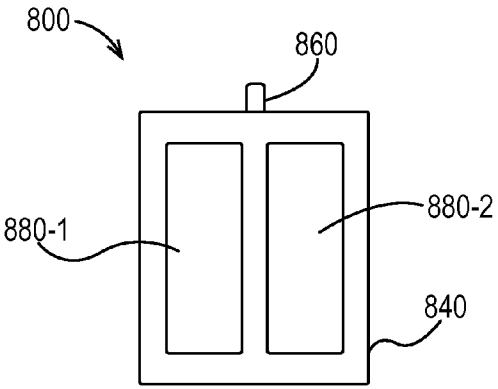
FIG. 8C illustrates a side view of the container of FIG. 8A.

FIG. 8A illustrates a front view of a stand up flexible container 800 having a structural support frame 840 that has an overall shape like a cylinder. The support frame 840 is formed by curved structural support members disposed around the top and bottom of the cylinder and by straight structural support members extending linearly from the top to the bottom, wherein the structural support members are joined together at their ends. The structural support members define a circular shaped top panel 880-*t*, curved somewhat rectangular shaped side panels 880-1, 880-2, 880-3, and 880-4, and a circular shaped bottom panel (not shown). Each of the side panels 880-1, 880-2, 880-3, and 880-4, is curved, however in various embodiments, part, parts, or all of any of the side panels can be approximately flat, substantially flat, nearly flat, or completely flat. The container 800 includes a dispenser 860, which is configured to dispense one or more fluent products from one or more product volumes disposed within the container 800. In the embodiment of FIG. 8A, the dispenser 860 is disposed in the center of the top panel 880-*t*, however, in various alternate embodiments, the dispenser 860 can be disposed anywhere else on the top, sides, or bottom, of the container 800. FIG. 8B illustrates a front view of the container 800 of FIG. 8A, including exemplary additional/alternate locations for a dispenser (shown as phantom lines), any of which can also apply to any side panel of the container 800. FIG. 8C illustrates a side view of the container 800 of FIG. 8A. FIG. 8D illustrates an isometric view of the container 800 of FIG. 8A.

In additional embodiments, any stand up flexible container with a structural support frame, as disclosed herein, can be configured to have an overall shape that corresponds with any other known three-dimensional shape, including any kind of polyhedron, any kind of prismatoid, and any kind of prism (including right prisms and uniform prisms).

Figure 9B:
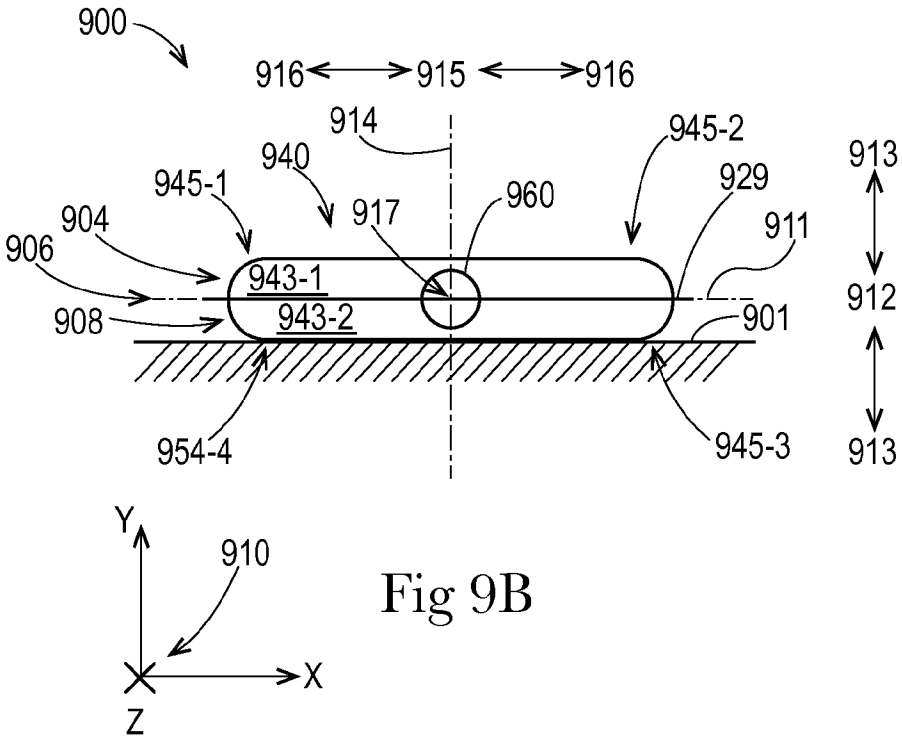
FIG. 9B illustrates an end view of the flexible container of FIG. 9A.
Figure 9A:
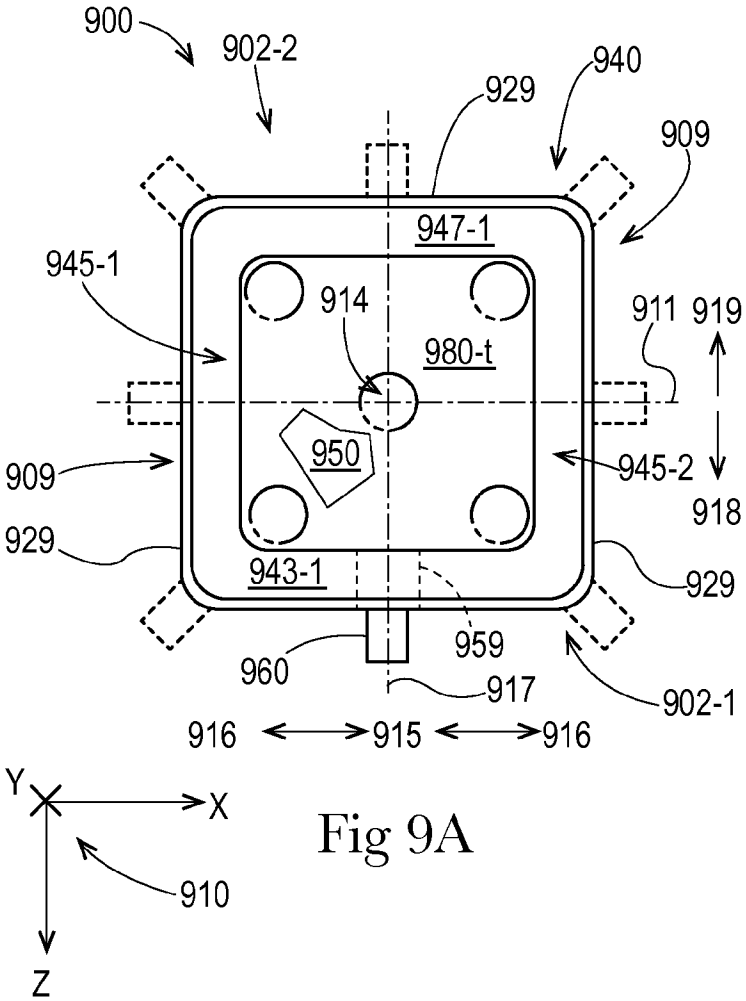
FIG. 9A illustrates a top view of an embodiment of a self-supporting flexible container, having an overall shape like a square.

FIG. 9A illustrates a top view of an embodiment of a self-supporting flexible container 900, having an overall shape like a square. FIG. 9B illustrates an end view of the flexible container 900 of FIG. 9A. The container 900 is resting on a horizontal support surface 901.

In FIG. 9B, a coordinate system 910, provides lines of reference for referring to directions in the figure. The coordinate system 910 is a three-dimensional Cartesian coordinate system, with an X-axis, a Y-axis, and a Z-axis. The X-axis and the Z-axis are parallel with the horizontal support surface 901 and the Y-axis is perpendicular to the horizontal support surface 901.

FIG. 9A also includes other lines of reference, for referring to directions and locations with respect to the container 900. A lateral centerline 911 runs parallel to the X-axis. An XY plane at the lateral centerline 911 separates the container 900 into a front half and a back half. An XZ plane at the lateral centerline 911 separates the container 100 into an upper half and a lower half. A longitudinal centerline 914 runs parallel to the Y-axis. A YZ plane at the longitudinal centerline 914 separates the container 900 into a left half and a right half. A third centerline 917 runs parallel to the Z-axis. The lateral centerline 911, the longitudinal centerline 914, and the third centerline 917 all intersect at a center of the container 900. These terms for direction, orientation, measurement, and disposition, in the embodiment of FIGS. 9A-9B are the same as the like-numbered terms in the embodiment of FIGS. 1A-1D.

The container 900 includes a top 904, a middle 906, and a bottom 908, the front 902-1, the back 902-2, and left and right sides 909. In the embodiment of FIGS. 9A-9B, the upper half and the lower half of the container are joined together at a seal 929, which extends around the outer periphery of the container 900.

The container 900 includes a structural support frame 940, a product volume 950, a dispenser 960, a top panel 980-*t* and a bottom panel (not shown). A portion of the top panel 980-*t* is illustrated as broken away, in order to show the product volume 950. The product volume 950 is configured to contain one or more fluent products. The dispenser 960 allows the container 900 to dispense these fluent product(s) from the product volume 950 through a flow channel 959 then through the dispenser 960, to the environment outside of the container 900. The structural support frame 940 supports the mass of fluent product(s) in the product volume 950. The top panel 980-*t* and the bottom panel are relatively flat surfaces, overlaying the product volume 950, and are suitable for displaying any kind of indicia.

The structural support frame 940 is formed by a plurality of structural support members. The structural support frame 940 includes front structural support members 943-1 and 943-2, intermediate structural support members 945-1, 945-2, 945-3, and 945-4, as well as back structural support members 947-1 and 947-2. Overall, each of the structural support members in the container 900 is oriented horizontally. And, each of the structural support members in the container 900 has a cross-sectional area that is substantially uniform along its length, although in various embodiments, this cross-sectional area can vary.

Upper structural support members 943-1, 945-1, 945-2, and 947-1 are disposed in an upper part of the middle 906 and in the top 904, while lower structural support members 943-2, 945-4, 945-3, and 947-2 are disposed in a lower part of the middle 906 and in the bottom 908. The upper structural support members 943-1, 945-1, 945-2, and 947-1 are disposed above and adjacent to the lower structural support members 943-2, 945-4, 945-3, and 947-2, respectively.

In various embodiments, adjacent upper and lower structural support members can be in contact with each other at one or more relatively smaller locations and/or at one or more relatively larger locations, along part, or parts, or about all, or approximately all, or substantially all, or nearly all of their overall lengths, so long as there is a gap in the contact for the flow channel 959, between the structural support members 943-1 and 943-2. In the embodiment of FIGS. 9A-9B, the upper and lower structural support members are not directly connected to each other. However, in various alternate embodiments, adjacent upper and lower structural support members can be directly connected and/or joined together along part, or parts, or about all, or approximately all, or substantially all, or nearly all, or all of their overall lengths.

The ends of structural support members 943-1, 945-2, 947-1, and 945-1 are joined together to form a top square that is outward from and surrounding the product volume 950, and the ends of structural support members 943-2, 945-3, 947-2, and 945-4 are also joined together to form a bottom square that is outward from and surrounding the product volume 950. In the structural support frame 940, the ends of the structural support members, which are joined together, are directly connected, all around the periphery of their walls. However, in various alternative embodiments, any of the structural support members of the embodiment of FIGS. 9A-9B can be joined together in any way described herein or known in the art.

In alternative embodiments of the structural support frame 940, adjacent structural support members can be combined into a single structural support member, wherein the combined structural support member can effectively substitute for the adjacent structural support members, as their functions and connections are described herein. In other alternative embodiments of the structural support frame 940, one or more additional structural support members can be added to the structural support members in the structural support frame 940, wherein the expanded structural support frame can effectively substitute for the structural support frame 940, as its functions and connections are described herein.

FIGS. 10A-11B illustrate embodiments of self-supporting flexible containers (that are not stand up containers) having various overall shapes. Any of the embodiments of FIGS. 10A-11B can be configured according to any of the embodiments disclosed herein, including the embodiments of FIGS. 9A-9B. Any of the elements (e.g. structural support frames, structural support members, panels, dispensers, etc.) of the embodiments of FIGS. 10A-11B, can be configured according to any of the embodiments disclosed herein. While each of the embodiments of FIGS. 10A-11B illustrates a container with one dispenser, in various embodiments, each container can include multiple dispensers, according to any embodiment described herein. Part, parts, or all of each of the panels in the embodiments of FIGS. 10A-11B is suitable to display any kind of indicia. Each of the top and bottom panels in the embodiments of FIGS. 10A-11B is configured to be a non-structural panel, overlaying product volume(s) disposed within the flexible container, however, in various embodiments, one or more of any kind of decorative or structural element (such as a rib, protruding from an outer surface) can be joined to part, parts, or all of any of these panels. For clarity, not all structural details of these flexible containers are shown in FIGS. 10A-11B, however any of the embodiments of FIGS. 10A-11B can be configured to include any structure or feature for flexible containers, disclosed herein.

Figure 10B:
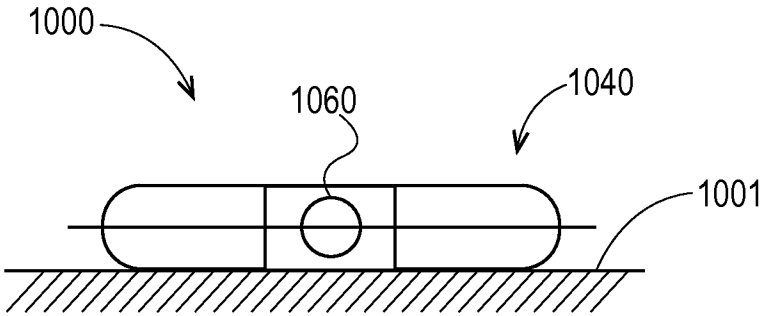
FIG. 10B illustrates an end view of the flexible container of FIG. 10A.
Figure 10A:
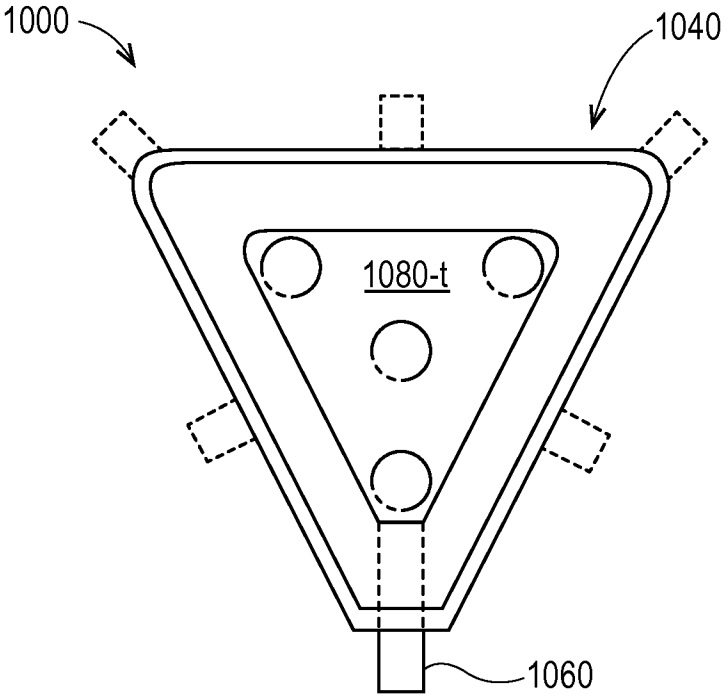
FIG. 10A illustrates a top view of an embodiment of a self-supporting flexible container, having an overall shape like a triangle.
Figure 11B:
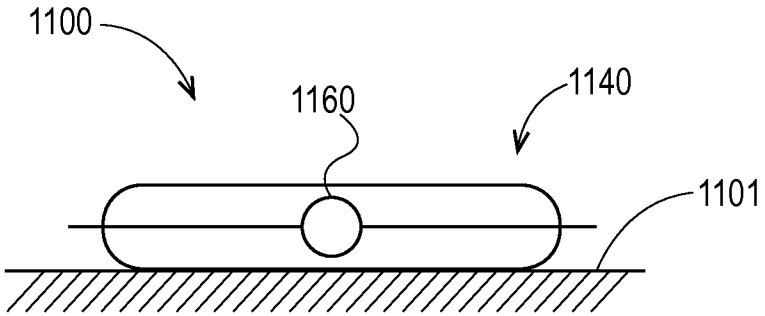
FIG. 11B illustrates an end view of the flexible container of FIG. 11A.
Figure 11A:
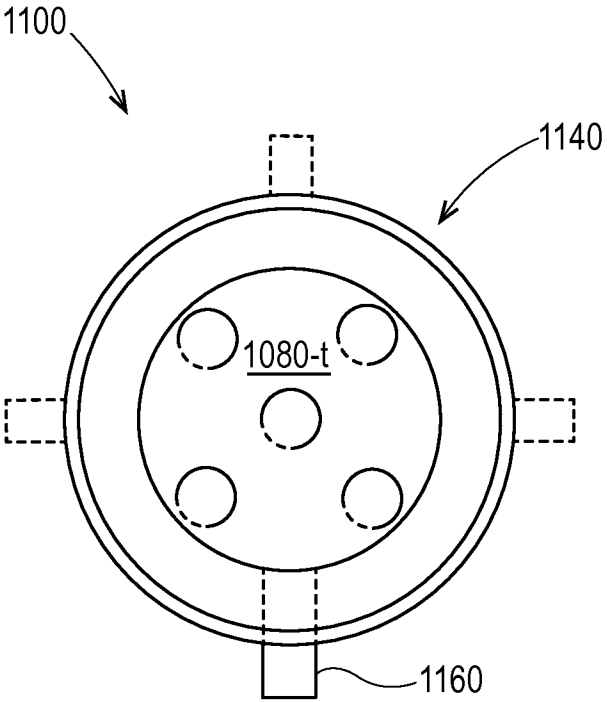
FIG. 11A illustrates a top view of an embodiment of a self-supporting flexible container, having an overall shape like a circle.

FIG. 10A illustrates a top view of an embodiment of a self-supporting flexible container 1000 (that is not a stand-up flexible container) having an overall shape like a triangle. However, in various embodiments, a self-supporting flexible container can have an overall shape like a polygon having any number of sides. The support frame 1040 is formed by structural support members disposed along the edges of the triangular shape and joined together at their ends. The structural support members define a triangular shaped top panel 1080-*t*, and a triangular shaped bottom panel (not shown). The top panel 1080-*t* and the bottom panel are about flat, however in various embodiments, part, parts, or all of any of the side panels can be approximately flat, substantially flat, nearly flat, or completely flat. The container 1000 includes a dispenser 1060, which is configured to dispense one or more fluent products from one or more product volumes disposed within the container 1000. In the embodiment of FIG. 10A, the dispenser 1060 is disposed in the center of the front, however, in various alternate embodiments, the dispenser 1060 can be disposed anywhere else on the top, sides, or bottom, of the container 1000. FIG. 10A includes exemplary additional/alternate locations for a dispenser (shown as phantom lines). FIG. 10B illustrates an end view of the flexible container 1000 of FIG. 10B, resting on a horizontal support surface 1001. FIG. 11A illustrates a top view of an embodiment of a self-supporting flexible container 1100 (that is not a stand-up flexible container) having an overall shape like a circle. The support frame 1140 is formed by structural support members disposed around the circumference of the circular shape and joined together at their ends. The structural support members define a circular shaped top panel 1180-*t*, and a circular shaped bottom panel (not shown). The top panel 1180-*t* and the bottom panel are about flat, however in various embodiments, part, parts, or all of any of the side panels can be approximately flat, substantially flat, nearly flat, or completely flat. The container 1100 includes a dispenser 1160, which is configured to dispense one or more fluent products from one or more product volumes disposed within the container 1100. In the embodiment of FIG. 11A, the dispenser 1160 is disposed in the center of the front, however, in various alternate embodiments, the dispenser 1160 can be disposed anywhere else on the top, sides, or bottom, of the container 1100. FIG. 11A includes exemplary additional/alternate locations for a dispenser (shown as phantom lines). FIG. 11B illustrates an end view of the flexible container 1100 of FIG. 10B, resting on a horizontal support surface 1101.

In additional embodiments, any self-supporting container with a structural support frame, as disclosed herein, can be configured to have an overall shape that corresponds with any other known three-dimensional shape. For example, any self-supporting container with a structural support frame, as disclosed herein, can be configured to have an overall shape (when observed from a top view) that corresponds with a rectangle, a polygon (having any number of sides), an oval, an ellipse, a star, or any other shape, or combinations of any of these.

Figure 12A:
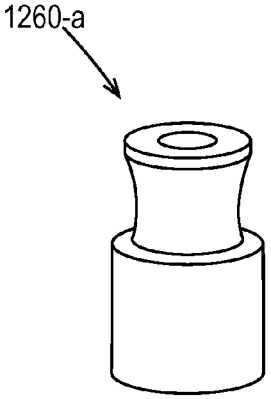
FIG. 12A illustrates an isometric view of a push-pull type dispenser.
Figure 12B:
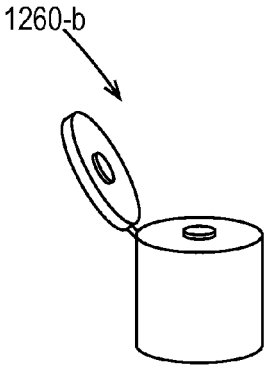
FIG. 12B illustrates an isometric view of a dispenser with a flip-top cap.
Figure 12C:
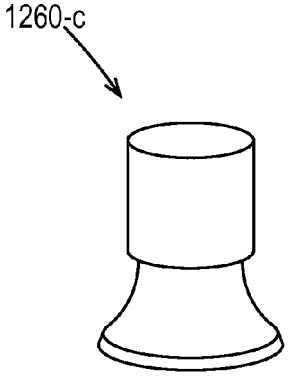
FIG. 12C illustrates an isometric view of a dispenser with a screw-on cap.
Figure 12D:
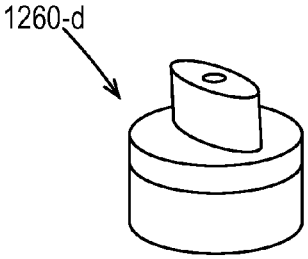
FIG. 12D illustrates an isometric view of a rotatable type dispenser.
Figure 12E:
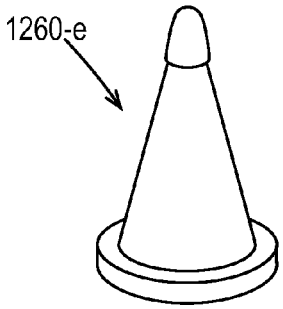
FIG. 12E illustrates an isometric view of a nozzle type dispenser with a cap.
Figures 13A, 13B, 13C, 13D:
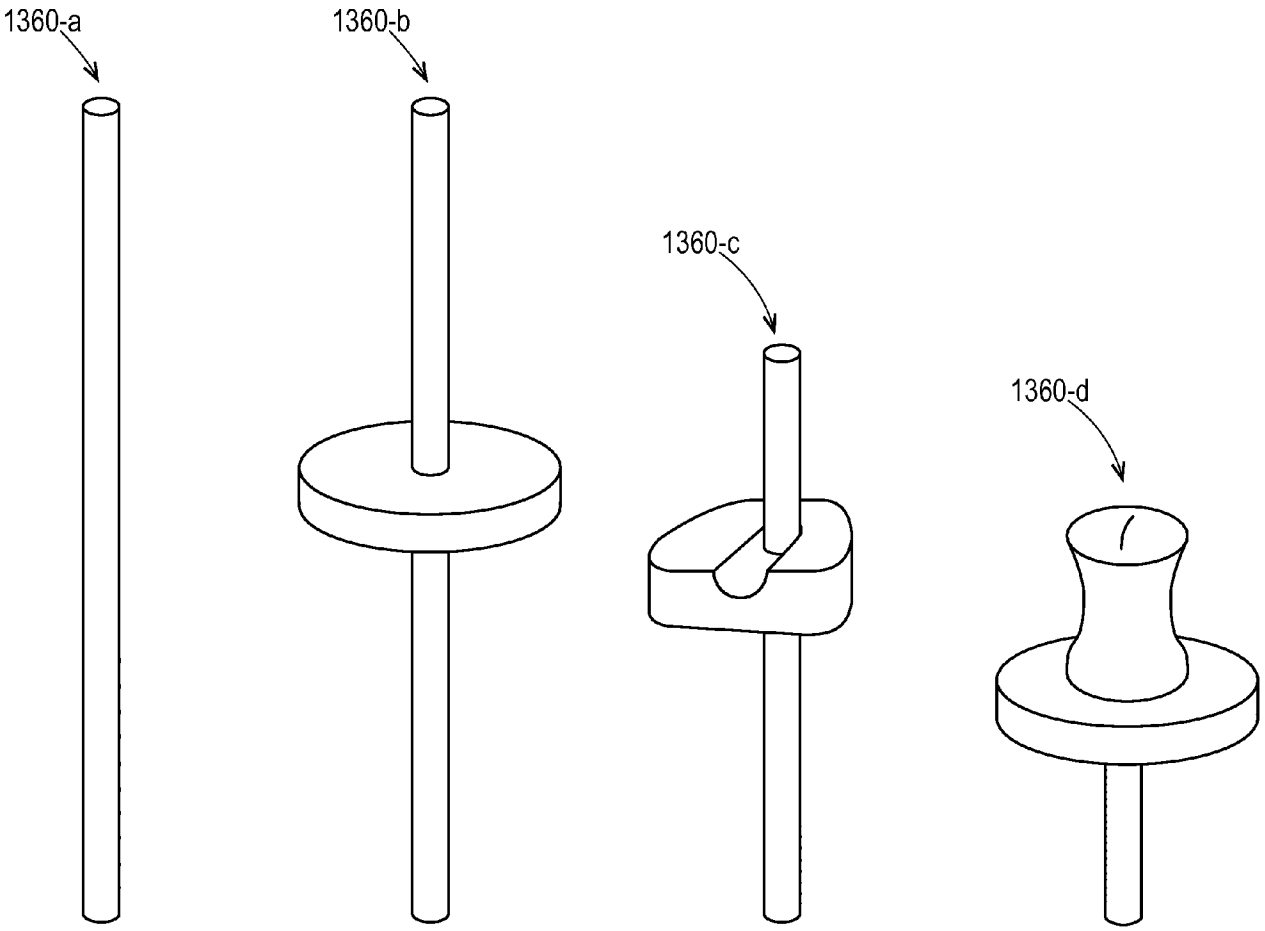
FIG. 13A illustrates an isometric view of a straw dispenser.
FIG. 13B illustrates an isometric view of a straw dispenser with a lid.
FIG. 13C illustrates an isometric view of a flip up straw dispenser.
FIG. 13D illustrates an isometric view of a straw dispenser with a bite valve.
Figure 14A:
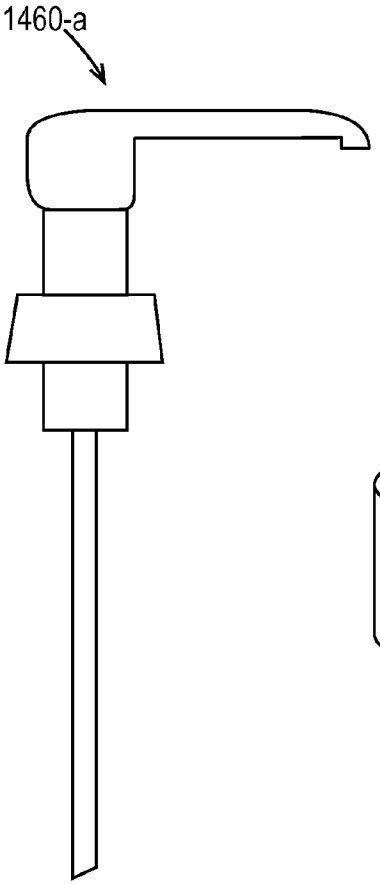
FIG. 14A illustrates an isometric view of a pump type dispenser.
Figure 14B:
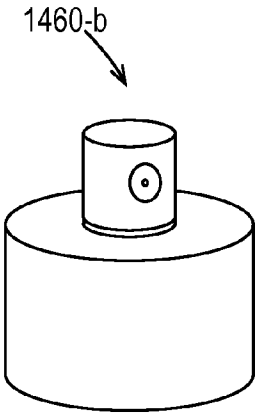
FIG. 14B illustrates an isometric view of a pump spray type dispenser.
Figure 14C:
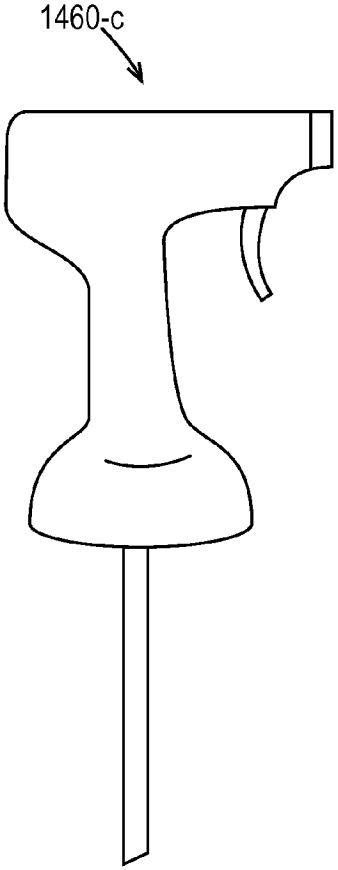
FIG. 14C illustrates an isometric view of a trigger spray type dispenser.

FIGS. 12A-14C illustrate various exemplary dispensers, which can be used with the flexible containers disclosed herein. FIG. 12A illustrates an isometric view of push-pull type dispenser 1260-*a*. FIG. 12B illustrates an isometric view of dispenser with a flip-top cap 1260-*b*. FIG. 12C illustrates an isometric view of dispenser with a screw-on cap 1260-*c*. FIG. 12D illustrates an isometric view of rotatable type dispenser 1260-*d*. FIG. 12E illustrates an isometric view of nozzle type dispenser with a cap 1260-*d*. FIG. 13A illustrates an isometric view of straw dispenser 1360-*a*. FIG. 13B illustrates an isometric view of straw dispenser with a lid 1360-*b*. FIG. 13C illustrates an isometric view of flip up straw dispenser 1360-*c*. FIG. 13D illustrates an isometric view of straw dispenser with bite valve 1360-*d*. FIG. 14A illustrates an isometric view of pump type dispenser 1460-*a*. FIG. 14B illustrates an isometric view of pump spray type dispenser 1460-*b*. FIG. 14C illustrates an isometric view of trigger spray type dispenser 1460-*c*.

The middle structural support members 146-1, 146-2, 146-3, and 146-4 of the disposable flexible containers of the present disclosure may be expanded, inflated, or otherwise filled, to a selected pressure. It is found that filling the structural support volumes to a gauge pressure in a range of about 13,750 Pa to about 69,000 Pa, more preferably, about 27,500 Pa to about 55,000 Pa, and most preferably, about 34,400 Pa, permits the structural support volumes to be of a sufficient rigidity to hold the container upright, but be sufficiently flexible to permit the support volumes to be squeezed toward one another to facilitate extraction of fluid product from the product volume within the container. Gauge pressures within any range formed by any of the preceding values, such as: from about 13,750 Pa to about 69,000 Pa, about 20,000 Pa to about 55,000 Pa, about 27,500 Pa to about 48,000 Pa, about 34,000 Pa to about 41,000 Pa, about 13,750 Pa to about 34,000 Pa, and about 34,000 Pa to about 69,000 Pa, are also considered within the scope of the present disclosure. Inflating the structural support volumes to pressures within these ranges lend attributes to the disposable flexible container, including imparting firmness and rigidity to the overall flexible container while having sufficient play or relaxation to permit the container to be squeezed without compromising the integrity of the structural support volumes or the product volume.

Figure 15A:
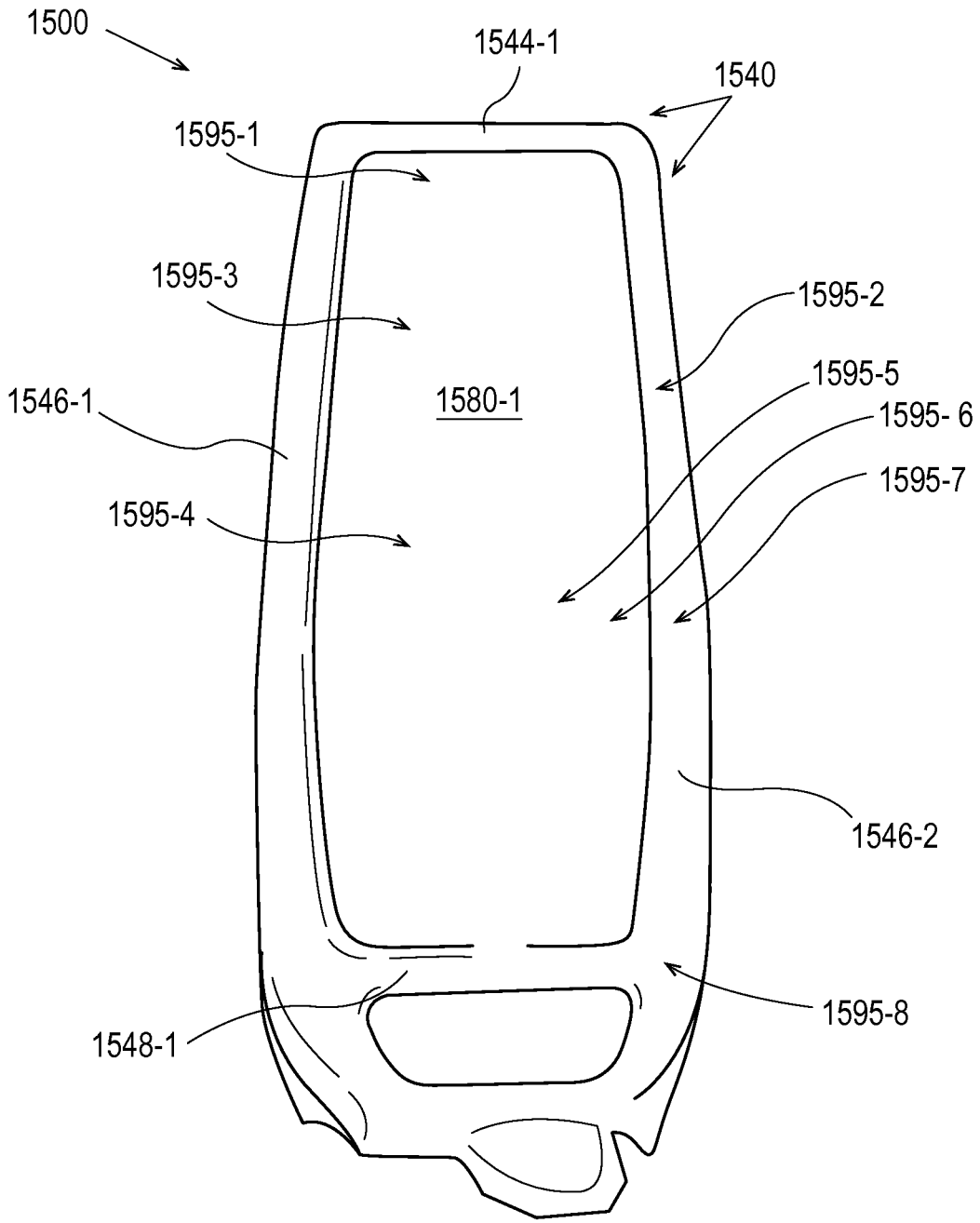
FIG. 15A illustrates a disposable flexible container of at least one aspect of the present disclosure.

Turning now to FIGS. 15A-20B, an aspect of the present disclosure is that measurements of hardness (also referred to herein as surface hardness) of the disclosed disposable flexible containers reflect a gradient of harnesses along the various surfaces of the containers. For instance, a flexible container 1500 has a configuration as illustrated in FIG. 15A, with elements that are like-numbered, with elements in the embodiment of FIGS. 1A-1D. The flexible container 1500 has a main nonstructural support panel 1580-1 surrounded by structural support volumes 1544-1, 1546-1, 1546-2, and 1548-1 that are part of a structural support frame 1540. The flexible container 1500 was tested by measuring hardness at eight distinct locations, identified by the following numbers in FIG. 15A: a first measurement location 1595-1 (on an outer surface of the panel 1580-1, in an upper portion of its top, along the longitudinal centerline); a second measurement location 1595-2 (on an outer surface of the middle support member 1546-2, in its uppermost portion, in the middle of its front); a third measurement location 1595-3 (on an outer surface of the panel 1580-1, in a lower portion of its top, along the longitudinal centerline); a fourth measurement location 1595-4 (on an outer surface of the panel 1580-1, in a center of the container); a fifth measurement location 1595-5 (on an outer surface of the panel 1580-1, along the lateral centerline, about halfway to a longitudinal edge of the panel 15801-1); a sixth measurement location 1595-6 (on an outer surface of the panel 1580-1, along the lateral centerline, proximate to the longitudinal edge of the panel 15801-1); a seventh measurement location 1595-7 (on an outer surface of the middle structural support member 1546-1, along the lateral centerline, in the middle of its front); and an eighth measurement location 1595-8 (on an outer surface of the middle structural support member 1546-1, in its lowermost portion, in the middle of its front).

All hardness measurements described herein were performed using an ASTM F1306 Penetration Probe having a 3.2 mm diameter hemispherical (biaxial stress) tip indented into the surface of the material of the container at the location to be measured, at a rate of 3 mm/s, with a preload of 0.3 N.

Figure 15B:
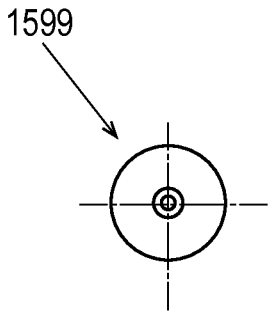
FIG. 15B is an end view of an indentor used to perform the hardness measurements depicted in the plot of FIGS. 15D, 18, 20, and 30.
Figure 15C:
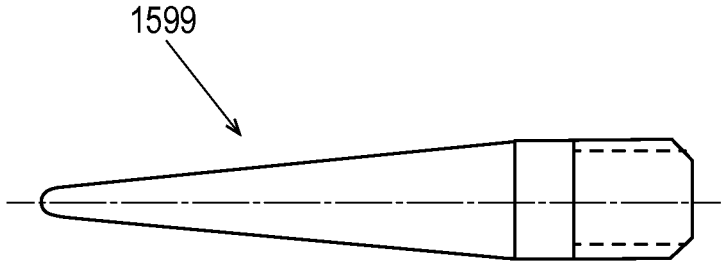
FIG. 15C is a side plan view of the indentor used to perform the hardness measurements depicted in the plot of FIGS. 15D, 16*b-e*, 18, 20, and 30.
Figure 15D:
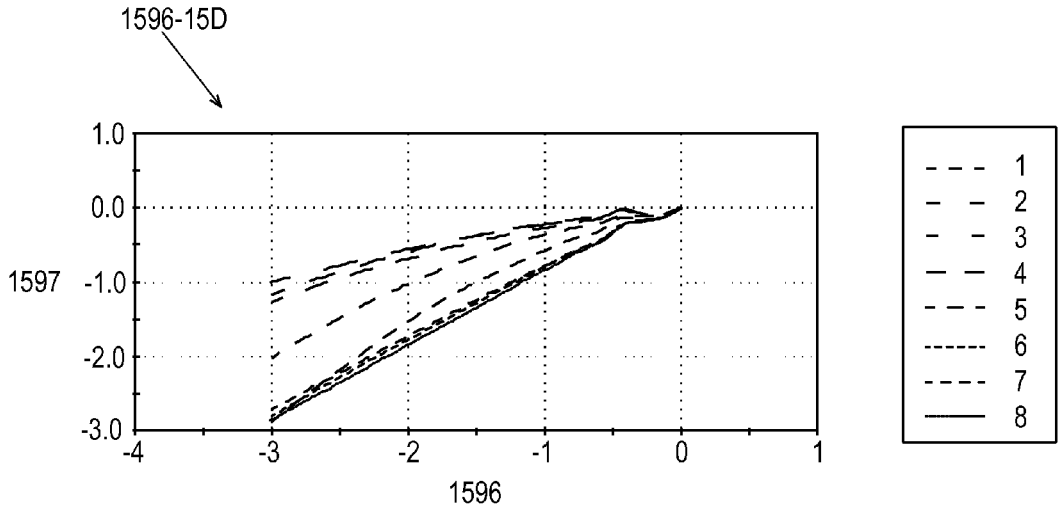
FIG. 15D is a plot of hardness measurements at various locations along outer surfaces of the flexible container of FIG. 15A.

FIG. 15B is a distal end view of the ASTM F1306 Penetration Probe 1599 and FIG. 15C is a side view of the ASTM F1306 Penetration Probe 1599. For each measurement, the probe was displaced into the surface of the material a distance of 3 mm from initial contact with the surface. From FIG. 15D, which is a plot 1596-15D of load 1597 (in units of Newtons (N)) versus displacement 1598 (in units of millimeters (mm)) for hardness measurements at measurement locations 1595-1 through 1595-8, one can appreciate that the hardness is lowest in the non-structural panel region of the container (e.g., locations 4 and 5) and highest in the structural support volumes (e.g., location 8), when the product volume of the flexible container 1500 is empty or filled with a low viscosity fluid material at atmospheric pressure.

Figure 16A:
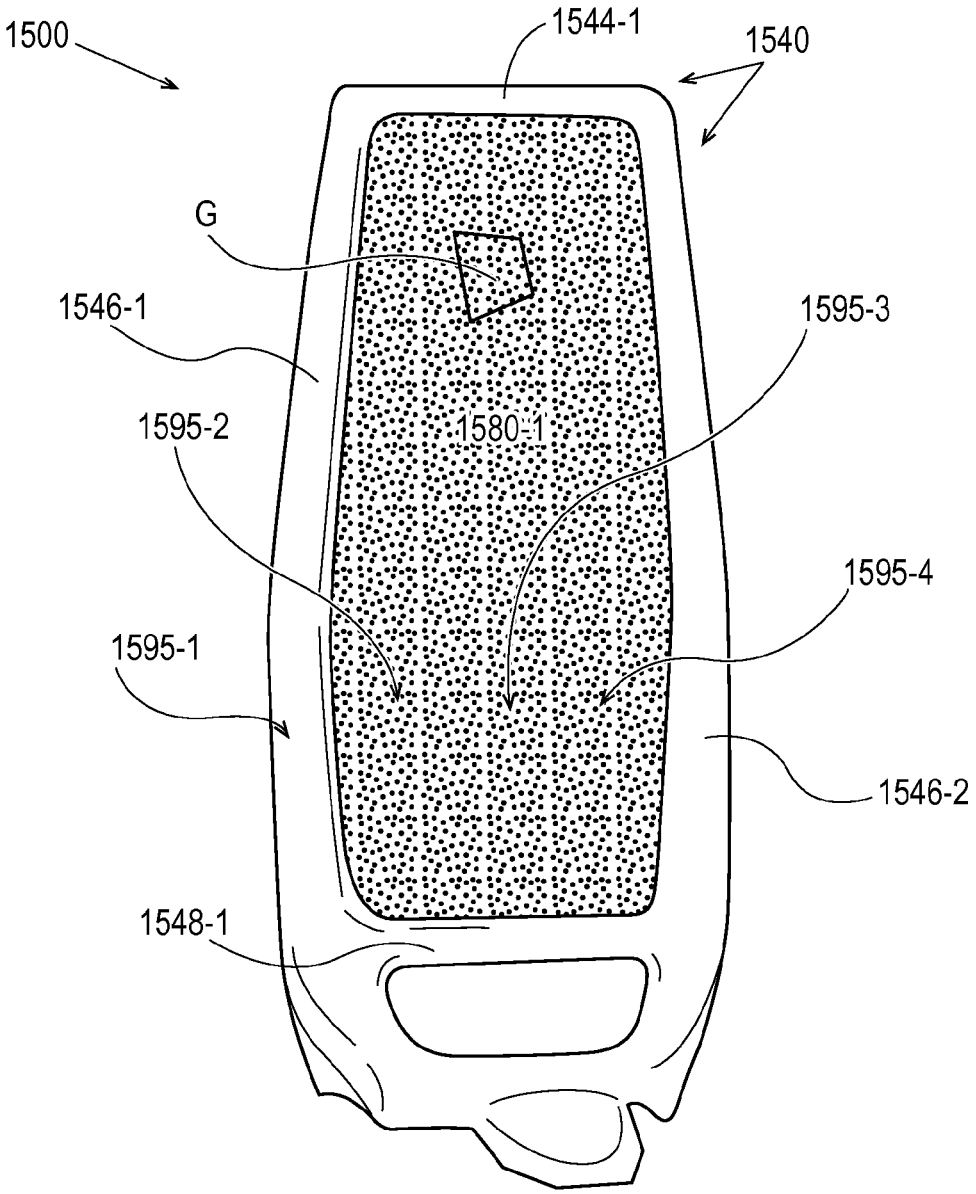
FIG. 16A illustrates a disposable flexible container having a product volume filled with a granular fluent material with an identification of a plurality of points at various locations on outer surfaces of the flexible container at which hardness of the container outer surface was tested.

Alternatively, if the product volume of the flexible container 1500 is filled with a granular solid flowable material, it is appreciated that the hardness can be relatively higher at locations on the outer surface of the non-structural panel and relatively lower at locations on the outer surface of the structural support volumes. For instance, a flexible container 1500 has a configuration as illustrated in FIG. 16A, with elements that are like-numbered, with elements in the embodiment of FIGS. 1A-1D. The flexible container 1500 was filled with a granular solid flowable material G (i.e. sand) and tested by measuring hardness at four distinct locations, identified by the following numbers in FIG. 16A: a first measurement location 1595-1 (on an outer surface of the middle structural support member 1546-1, in its lowermost portion, in the middle of its front); a second measurement location 1595-2 (laterally inboard from the first measurement location 1595-1, on an outer surface of the panel 1580-1, proximate to the near longitudinal edge of the panel 1581-1); a third measurement location 1595-3 (laterally inboard from the second measurement location 1595-2, on an outer surface of the panel 1580-1, along the longitudinal centerline); and a fourth measurement location 1595-4 (laterally inboard from the second measurement location 1595-2, on an outer surface of the panel 1580-1, on an outer surface of the panel 1580-1, proximate to the near longitudinal edge of the panel 1581-1). Hardness measurements were taken at each location; the results are provided below in Table 1.

TABLE 1

| | First Location | Second Location | Third Location | Fourth Location |
|---|---|---|---|---|
| Pass 1 | 3.09113 | 8.87542 | 8.05519 | 7.79018 |
| Pass 2 | 3.01320 | 7.25581 | 6.08533 | 6.01762 |
| Pass 3 | 2.95436 | 6.48773 | 5.23318 | |
| Max Load (N) | 3.09113 | 8.87542 | 8.05519 | 7.79018 |
| Avg Load (N) | 3.02 | 7.54 | 6.46 | 6.90 |
| Std Dev | 0.07 | 1.22 | 1.45 | 1.25 |

Figure 16B:
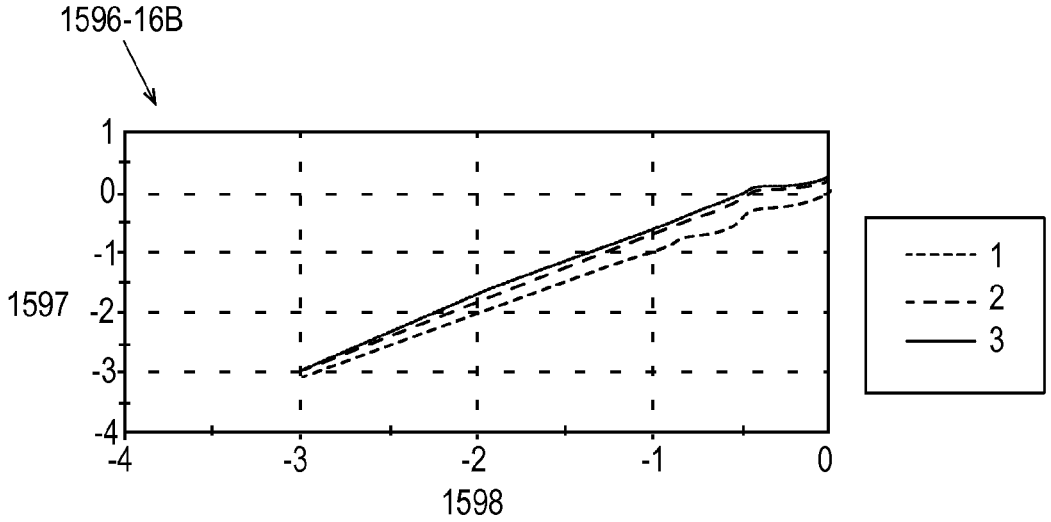
FIG. 16B is a plot of hardness measurements at a first location along the outer surfaces of the flexible container identified in FIG. 16*a;*
Figure 16C:
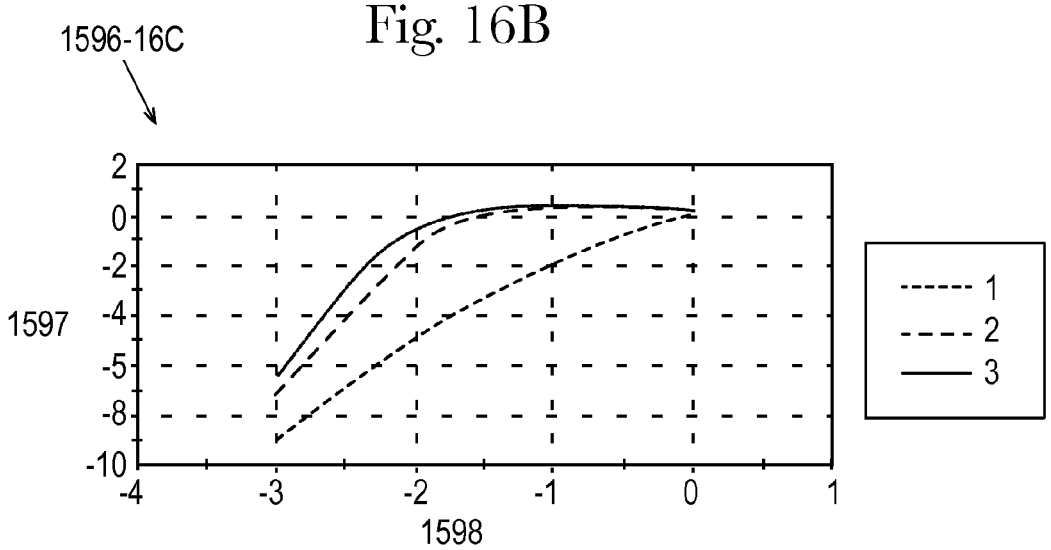
FIG. 16C is a plot of hardness measurements at a second location along the outer surfaces of the flexible container identified in FIG. 16*a;*
Figure 16D:
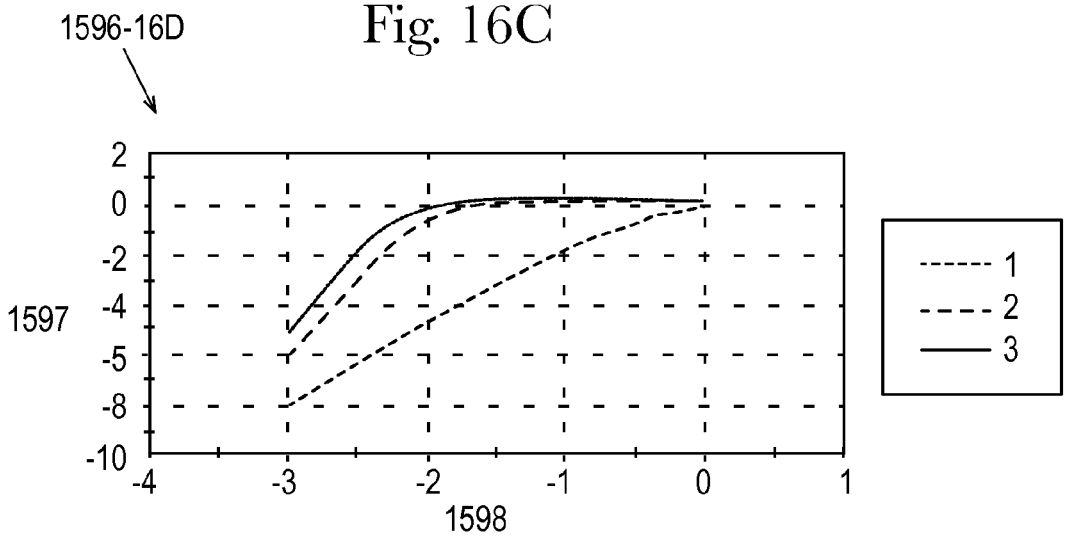
FIG. 16D is a plot of hardness measurements at a third location along the outer surfaces of the flexible container identified in FIG. 16*a;*

FIGS. 16B-16D depict plots 1596-16B, 1596-16C, and 1596-16D of the hardness measurements at the first three respective measurement locations in FIG. 16A. As the plots of FIGS. 16B-16D illustrate, the location with the greatest hardness was the second location.

Figure 17:
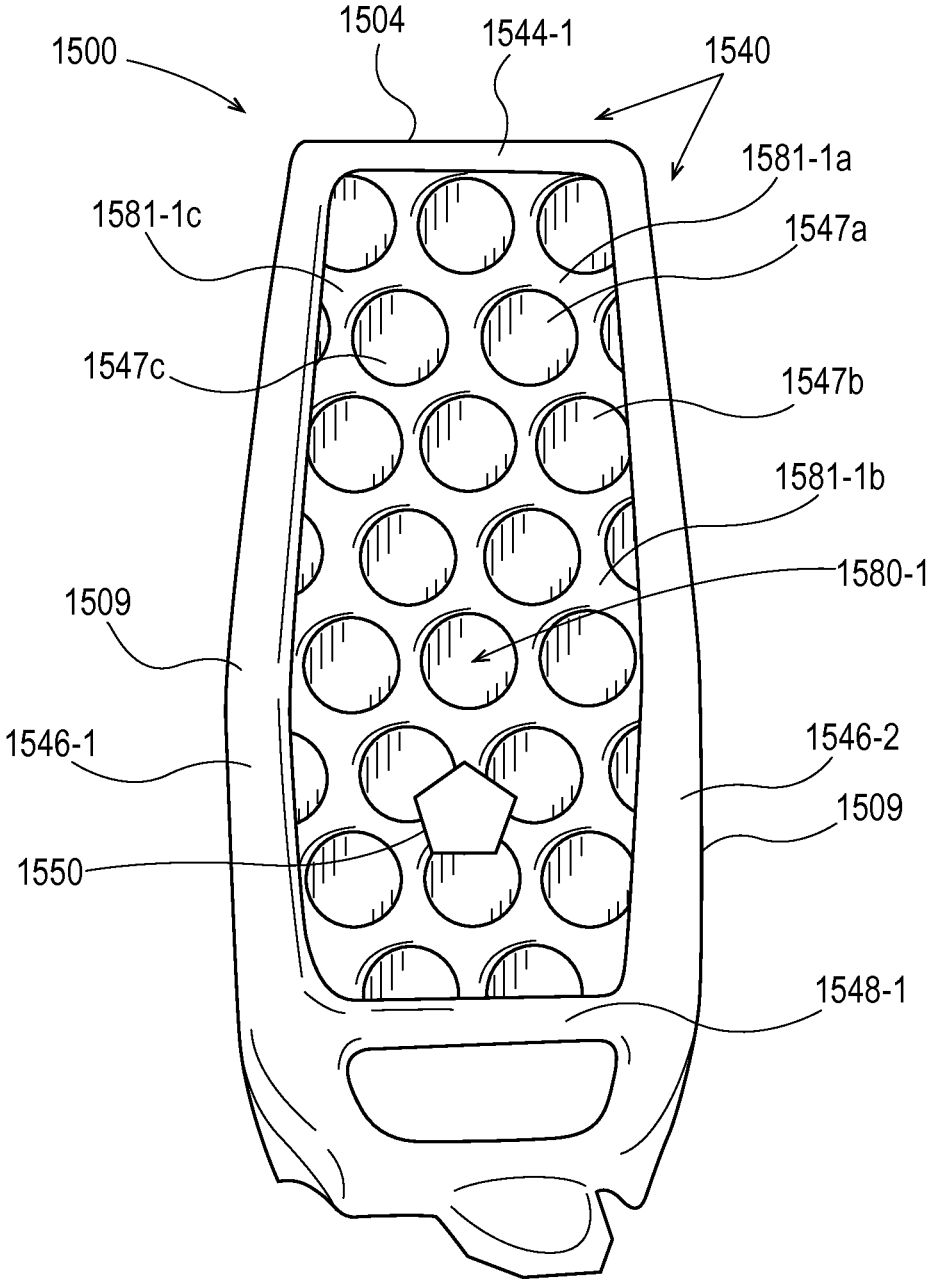
FIG. 17 illustrates a disposable flexible container of at least one aspect of the present disclosure, having, in addition to structural support members, one form of non-structural volumes on at least one nonstructural panel thereof.
Figure 18A:
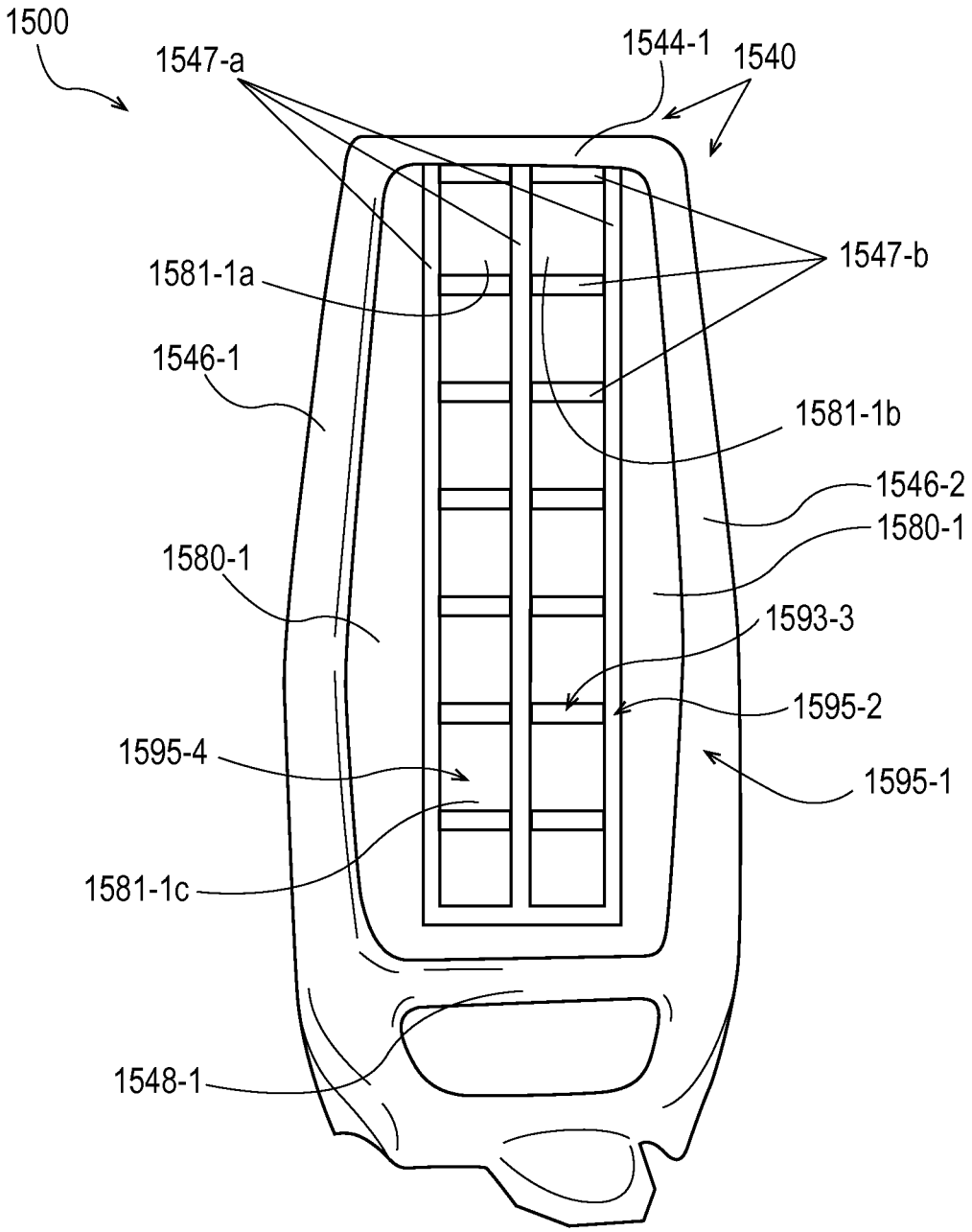
FIG. 18A illustrates a disposable flexible container of at least one aspect of the present disclosure, having, in addition to structural volume members, a grid of non-structural volume members on at least one nonstructural panel thereof

FIGS. 17 and 18A illustrate disposable flexible containers 1500 comprising a product volume 1550 for a fluent product at least partially defined by a nonstructural panel 1580-1 having one or more flat spaces such as 1581-1*a* and 1581-1*b* and one or more structural support volumes such as 1544-1, 1546-1, 1546-2 and 1548-1. The disposable flexible container 1500 also includes one or more surface elements such as 1547*a* projecting outwardly in relation to the one or more flat spaces such as 1581-1*a* and 1581-1*b* on the nonstructural panel 1580-1. The one or more surface elements 1547-*a*, 1547-*b*, 1547-*c*, etc. may suitably comprise a pattern of nonstructural volumes which projects outwardly of the one or more flat spaces 1581-1*a*, 1581-1*b*, 1581-1*c*, etc. on the squeeze panel 1580-1 and, while shown in FIG. 18A as being arranged in a regular grid-like pattern, it will be understood and appreciated that the pattern of nonstructural volumes on the squeeze panel 1580-1 may comprise any desired regular or irregular pattern wherein the nonstructural volumes have any desired shape(s) and/or size(s). Preferably, the one or more structural support volumes such as 1544-1, 1546-1, 1546-2 and 1548-1 comprise a structural support frame generally designated 1540 configured to render the container 1500 self-supporting. In some embodiments the one or more structural support volumes are arranged to generate and maintain tension in the nonstructural panel 1580-1 when expanded.

For the embodiment of FIG. 18A, hardness was measured at four distinct locations, by the following numbers in FIG. 18A: a first measurement location 1595-1 (on an outer surface of the middle structural support member 1546-2, in its lowermost portion, in the middle of its front); a second measurement location 1595-2 (laterally inboard from the first measurement location 1595-1, on an outer surface of a surface element 1547-*a*); a third measurement location 1595-3 (laterally inboard from the second measurement location 1595-2, on an outer surface of the surface element 1547-*b*); and a fourth measurement location 1595-4 (on an outer surface of the flat space 1581-1*c*, about in its middle).

Figure 18B:
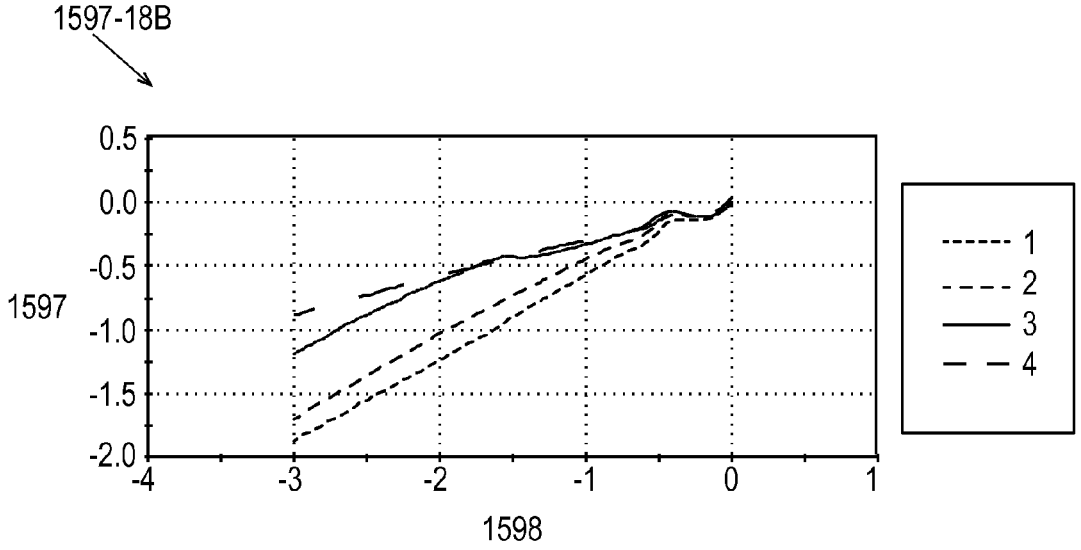
FIG. 18B is a plot of hardness measurements at various locations along outer surfaces of the flexible container of FIG. 17*a;*

FIG. 18B depicts a plot 1596-18B of the hardness measurements at the four measurement locations in FIG. 18A.

One can appreciate that the hardness is lower in the non-structural panel region of the container (i.e. location 1595-4) than along the structural support volume (i.e. location 1594-1), the hardness is lower still along the nonstructural volumes (i.e., location 1594-3), and the hardness is lowest at an intersection of two non-structural volume segments, i.e., generally vertical and generally horizontal segments of the non-structural volumes (i.e. location 1594-2).

Figure 19A:
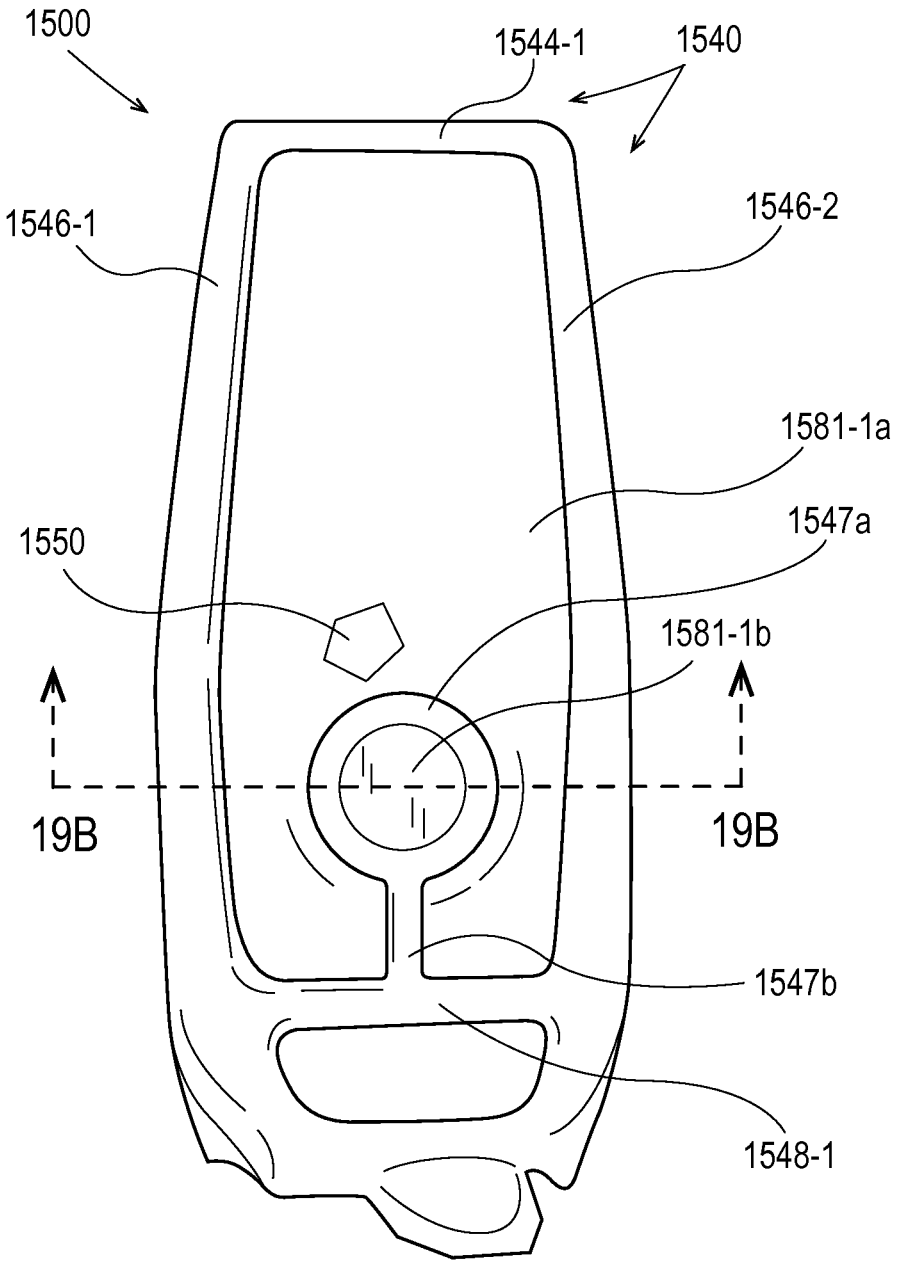
FIG. 19A illustrates a disposable flexible container of at least one aspect of the present disclosure, including a nonstructural volume member in a nonstructural panel thereof.

Referring to FIG. 19A, a disposable flexible container 1500 comprises a product volume 1550 for a fluent product at least partially defined by a nonstructural panel 1580-1 having one or more flat spaces such as 1581-1*a* and 1581-1*b* and one or more structural support volumes such as 1544-1, 1546-1, 1546-2 and 1548-1. The disposable flexible container 1500 also includes one or more surface elements such as 1547*a* and 1547*b*, projecting outwardly in relation to the one or more flat spaces such as 1581-1*a* and 1581-1*b* on the nonstructural panel 1580-1. Preferably, the one or more structural support volumes such as 1544-1, 1546-1, 1546-2 and 1548-1 comprise a structural support frame generally designated 1540 configured to prevent the container 1500 from collapsing and arranged to generate and maintain tension in the nonstructural panel 1580-1 when expanded. The surface element 1547*a* may serve as both a visual and a tactile indicator of an optimal location to apply pressure to the nonstructural panel 1580-1 so as to serve as a cue to the user as to where to squeeze the nonstructural panel 1580-1 to dispense product from the container 1500.

Figure 19B:
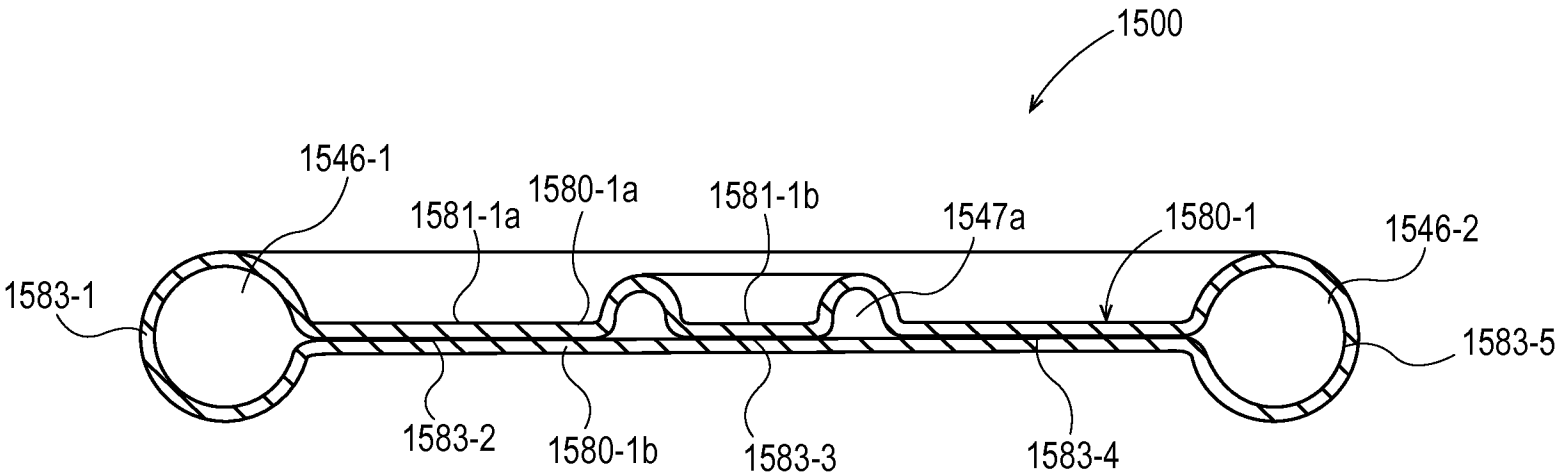
FIG. 19B is a cross-sectional view taken generally along the line 19*a*-19*a* through the front panel of the container of FIG. 19.

Referring to FIG. 19B, the nonstructural panel 1580-1 may comprise a double wall 1580-1*a*, 1580-1*b* wherein one or more heat seals join the double wall at discrete locations such as 1583-1, 1583-2, 1583-3, 1583-4, and 1583-5. While heat seals may be used, it will also be understood that the double wall can be joined or bonded where needed by any other known manner of joining two flexible materials together, as described above in connection with the description of "flexible material". The heat seals form at least one or more structural support volumes such as 1546-1 and 1546-2 as well as one or more nonstructural volumes such as 1547*a* comprising the one or more surface elements of the container 1500. Hardness was measured at eight distinct locations, identified by the numbers 1595-1 thru 1595-8 in FIG. 20A.

Figure 20A:
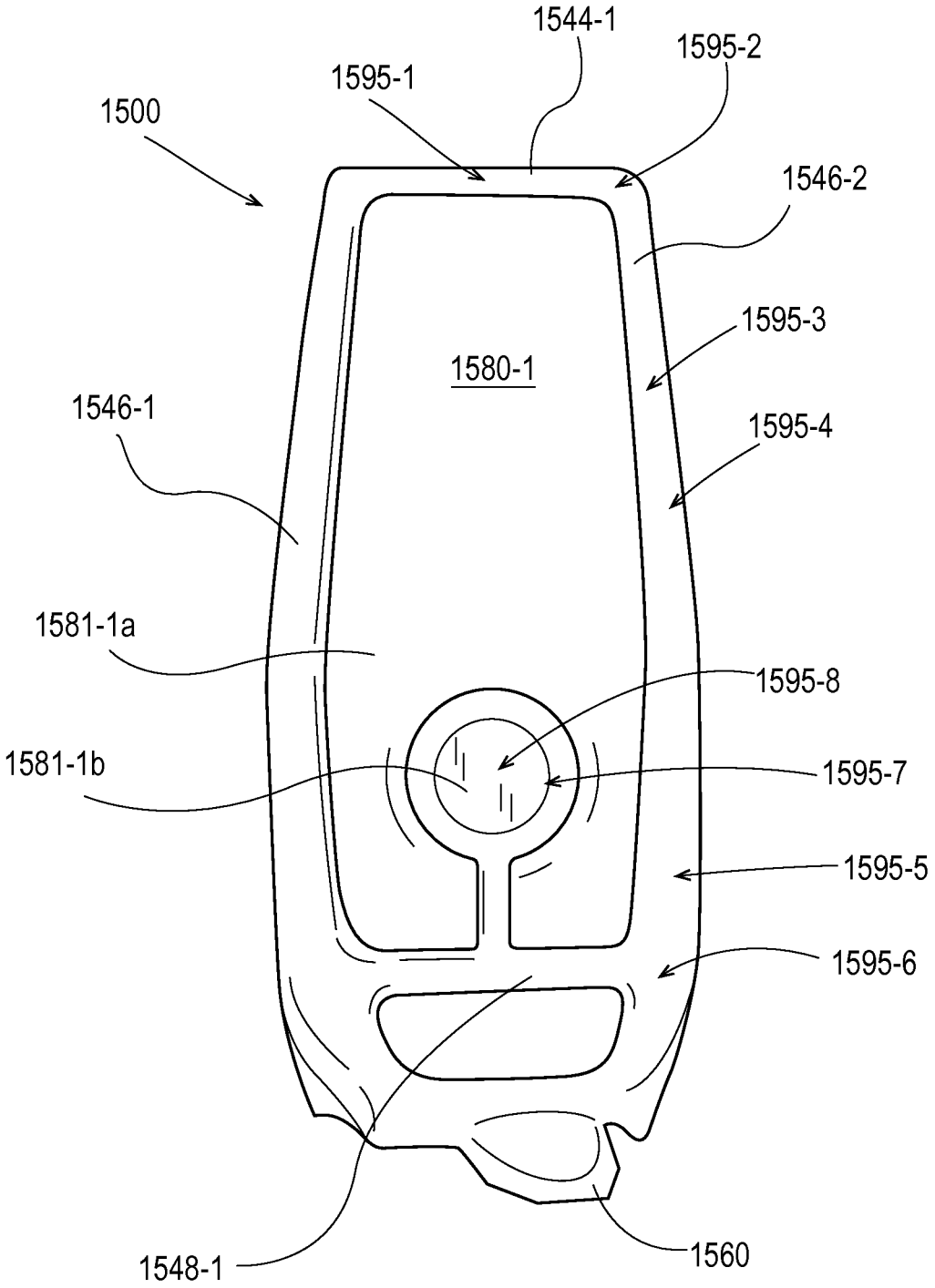
FIG. 20A illustrates the disposable flexible container of FIG. 19, with an identification of a plurality of points at various locations on outer surfaces of the flexible container at which hardness of the container outer surface was tested.
Figure 20B:
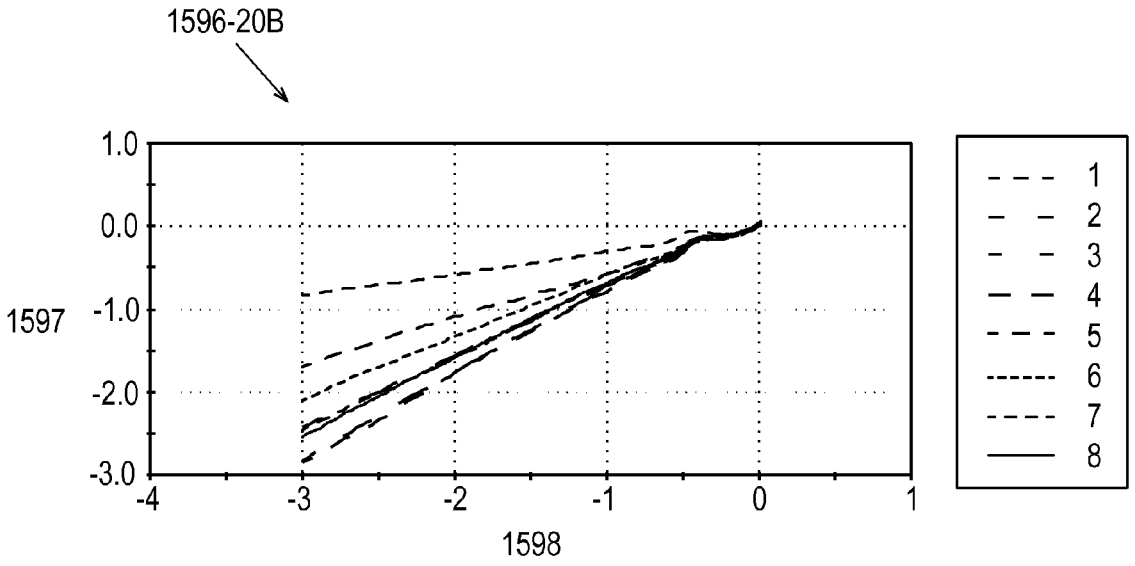
FIG. 20B is a plot of hardness measurements at the locations along the outer surfaces of the flexible container identified in FIG. 20A.

Turning to FIG. 20B, which depicts a plot 1596-20B, one can appreciate that the hardness is highest along the top (generally horizontal) structural support volume 1544-1 (e.g., location 1595-1), lower in the non-structural panel region of the container (e.g., location 1595-8) than along the structural support volume, the hardness is lower still along the nonstructural volumes (e.g., location 1595-7), and the hardness is lowest at an intersection of two non-structural volume segments, i.e., generally vertical and generally horizontal segments of the non-structural volumes (e.g., location 1595-2). As can be appreciated from these tests demonstrating variation in hardness characteristics at different locations, a given disposable flexible container of the present disclosure, the outer surface of the container can have a gradient of hardness.

Additionally or in the alternative, the flexible product container of the present disclosure facilitates tactile interaction with the product in the product volume through the outer surface of the container. For instance, the nonstructural panels are sufficiently thin to permit a user to perceive the viscosity and other characteristics, such as texture, of the fluent product through at least portions of the nonstructural panels that are free of surface elements. This permits consumers to assess viscosity, texture, consistency, etc., and experience a sensation akin to touching the product directly, but without actually touching the product until the product is intentionally dispensed from the container. An entire nonstructural panel 1580-1 or one or more transparent or translucent windows 152 therein may provide a means by which fluent product within the container can not only be seen, but also, may serve as a tactile preview panel by which the user may have limited simulated interaction with the fluent product. By selectively placing surface elements in the form of non-structural volumes along the nonstructural panel that interfere with the ability to perceive the viscosity of the product through the film wall, the manufacturer can select which portions of the container are intended to permit users to perceive product viscosity and which are not. In this respect, a given disposable flexible container of the present disclosure can have a gradient of tactile sensation of the characteristics of the contained product through the outer surface of the container.

Each of the non-structural support volumes and structural support volumes not only serve as a buffer to prevent user perception of product viscosity, but may also act as an insulator in some embodiments. The thermal conductivity coefficient $K_{eff}$ of a gas-filled space such as the non-structural support volumes is about 0.03 Watt/meter K. Materials suitable for forming the flexible container of the present disclosure include sealable foils having a thermal conductivity coefficient $K_{eff}$ of about 3 Watt/meter K. Another suitable material for forming the flexible container of the present disclosure is high density polyethylene (HDPE), having a thermal conductivity coefficient $K_{eff}$ of about 0.5 Watt/meter K. The relatively high thermal conductivity coefficient $K_{eff}$ of sealable foil or HDPE, coupled with the thin wall of the flexible container in the non-structural panels, on the order of about 5 microns to about 1000 microns, or about 25 microns to about 500 microns, or about 50 microns to about 300 microns, for products contained in the flexible container having a temperature lower than about 37° C. (98.6° F.), result in heat being drawn away from a user's skin touching portions of the non-structural panels that are free of surface elements, giving the user a cooling sensation. Additionally, in the non-structural panel region, there may be one or more layers of flexible materials present. For example, there may be two layers, two layers and a cover, three layers, three layers and a cover, four layers, four layers and a cover, and so on. For products contained in the flexible container having a temperature greater than about 37° C. (98.6° F.), there is a transmission of heat from the product to the user's skin. Due to the relatively low thermal conductivity coefficient $K_{eff}$ of the non-structural or structural support volumes, which is due to the gas therein serving as insulators, the heat transfer between the user's skin/body and product contained in the product volume is significantly diminished. Thus, by selectively placing structural and non-structural volumes along the container outer surface that interfere with heat transfer between the user's skin/body and the contained product through the flexible container, the manufacturer can select which portions of the container are intended to permit users to perceive heat transfer to or from the product and which are not. In this respect, a given disposable flexible container of the present disclosure can have a gradient of thermal conductivity resulting in controllable variable tactile sensation of thermal characteristics of the contained product through the outer surface of the container.

Figure 21:
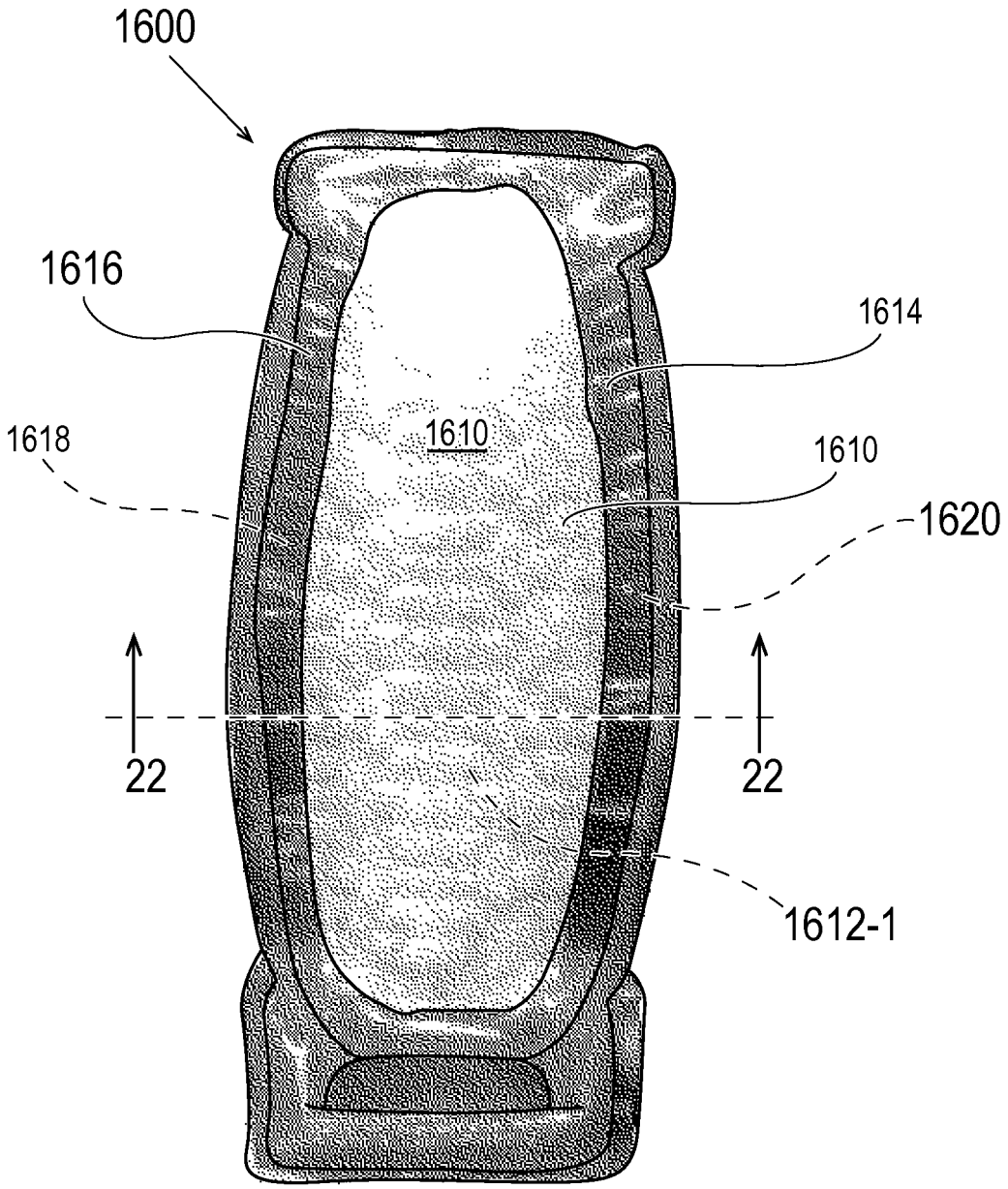
FIG. 21 illustrates a disposable flexible container according to an aspect of the present disclosure wherein a cover material is provided over nonstructural panels of the container.
Figure 22:
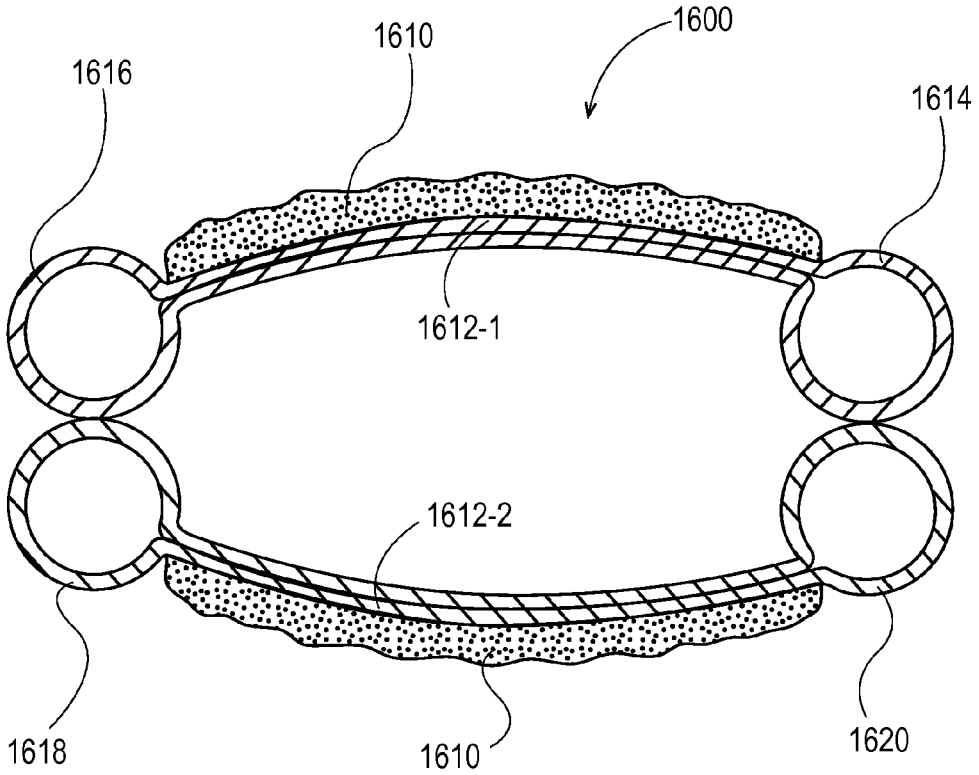
FIG. 22 is a cross-sectional view taken along lines 22-22 of FIG. 21.

Turning now to FIGS. 21-28, one or more cover materials may be used to achieve a gradient in the disposable flexible containers of the present disclosure. For instance, as illustrated in FIGS. 21-22, a disposable flexible container 1600 may be provided with a cover material 1610 on the nonstructural panels 1612-1, 1612-2 thereof. In this embodiment, the structural support volumes 1614, 1616, 1618, 1620 are not covered by the cover material 1610. The cover material 1610 may be textured so as to improve the feel of the disposable flexible container 1600. Because the cover material 1610 may have thermal conductivity properties and hardness properties different than the underlying nonstructural panels 1612-1, 1612-2, the cover material 1610 may be employed in a manner similar to the above-described nonstructural surface elements to alter the user's ability to tactilely interact with the product through the nonstructural panel 1612-1, 1612-2. In other words, a gradient can be achieved by selective use of the cover material 1610 at different desired locations, i.e., positions, coordinates, regions, or zones, of the disposable flexible container 1600.

Figure 23:
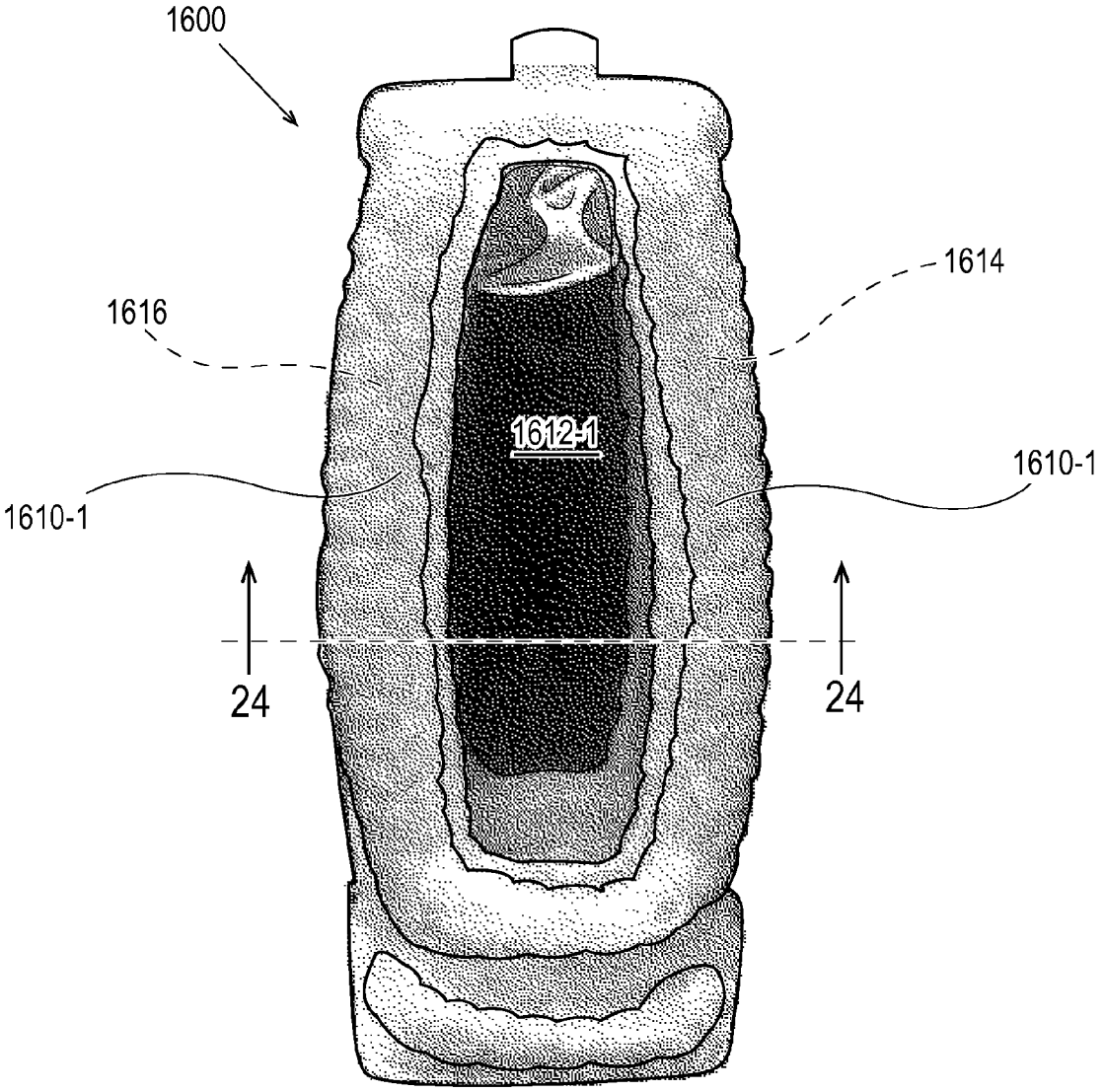
FIG. 23 illustrates a disposable flexible container according to an aspect of the present disclosure wherein structural support members of the container are covered by a cover material.
Figure 24:
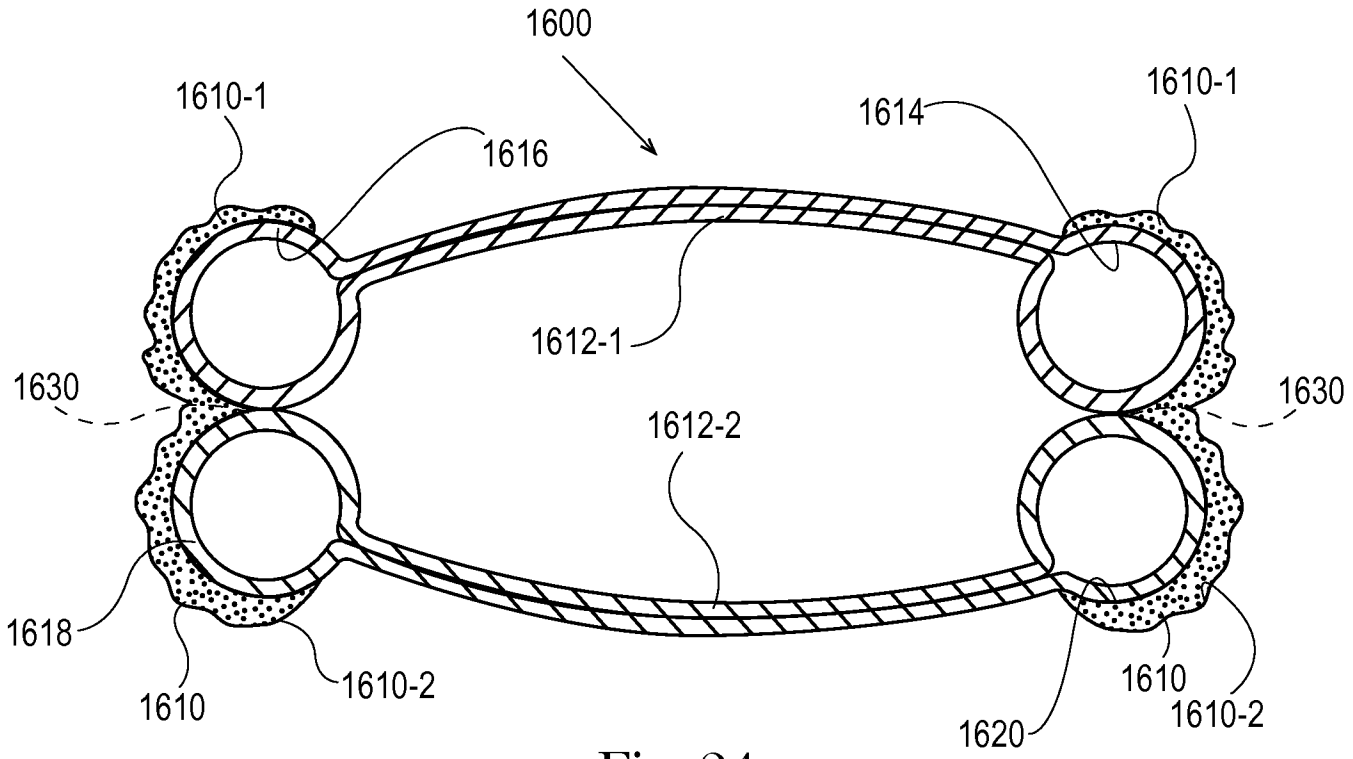
FIG. 24 is a cross-sectional view taken along lines 24-24 of FIG. 23.

With reference to FIGS. 23-24, a disposable flexible container 1600 is provided with a cover material 1610 only on the structural support volumes 1614, 1616, 1618, 1620. The cover material 1610 may be a single contiguous cover, or alternately, as indicated by the dashed lines 1630 in FIG. 24, the cover material 1610 may be a plurality of covers, such as a first cover 1610-1 covering only the structural support volumes 1614, 1616 and a second cover 1610-2 covering only the structural support volumes 1618, 1620.

Figure 25:
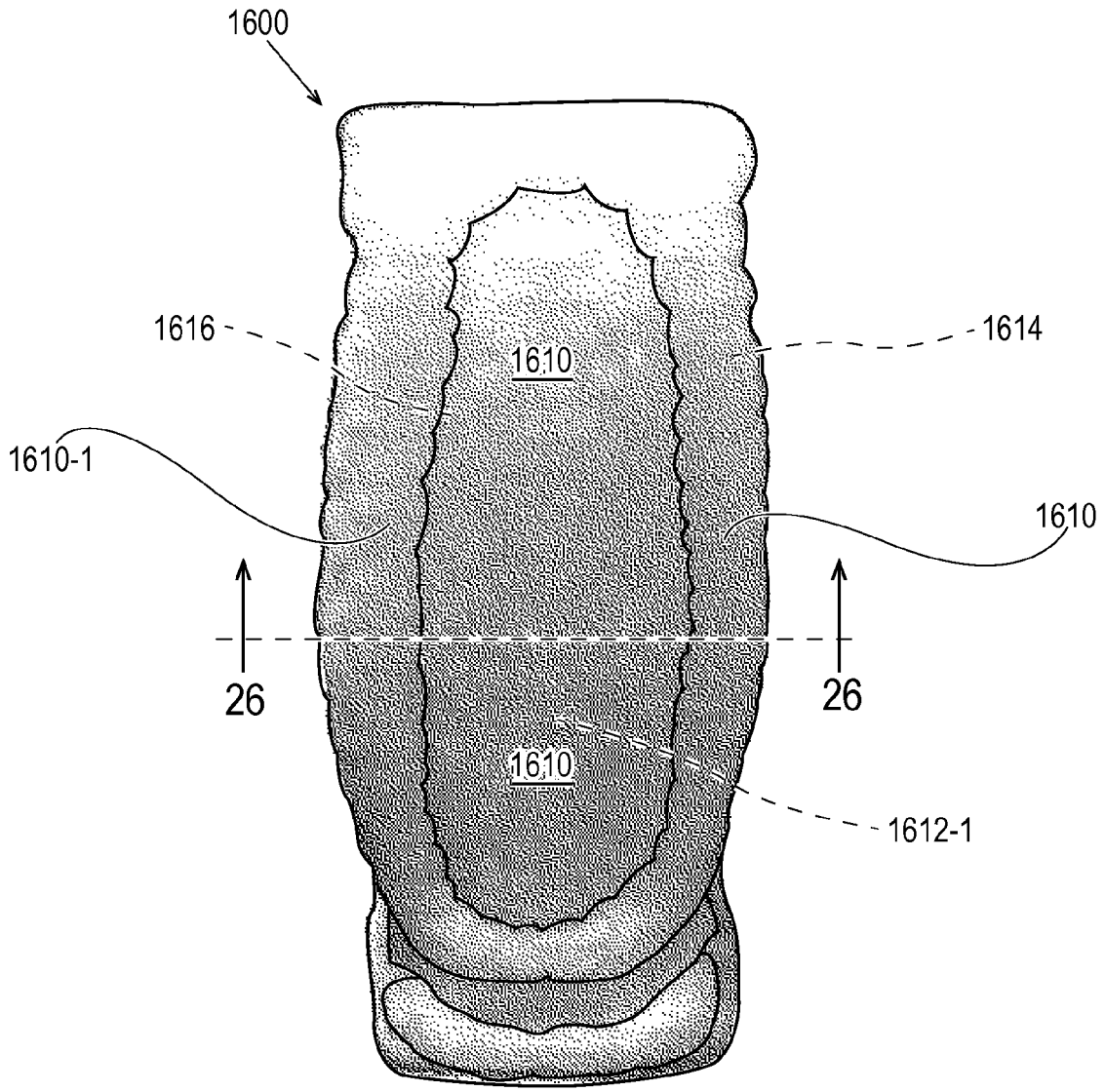
FIG. 25 illustrates a disposable flexible container according to an aspect of the present disclosure wherein an entirety of the container is covered by a cover material.
Figure 26:
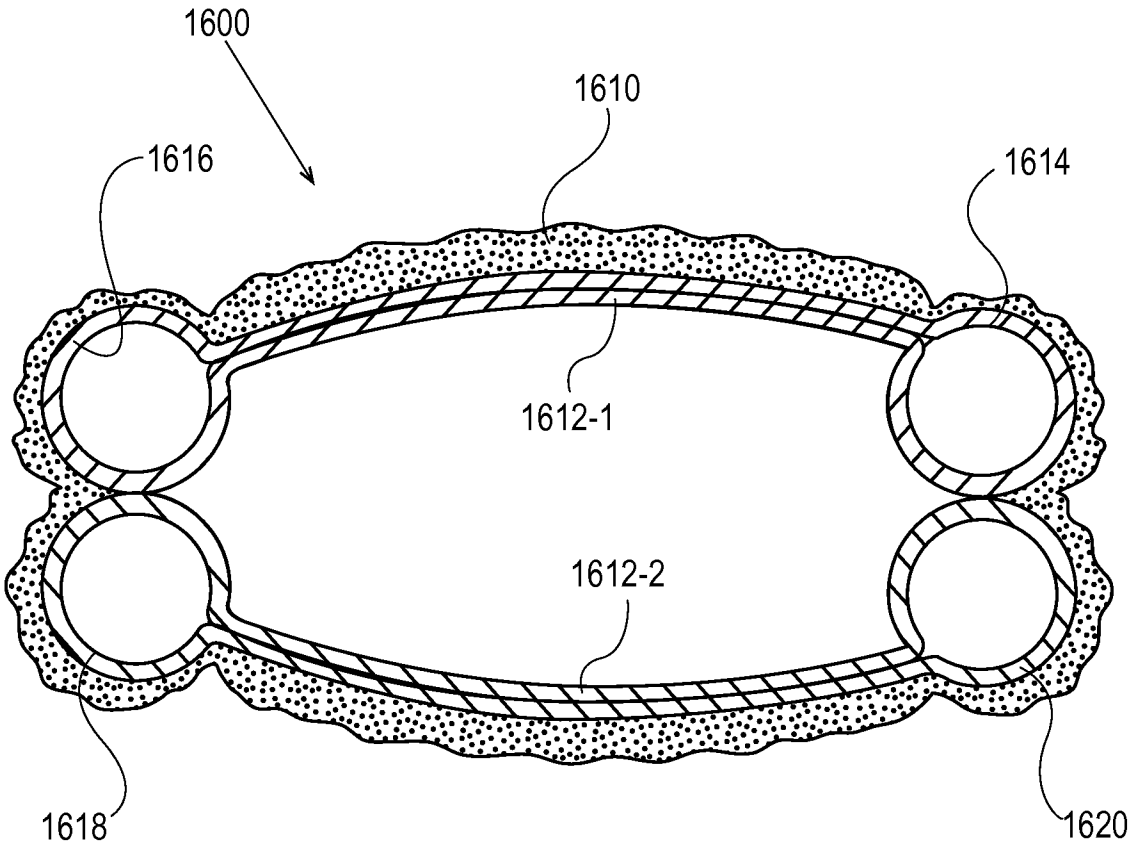
FIG. 26 is a cross-sectional view taken along lines 26-26 of FIG. 25.
Figure 27:
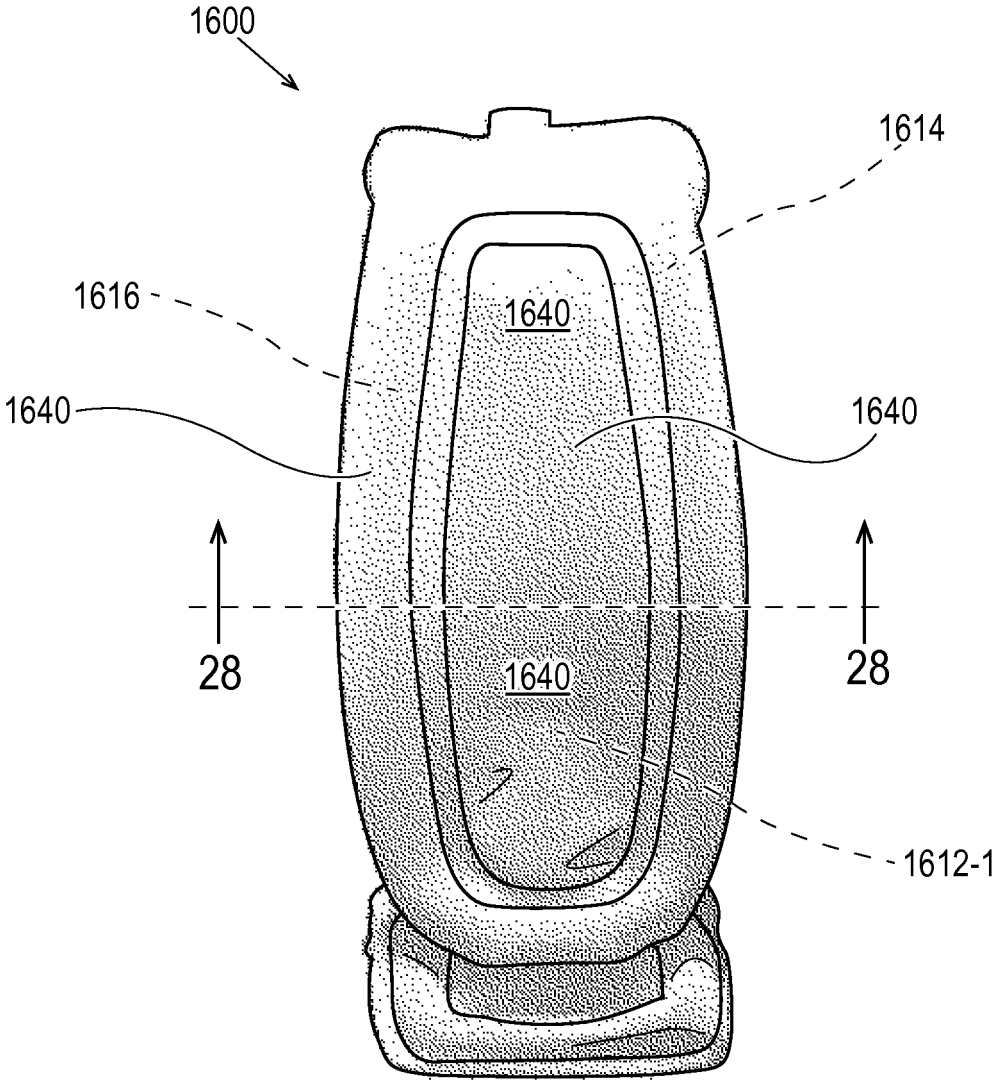
FIG. 27 illustrates a disposable flexible container according to an aspect of the present disclosure wherein an entirety of the container is covered by a cover material having a different texture the cover material illustrated in FIG. 25.
Figure 28:
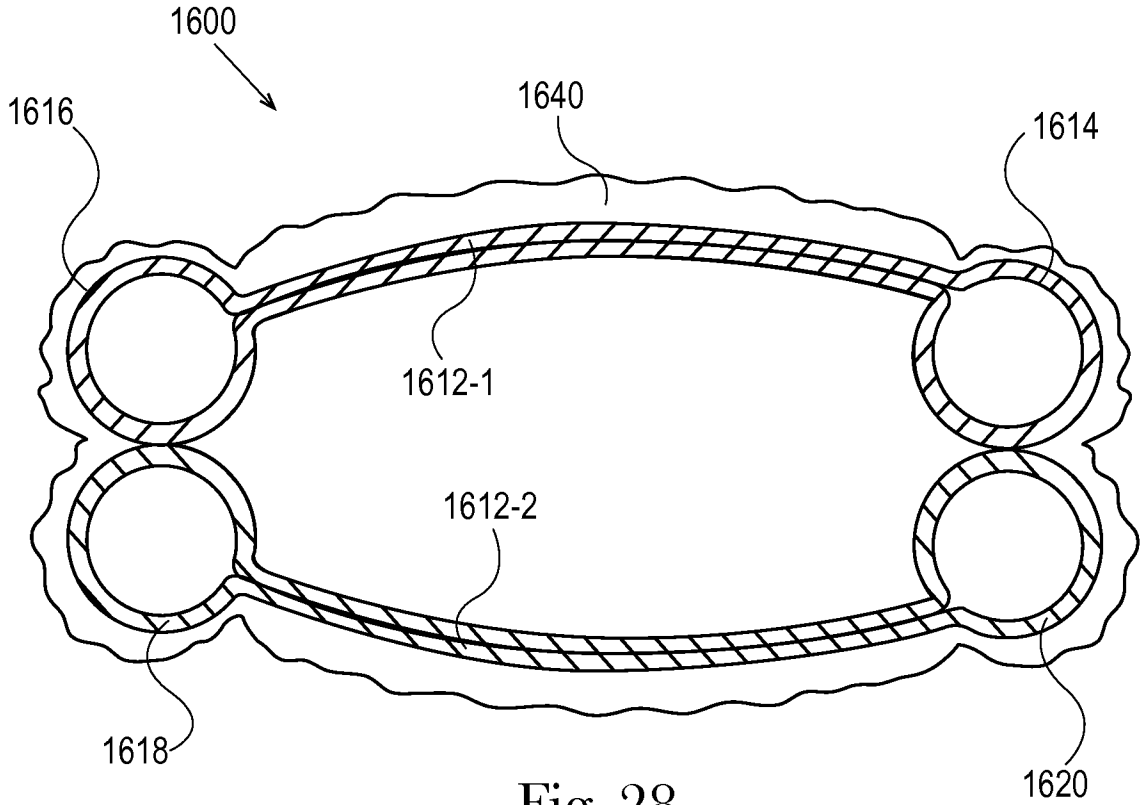
FIG. 28 is a cross-sectional view taken along lines 28-28 of FIG. 27.

With reference to FIGS. 25-26, it will be appreciated that the cover material 1610 may cover an entirety of the disposable flexible container 1600, or at least the entire non-structural panels 1612-1, 1612-2 and structural support volumes 1614, 1616, 1618, 1620 above the base. As illustrated in FIGS. 27-28, a cover material 1640 (which is shown as covering the entirety of the disposable flexible container 1600, but could instead cover only one or more portions thereof) is provided with a different texture than that of the cover material 1610. Different cover materials may be employed at different locations of the disposable flexible container 1600 to achieve a gradient in one or more tactile properties or other characteristics, consistent with the foregoing descriptions.

The cover material 1610, 1640 of any of FIGS. 21-28 can be joined to at least a portion of the outer surface of the container using any suitable methods, including, for example, lamination, heat seal, adhesive, weld, tack, and sew methods. The cover material can be any suitable flexible material including, for example, a film laminate, a non-woven, a vacuum-formed material, a hydro-formed material, a woven material, and a solid-state formed material.

Part, parts, or all of any of the embodiments disclosed herein can be combined with part, parts, or all of other embodiments known in the art of flexible containers, including those described below.

Embodiments of the present disclosure can use any and all embodiments of materials, structures, and/or features for flexible containers, as well as any and all methods of making and/or using such flexible containers, as disclosed in the following patent applications: (1) U.S. non-provisional application Ser. No. 13/888,679 filed May 7, 2013, entitled "Flexible Containers" and published as US20130292353 (applicant's case 12464M); (2) U.S. non-provisional application Ser. No. 13/888,721 filed May 7, 2013, entitled "Flexible Containers" and published as US20130292395 (applicant's case 12464M2); (3) U.S. non-provisional application Ser. No. 13/888,963 filed May 7, 2013, entitled "Flexible Containers" published as US20130292415 (applicant's case 12465M); (4) U.S. non-provisional application Ser. No. 13/888,756 May 7, 2013, entitled "Flexible Containers Having a Decoration Panel" published as US20130292287 (applicant's case 12559M); (5) U.S. non-provisional application Ser. No. 13/957,158 filed Aug. 1, 2013, entitled "Methods of Making Flexible Containers" published as US20140033654 (applicant's case 12559M); and (6) U.S. non-provisional application Ser. No. 13/957,187 filed Aug. 1, 2013, entitled "Methods of Making Flexible Containers" published as US20140033655 (applicant's case 12579M2); (7) U.S. non-provisional application Ser. No. 13/889,000 filed May 7, 2013, entitled "Flexible Containers with Multiple Product Volumes" published as US20130292413 (applicant's case 12785M); (8) U.S. non-provisional application Ser. No. 13/889,061 filed May 7, 2013, entitled "Flexible Materials for Flexible Containers" published as US20130337244 (applicant's case 12786M); (9) U.S. non-provisional application Ser. No. 13/889,090 filed May 7, 2013, entitled "Flexible Materials for Flexible Containers" published as US20130294711 (applicant's case 12786M2); (10) U.S. provisional application 61/861,100 filed Aug. 1, 2013, entitled "Disposable Flexible Containers having Surface Elements" (applicant's case 13016P); (11) U.S. provisional application 61/861,106 filed Aug. 1, 2013, entitled "Flexible Containers having Improved Seam and Methods of Making the Same" (applicant's case 13017P); (12) U.S. provisional application 61/861,118 filed Aug. 1, 2013, entitled "Methods of Forming a Flexible Container" (applicant's case 13018P); (13) U.S. provisional application 61/861,129 filed Aug. 1, 2013, entitled "Enhancements to Tactile Interaction with Film Walled Packaging Having Air Filled Structural Support Volumes" (applicant's case 13019P); (14) Chinese patent application CN2013/085045 filed Oct. 11, 2013, entitled "Flexible Containers Having a Squeeze Panel" (applicant's case 13036); (15) Chinese patent application CN2013/085065 filed Oct. 11, 2013, entitled "Stable Flexible Containers" (applicant's case 13037); (16) U.S. provisional application 61/900,450 filed Nov. 6, 2013, entitled "Flexible Containers and Methods of Forming the Same" (applicant's case 13126P); (17) U.S. provisional application 61/900,488 filed Nov. 6, 2013, entitled "Easy to Empty Flexible Containers" (applicant's case 13127P); (18) U.S. provisional application 61/900,501 filed Nov. 6, 2013, entitled "Containers Having a Product Volume and a Stand-Off Structure Coupled Thereto" (applicant's case 13128P); (19) U.S. provisional application 61/900,508 filed Nov. 6, 2013, entitled "Flexible Containers Having Flexible Valves" (applicant's case 13129P); (20) U.S. provisional application 61/900,514 filed Nov. 6, 2013, entitled "Flexible Containers with Vent Systems" (applicant's case 13130P); (21) U.S. provisional application 61/900,765 filed Nov. 6, 2013, entitled "Flexible Containers for use with Short Shelf-Life Products and Methods for Accelerating Distribution of Flexible Containers" (applicant's case 13131P); (22) U.S. provisional application 61/900,794 filed Nov. 6, 2013, entitled "Flexible Containers and Methods of Forming the Same" (applicant's case 13132P); (23) U.S. provisional application 61/900,805 filed Nov. 6, 2013, entitled "Flexible Containers and Methods of Making the Same" (applicant's case 13133P); (24) U.S. provisional application 61/900,810 filed Nov. 6, 2013, entitled "Flexible Containers and Methods of Making the Same" (applicant's case 13134P); each of which is hereby incorporated by reference.

Part, parts, or all of any of the embodiments disclosed herein also can be combined with part, parts, or all of other embodiments known in the art of containers for fluent products, so long as those embodiments can be applied to flexible containers, as disclosed herein. For example, in various embodiments, a flexible container can include a vertically oriented transparent strip, disposed on a portion of the container that overlays the product volume, and configured to show the level of the fluent product in the product volume.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or patent publication, is hereby incorporated herein by reference in its entirety unless expressly excluded or otherwise limited. The citation of any document is not an admission that it is prior art with respect to any document disclosed or claimed herein or that it alone, or in any combination with any other reference or references, teaches, suggests or discloses any such embodiment. Further, to the extent that any meaning or definition of a term in this document conflicts with any meaning or definition of the same term in a document incorporated by reference, the meaning or definition assigned to that term in this document shall govern.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

What is claimed is:

1. A non-durable flexible container for a fluent product, the container comprising:

a product volume for the fluent product and at least partially defined by one or more nonstructural panels, each formed by one or more flexible materials; and one or more structural support volumes associated with the nonstructural panel to generate and maintain tension in the nonstructural panel, wherein at least one of the one or more structural support volumes is inflated to a gauge pressure in a range between 20,000 Pa and 69,000 Pa, and the nonstructural panel is configured to provide a tactile perception of one or more characteristics of a fluent product in the nonstructural panel, when the nonstructural panel is touched.

2. The container of claim 1, wherein the range is between 27,500 Pa and 55,000 Pa.

3. The container of claim 1, wherein the gauge pressure is about 34,000 Pa.

4. The container of claim 1, wherein the nonstructural panel has a thermal conductivity between 0.5 W/meter K and 3 W/meter K.

5. The container of claim 4, wherein each of the one or more structural support volumes has a thermal conductivity between 0.03 W/meter K and 0.5 W/meter K.

6. The container of claim 1, wherein the nonstructural panel has a thickness between 50 microns and 300 microns.

7. The container of claim 1, wherein substantially all of each of the one of the nonstructural panels is opaque.

8. The container of claim 1, including a cover material that is joined to at least a portion of an outer surface of at least one of the nonstructural panels.

9. The container of claim 8, wherein the cover material covers substantially all of the outer surface of at least one of the nonstructural panels.

10. The container of claim 9, wherein the cover material is directly connected to the outer surface of at least one of the nonstructural panels.

11. The container of claim 1, including:

at least two nonstructural panels, each with an outer surface; and a cover material that covers substantially all of the outer surface of each of the nonstructural panels.

12. The container of claim 8, wherein the cover material does not cover the one or more structural support volumes.

13. The container of claim 1, including a cover material that is joined to at least a portion of an outer surface of at least one of the one or more structural support volumes.

14. The container of claim 13, wherein the cover material covers substantially all of the outer surface of at least one of the one or more structural support volumes.

15. The container of claim 14, wherein the cover material is directly connected to the outer surface of at least one of the one or more structural support volumes.

16. The container of claim 1, including:

a structural support frame, formed by the one or more structural support volumes; and a cover material that covers substantially all of an outer surface of the structural support frame.

17. The container of claim 13, wherein the cover material does not cover the one or more nonstructural panels.

18. The container of claim 1, including a cover material joined to an outer surface of the container, wherein the cover material is a film laminate.

19. The container of claim 1, including a cover material joined to an outer surface of the container, wherein the cover material is a non-woven.

20. The container of claim 1, wherein the container is disposable.

* * * * *